US006116883A

United States Patent [19]

Takeuchi et al.

[11] Patent Number: 6,116,883

[45] Date of Patent: Sep. 12, 2000

[54] MELT SPIN SYSTEM FOR PRODUCING SKIN-CORE HIGH THERMAL BOND STRENGTH FIBERS

[75] Inventors: Kunihiko Takeuchi; Rakesh K. Gupta; Shiv Sibal; Richard J. Coffin, all of Conyers, Ga.; Walter J. Freeman, Landenberg, Pa.

[73] Assignee: Fiberco, Inc., Wilmington, Del.

[21] Appl. No.: 08/598,240

[22] Filed: Feb. 7, 1996

Related U.S. Application Data

[60] Continuation of application No. 08/378,271, Jan. 26, 1995, abandoned, which is a division of application No. 08/080, 849, Jun. 24, 1993, abandoned.

[51] Int. Cl.[7] ..... B29C 47/86; D01D 4/00; D01D 5/088

[52] U.S. Cl. ..... 425/72.2; 425/175.8 R; 425/378.2; 425/464; 425/DIG. 13

[58] Field of Search ..... 425/72.2, 461, 425/378.2, DIG. 13, 463, 464, 174.8 R

[56] References Cited

U.S. PATENT DOCUMENTS

| | | |
|---|---|---|
| 2,335,922 | 12/1943 | Dreyfus . |
| 2,715,075 | 8/1955 | Wolinski . |
| 2,715,076 | 8/1955 | Wolinski . |
| 2,715,077 | 8/1955 | Wolinski . |
| 2,715,256 | 8/1955 | Siegrist . |
| 2,904,828 | 9/1959 | Smith . |
| 2,907,687 | 10/1959 | Scigliano . |
| 2,985,995 | 5/1961 | Bunting, Jr. et al. . |
| 3,067,458 | 12/1962 | Dauchert . |
| 3,174,183 | 3/1965 | Siegel . |
| 3,216,187 | 11/1965 | Chantry et al. . |
| 3,316,859 | 5/1967 | Cenzato . |
| 3,353,211 | 11/1967 | Heijnis . |
| 3,354,250 | 11/1967 | Killoran et al. . |
| 3,361,659 | 1/1968 | Cenzato . |
| 3,364,537 | 1/1968 | Bunting, Jr. et al. . |
| 3,420,724 | 1/1969 | Saunders . |

(List continued on next page.)

FOREIGN PATENT DOCUMENTS

| | | |
|---|---|---|
| 652349 | 11/1962 | Canada . |
| 0279511 | 8/1988 | European Pat. Off. . |
| 0391438 | 10/1990 | European Pat. Off. . |
| 0445536 | 9/1991 | European Pat. Off. . |
| 552013 | 7/1993 | European Pat. Off. . |
| 719879 | 7/1996 | European Pat. Off. . |
| 1142065 | 9/1957 | France . |
| 3612610 | 10/1987 | Germany . |
| 4234790 | 4/1993 | Germany . |
| 48-18519 | 3/1973 | Japan . |
| 59-066508 | 4/1984 | Japan . |
| 62-177207 | 8/1987 | Japan . |
| 63-92709 | 4/1988 | Japan . |
| 63-99310 | 4/1988 | Japan . |
| 63-275706 | 11/1988 | Japan . |
| 392416 | 4/1991 | Japan . |
| 34908 | 1/1957 | Luxembourg . |
| 738474 | 10/1955 | United Kingdom . |
| 2121423 | 12/1983 | United Kingdom . |
| 2258869 | 2/1993 | United Kingdom . |

*Primary Examiner*—Robert Davis
*Attorney, Agent, or Firm*—Greenblum & Bernstein, P.L.C.

[57] ABSTRACT

Process and apparatus for spinning polymer filaments permits the obtaining of skin-core filament structure by feeding a polymer composition to a spinnerette at a flow rate sufficient to obtain a spinning speed of about 10 to 200 meters per minute through the spinnerette; heating the polymer composition at a location at or adjacent to the spinnerette so as to heat the polymer composition to a sufficient temperature to obtain a skin-core filament structure upon quenching in an oxidative atmosphere; extruding the heated polymer composition through the spinnerette at a spinning speed of about 10 to 200 meters per minute to form molten filaments; and quenching the molten filaments in an oxidative atmosphere so as to effect oxidative chain scission degradation of at least a surface of the molten filaments to obtain filaments having a skin-core structure.

96 Claims, 14 Drawing Sheets

U.S. PATENT DOCUMENTS

| | | | |
|---|---|---|---|
| 3,428,506 | 2/1969 | Johnstone . | |
| 3,436,298 | 4/1969 | Oppenlander et al. . | |
| 3,437,725 | 4/1969 | Pierce . | |
| 3,484,916 | 12/1969 | Johnstone . | |
| 3,505,164 | 4/1970 | Oppenlander . | |
| 3,509,013 | 4/1970 | Oppenlander . | |
| 3,516,899 | 6/1970 | Saunders . | |
| 3,533,904 | 10/1970 | Jurkiewitsch . | |
| 3,537,135 | 11/1970 | Santangelo . | |
| 3,597,268 | 8/1971 | Smith . | |
| 3,601,846 | 8/1971 | Hudnall . | |
| 3,616,168 | 10/1971 | Johnstone . | |
| 3,663,675 | 5/1972 | Fukuma et al. . | |
| 3,693,341 | 9/1972 | Higgins, Jr. . | |
| 3,807,917 | 4/1974 | Shimoda et al. . | |
| 3,862,265 | 1/1975 | Steinkamp et al. . | |
| 3,898,209 | 8/1975 | Watson et al. . | |
| 3,900,678 | 8/1975 | Aishima et al. . | |
| 3,907,057 | 9/1975 | Reddekopp . | |
| 3,907,957 | 9/1975 | Shaffer . | |
| 4,035,127 | 7/1977 | Ogasawara et al. . | |
| 4,115,620 | 9/1978 | Gupta et al. . | |
| 4,119,420 | 10/1978 | Shono et al. . | |
| 4,121,918 | 10/1978 | Shono et al. . | |
| 4,134,882 | 1/1979 | Frankfort et al. . | |
| 4,193,961 | 3/1980 | Roberts . | |
| 4,195,051 | 3/1980 | Frankfort et al. . | |
| 4,251,200 | 2/1981 | Parkin . | |
| 4,259,399 | 3/1981 | Hill . | |
| 4,296,022 | 10/1981 | Hudson . | |
| 4,303,606 | 12/1981 | Roberts . | |
| 4,347,206 | 8/1982 | Roberts . | |
| 4,361,489 | 11/1982 | Kilsdonk et al. . | |
| 4,438,238 | 3/1984 | Fukushima et al. . | |
| 4,473,677 | 9/1984 | Pellegrini et al. . | |
| 4,477,516 | 10/1984 | Sugihara et al. . | |
| 4,480,000 | 10/1984 | Watanabe et al. . | |
| 4,500,384 | 2/1985 | Tomioka et al. . | |
| 4,511,615 | 4/1985 | Ohta . | |
| 4,521,483 | 6/1985 | Sasaki et al. . | |
| 4,564,553 | 1/1986 | Pellegrini et al. . | |
| 4,576,811 | 3/1986 | Riggs et al. | 425/72.2 |
| 4,578,414 | 3/1986 | Sawyer et al. . | |
| 4,592,943 | 6/1986 | Cancian et al. . | |
| 4,606,872 | 8/1986 | Watanabe | 425/72.2 |
| 4,626,467 | 12/1986 | Hostetter . | |
| 4,632,861 | 12/1986 | Vassilatos . | |
| 4,634,739 | 1/1987 | Vassilatos . | |
| 4,652,484 | 3/1987 | Shiba et al. . | |
| 4,680,156 | 7/1987 | Collier . | |
| 4,717,325 | 1/1988 | Fujimura et al. . | |
| 4,724,109 | 2/1988 | Yamashita et al. . | |
| 4,732,809 | 3/1988 | Harris, Jr. et al. . | |
| 4,769,279 | 9/1988 | Graham . | |
| 4,770,925 | 9/1988 | Uchikawa et al. . | |
| 4,789,592 | 12/1988 | Taniguchi et al. . | |
| 4,795,668 | 1/1989 | Krueger et al. . | |
| 4,798,757 | 1/1989 | Moodrak et al. . | |
| 4,804,577 | 2/1989 | Hazelton et al. . | |
| 4,814,121 | 3/1989 | Watanabe | 425/461 |
| 4,818,587 | 4/1989 | Ejima et al. . | |
| 4,828,911 | 5/1989 | Morman . | |
| 4,830,904 | 5/1989 | Gessner et al. . | |
| 4,837,078 | 6/1989 | Harrington . | |
| 4,840,846 | 6/1989 | Ejima et al. . | |
| 4,840,847 | 6/1989 | Ohmae et al. . | |
| 4,842,922 | 6/1989 | Krupp et al. . | |
| 4,850,836 | 7/1989 | Maeda et al. | 425/72.2 |
| 4,851,284 | 7/1989 | Yamanoi et al. . | |
| 4,868,031 | 9/1989 | Moodrak et al. . | |
| 4,874,666 | 10/1989 | Kubo et al. . | |
| 4,883,707 | 11/1989 | Newkirk . | |
| 4,909,976 | 3/1990 | Cuculo et al. . | |
| 4,921,607 | 5/1990 | Langley . | |
| 4,923,648 | 5/1990 | Hara et al. . | |
| 4,938,832 | 7/1990 | Schmalz . | |
| 4,973,236 | 11/1990 | Hasegawa et al. . | |
| 4,997,875 | 3/1991 | Geddes et al. . | |
| 5,009,951 | 4/1991 | Ohmae et al. . | |
| 5,015,694 | 5/1991 | Milani et al. . | |
| 5,025,124 | 6/1991 | Alfredeen . | |
| 5,033,172 | 7/1991 | Harrington . | |
| 5,045,387 | 9/1991 | Schmalz . | |
| 5,066,723 | 11/1991 | Randall, Jr. et al. . | |
| 5,082,720 | 1/1992 | Hayes . | |
| 5,130,196 | 7/1992 | Nishio et al. . | |
| 5,130,317 | 7/1992 | Baader et al. . | |
| 5,133,917 | 7/1992 | Jezic et al. . | |
| 5,143,779 | 9/1992 | Newkirk et al. . | |
| 5,178,814 | 1/1993 | Lemond | 425/72.2 |
| 5,230,905 | 7/1993 | Fare et al. | 425/72.2 |
| 5,277,974 | 1/1994 | Kubo et al. . | |
| 5,281,378 | 1/1994 | Kozulla . | |
| 5,294,482 | 3/1994 | Gessner . | |
| 5,318,735 | 6/1994 | Kozulla . | |
| 5,336,552 | 8/1994 | Strack et al. . | |
| 5,372,885 | 12/1994 | Tabor et al. . | |
| 5,431,994 | 7/1995 | Kozulla . | |

5,000 X
1.0 um 5,000 X
1.0 μm

Fig- 8
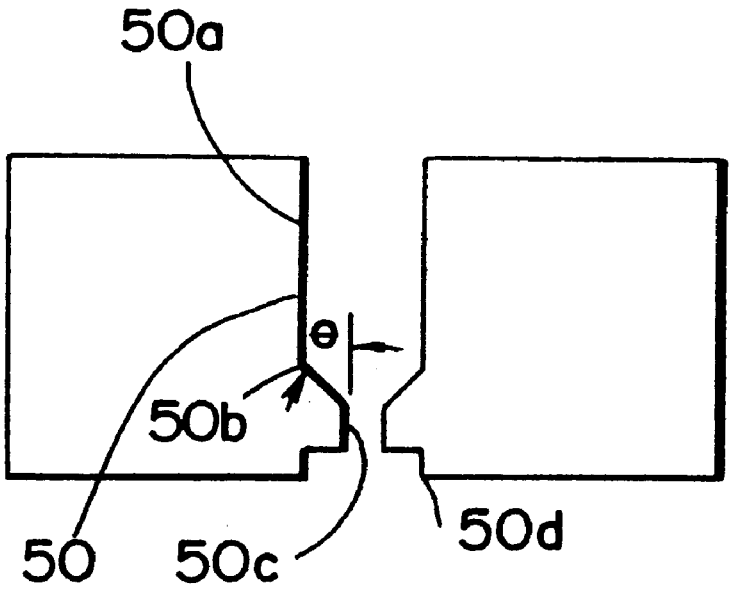
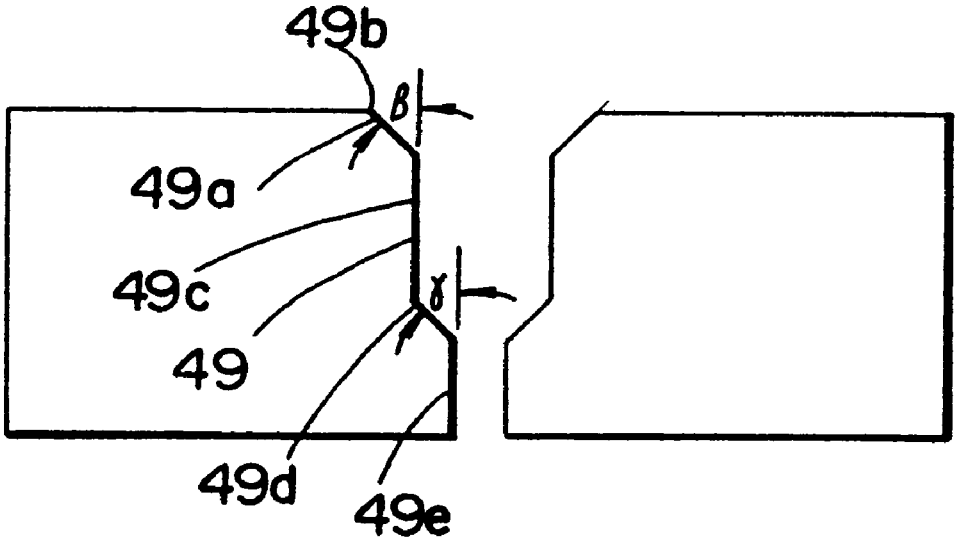
Fig- 7

Fig- 17
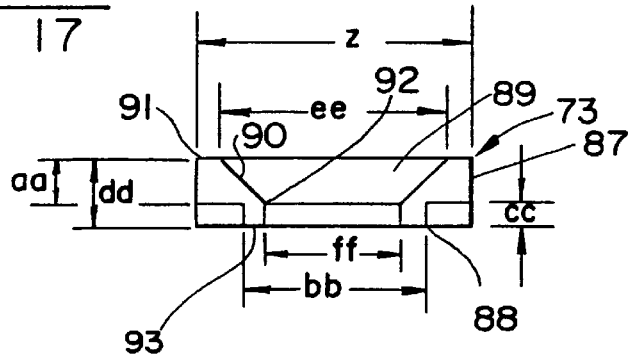
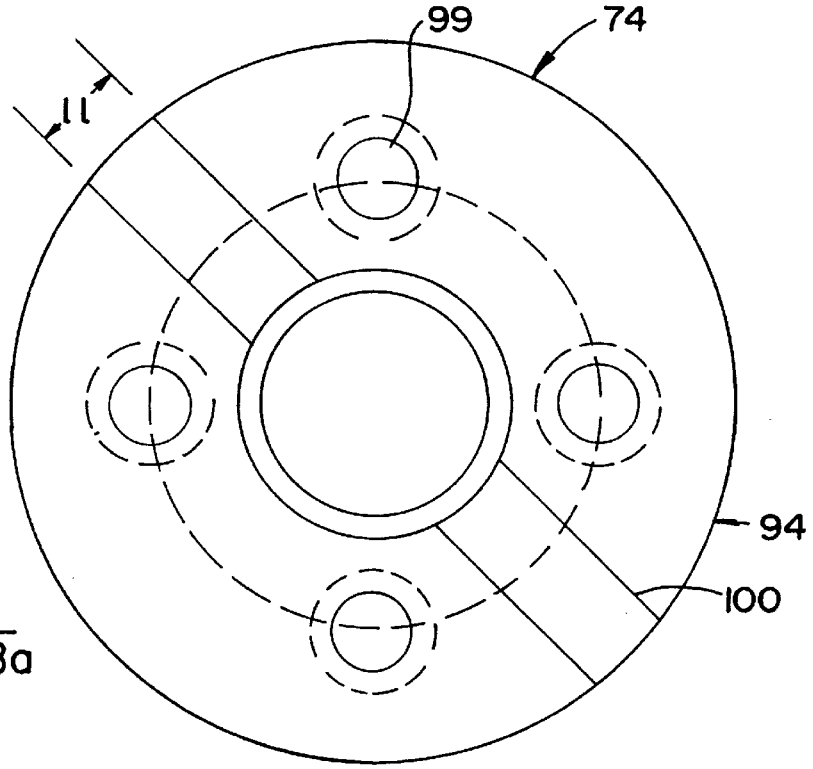
Fig- 18a
Fig- 18b
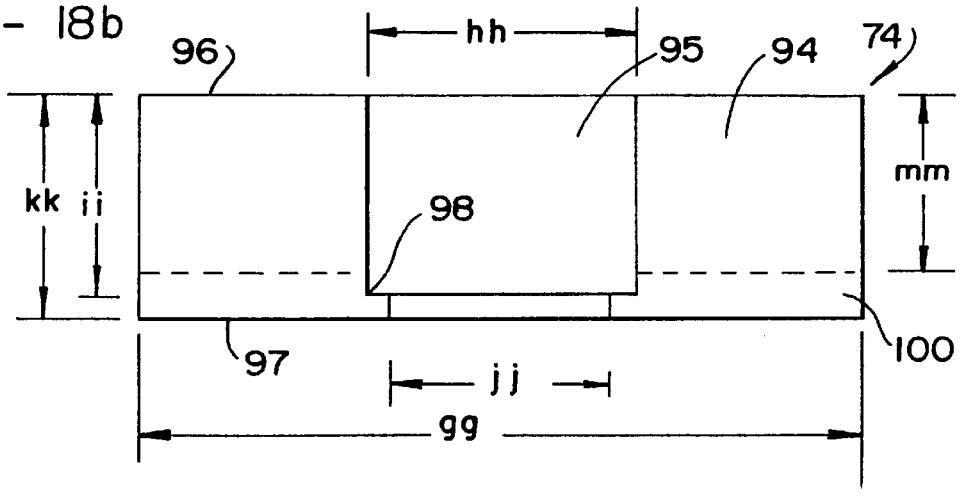

MELT SPIN SYSTEM FOR PRODUCING SKIN-CORE HIGH THERMAL BOND STRENGTH FIBERS

CROSS-REFERENCE TO RELATED APPLICATION

This application is a continuation of application Ser. No. 08/378,271, filed Jan. 26, 1995 and now abandoned, which is a divisional of application Ser. No. 08/080,849, filed Jun. 24, 1993, now abandoned, the disclosure of which applications are incorporated by reference in their entirety.

This application is related to application Ser. No. 08/598,168, filed on Feb. 7, 1996 and now U.S. Pat. No. 5,705,119 which is a continuation of application Ser. No. 08/378,667, filed Jan. 26, 1995 and now abandoned, which is a continuation of application Ser. No. 08/080,849, filed Jun. 24, 1993, now abandoned, and application Ser. No. 08/598,184, filed on Feb. 7, 1996 and now abandoned, which is a continuation of application Ser. No. 08/378,267, filed Jan. 26, 1995 and now abandoned, which is a divisional of application Ser. No. 08/080,849, filed Jun. 24, 1993 and now abandoned, the disclosures of which application are incorporated by reference in their entirety.

This application is also related to application Ser. No. 08/003,696, filed Jan. 13, 1993 and now U.S. Pat No. 5,629,080, in the name of Gupta et al., which is a continuation-in-part of application Ser. No. 07/943,190, filed Sep. 11, 1992, now abandoned which is a continuation-in-part of application Ser. No. 07/818,772, filed Jan. 13, 1992; now abandoned and application Ser. No. 07/474,897, filed Feb. 5, 1990, in the name of Kozulla, now abandoned its continuation application Ser. No. 07/887,416, filed May 20, 1992, now U.S. Pat. No. 5,281,378, its continuation-in-part application Ser. No. 07/683,635, filed Apr. 11, 1991, now U.S. Pat. No. 5,318,735 and its divisional application Ser. No. 07/836,438, filed Feb. 18, 1992, now abandoned and its continuation application Ser. No. 07/939,857, filed Sep. 2, 1992, now U.S. Pat. No. 5,431,994 the disclosures of which are hereby incorporated by reference in their entirety.

BACKGROUND OF THE INVENTION

1. Field of the Invention

The present invention relates to synthetic fibers, especially synthetic fibers used in the manufacture of non-woven fabrics. In particular, the present invention relates to processes and apparatus for the production of polymer fibers and filaments. More specifically, the present invention relates to skin-core fibers produced using melt spin processes, including short spin and long spin processes, and to articles incorporating these skin-core fibers.

2. Background Information

The production of polymer fibers and filaments usually involves the use of a mix of a single polymer with nominal amounts of stabilizers and pigments. The mix is melt extruded into fibers and fibrous products using conventional commercial processes. Non-woven fabrics are typically made by making a web of the fibers, and then thermally bonding the fibers are converted into non-woven fabrics using, for example, a carding machine, and the carded fabric is thermally bonded. The thermal bonding can be achieved using various heating techniques, including heating with heated rollers and heating through the use of ultrasonic welding.

Conventional thermally bonded non-woven fabrics exhibit good loft and softness properties, but less than optimal cross-directional strength, and less than optimal cross-directional strength in combination with high elongation. The strength of the thermally bonded non-woven fabrics depends upon the orientation of the fibers and the inherent strength of the bond points.

Over the years, improvements have been made in fibers which provide stronger bond strengths. However, further improvements are needed to provide even higher fabric strengths to permit use of these fabrics in today's high speed converting processes for hygiene products, such as diapers and other types of incontinence products. In particular, there is a need for a thermally bondable fiber and a resulting non-woven fabric that possess high cross-directional strength and high elongation.

Further, there is a need to produce thermally bondable fibers that can achieve superior cross-directional strength, elongation and toughness properties in combination with fabric uniformity and loftiness. In particular, there is a need to obtain fibers that can produce carded, calendared fabrics with cross-directional properties on the order of at least 650 g/in, with an elongation of 140–180%, and a toughness of 480–700 g/in for a 20 g/yd$^2$ fabric bonded at speeds as high as 500 ft/min or more.

A number of patent applications, as referred to above, have been filed by the present inventor and the present assignee which are directed to improvements in polymer degradation, spin and quench steps, and extrusion compositions that enable the production of fibers having an improved ability to thermally bond accompanied by the ability to produce non-woven fabric having increased strength, elongation, toughness and integrity.

In particular, the above-referred to Kozulla Application Ser. Nos. 07/474,897, 07/887,416, 07/683,635, 07/836,438, and 07/939,857 are directed to processes for preparing polypropylene containing fibers by extruding polypropylene containing material having a molecular weight distribution of at least about 5.5 to form hot extrudate having a surface, with quenching of the hot extrudate in an oxygen containing atmosphere being controlled so as to effect oxidative chain scission degradation of the surface. For example, the quenching of the hot extrudate in an oxygen containing atmosphere can be controlled so as to maintain the temperature of the hot extrudate above about 250° C. for a period of time to obtain oxidative chain scission degradation of the surface.

As disclosed in these applications, by controlling the quenching to obtain oxidative chain scission degradation of the surface, the resulting fiber essentially contains a plurality of zones, defined by different characteristics including differences in melt flow rate, molecular weight, melting point, birefringence, orientation and crystallinity. In particular, as disclosed in these applications, the fiber produced by the delayed quench process includes an inner zone identified by a substantial lack of oxidative polymeric degradation, an outer zone of a high concentration of oxidative chain scission degraded polymeric material, and an intermediate zone identified by an inside-to-outside increase in the amount of oxidative chain scission polymeric degradation. In other words, the quenching of the hot extrudate in an oxygen containing atmosphere can be controlled so as to obtain a fiber having a decreasing weight average molecular weight towards the surface of the fiber, and an increasing melt flow rate towards the surface of the fiber. For example, the fiber comprises an inner zone having a weight average molecular weight of about 100,000 to 450,000 grams/mole, an outer zone, including the surface of the fiber, having a weight average molecular weight of less than about 10,000 grams/mole, and an intermediate zone positioned between the inner zone and the outer zone having a weight average molecular weight and melt flow rate intermediate the inner zone and the outer zone. Moreover, the inner, core zone has a melting point and orientation that is higher than the outer surface zone.

Further, the above referred to Gupta et al. Application Ser. Nos. 08/003,696, 07/943,190 and 07/818,772 are directed to processes for spinning polypropylene fibers, and the resulting fibers and products made from such fibers. The processes of the Gupta et al. applications include melt spinning a polypropylene composition having a broad molecular weight distribution through a spinnerette to form molten fibers, and quenching the molten fibers to obtain thermally bondable polypropylene fibers. The processes of the Gupta et al. applications can be used in both a two step "long spin" process, as well as in a one step "short spin" process. According to certain aspects of the invention disclosed in the Gupta et al. applications substantially constant characteristics are maintained within the material forming the fiber, such as Theological polydispersity index and melt flow rate, as the material is extruded, quenched and drawn, and a substantially uniform fiber is obtained.

More specifically, with regard to known processes for making staple fiber, these processes include the older two-step "long spin" process and the newer one-step "short spin" process. The long spin process involves first melt-extruding fibers at typical spinning speeds of 500 to 3000 meters per minute, and more usually depending on the polymer to be spun from 500 to 1500 meters per minute. Additionally, in a second step usually run at 100 to 250 meters per minute, these fibers are drawn, crimped, and cut into staple fiber. The one-step short spin process involves conversion from polymer to staple fibers in a single step where typical spinning speeds are in the range of 50 to 200 meters per minute. The productivity of the one-step process is increased with the use of about 5 to 20 times the number of capillaries in the spinnerette compared to that typically used in the long spin process. For example, spinnerettes for a typical commercial "long spin" process would include approximately 50–4,000, preferably approximately 3,000–3,500 capillaries, and spinnerettes for a typical commercial "short spin" process would include approximately 500 to 100,000 capillaries preferably, about 30,000–70,000 capillaries. Typical temperatures for extrusion of the spin melt in these processes are about 250–325° C. Moreover, for processes wherein bicomponent filaments are being produced, the numbers of capillaries refers to the number of filaments being extruded, and usually not the number of capillaries in the spinnerette.

The short spin process for manufacture of polypropylene fiber is significantly different from the conventional long spin process in terms of the quenching conditions needed for spin continuity. In the short spin process, with high hole density spinnerettes spinning around 100 meters/minute, quench air velocity is required in the range of about 3,000–8,000 ft/minute to complete fiber quenching within one inch below the spinnerette face. To the contrary, in the long spin process, with spinning speeds of about 1000–1500 meters/minute, a lower quench air velocity in the range of 300 to 500 ft./minute is used. Therefore, achieving a skin-core type fiber, such as that disclosed in the above-identified Kozulla applications (which controls quenching to achieve a delayed quenching) is difficult in a short spin process due to the high quench air velocity needed for the short spin process.

Apparatus and methods are also known for melt spinning of polymers to obtain certain advantages in the spinning process. For example, U.S. Pat. No. 3,354,250 to Killoran et al. (Killoran), which is hereby incorporated by reference in its entirety, is directed to extrusion method and apparatus wherein contact of molten or plastic material with moving parts is avoided and the residence time of the polymer in the molten condition is kept to a minimum. Specifically, in the extrusion system of Killoran, the splined barrel is cooled, rather than heated, by a surrounding water-cooling jacket which carries away heat, so as to maintain the screw, barrel and powder at a temperature below the melting point of the lowest melting additive.

In describing the processing of polypropylene, Killoran teaches that the softening temperature of polypropylene is within the range from 168° C. to 170° C., and at this temperature the material becomes semi-plastic and sticky. Killoran further teaches that the temperature required for filtering and extrusion of polypropylene. may be as high as 280° C., so that the temperature of the polypropylene is increased during the passage through perforations in the block from approximately 170° C. to 270° C., or 280° C., that is, there is about 100° C. rise from the initial softening at the entrance to the block to the molten condition at the outlet of the block. Therefore, the teachings of Killoran are limited to heating of the polymer from a solid condition to a molten condition to achieve a reduced amount of time that the polymer is in a molten condition, as well as to the prevent polymer in the molten condition from contacting moving elements.

Further, U.S. Pat. No. 3,437,725 to Pierce, which is hereby incorporated by reference in its entirety, is directed to the melt-spinning of synthetic polymers, including polypropylene. According to the invention of Pierce, the spinnerette is designed so as to enable the use of polymers having higher melt viscosities, either from high molecular weight polymers or from polymers with stiff chain structures. Specifically, the spinnerette of Pierce is designed so as to permit the spinning of polymer having a high melt viscosity without degrading the polymer. To accomplish this lack of degradation of the polymer, Pierce passes the molten polymer through the filter holder at an initial temperature within a temperature range below that at which significant polymer degradation will occur, passes the polymer into a plurality of passages, each of which leads to a different spinning capillary in the spinnerette plate and has an entrance temperature within the initial temperature range, heats the spinnerette plate to increase the temperature along the passages from the temperature at the entrance to a temperature at least 60° C. higher at the spinning capillary, and extrudes the polymer from the spinning capillary after a maximum of 4 seconds of travel through the heated passage. The quenching of Pierce is performed using inert gas and the process is accomplished using a long spin, two step process wherein the filaments are initially spun, and subsequently drawn.

SUMMARY OF THE INVENTION

It is an object of the present invention to obtain skin-core filaments or fibers using melt spin processes. It is also an object of the present invention to enable control of the skin-core structure of the fibers or filaments, whereby a skin-core structure can be obtained which possesses either a gradient or a distinct step between the core and the surface of the fiber.

The objects of the present invention can be obtained by providing a process for spinning polymer filaments, comprising feeding a polymer composition to at least one spinnerette; heating the polymer composition at a location at or adjacent to the at least one spinnerette so as to heat the polymer composition to a sufficient temperature to obtain a skin-core filament structure upon quenching in an oxidative atmosphere; extruding the heated polymer composition through the at least one spinnerette to form molten filaments; and immediately quenching the molten filaments in an oxidative atmosphere, as the molten filaments are extruded, to effect oxidative chain scission degradation of at least a surface of the molten filaments to obtain filaments having a skin-core structure.

The objects of the present invention are also achieved by providing a process for spinning polymer filaments, comprising feeding a polymer composition to at least one spinnerette; heating the polymer composition at a location at or adjacent to the at least one spinnerette so as to obtain sufficient heating of the polymer composition to partially degrade the polymer composition in a vicinity of the at least one spinnerette; extruding the partially degraded polymer composition through the at least one spinnerette to form molten filaments; and immediately quenching the molten filaments in an oxidative atmosphere, as the molten filaments are extruded, to effect oxidative chain scission degradation of at least a surface of the molten filaments to obtain filaments having a skin-core structure.

In another embodiment of the invention, the objects of the present invention are obtained by providing a process for spinning polymer filaments, comprising feeding a polymer composition to at least one spinnerette; heating the at least one spinnerette to a temperature of at least about 230° C.; extruding the heated polymer composition through the at least one spinnerette to form molten filaments; and immediately quenching the molten filaments in an oxidative atmosphere, as the molten filaments are extruded, to effect oxidative chain scission degradation of at least a surface of the molten filaments to obtain filaments having a skin-core structure.

In still another embodiment of the invention, the objects of the present invention are obtained by providing a process for spinning polymer filaments, comprising feeding a polymer composition to at least one spinnerette; heating at least one apertured element positioned upstream of the at least one spinnerette to a temperature of at least about 250° C.; extruding the heated polymer composition through the at least one apertured element and the at least one spinnerette to form molten filaments; and immediately quenching the molten filaments in an oxidative atmosphere, as the molten filaments are extruded, to effect oxidative chain scission degradation of at least a surface of the molten filaments to obtain filaments having a skin-core structure.

In yet another embodiment of the invention, the objects of the present invention are obtained by providing a process for spinning polymer filaments, comprising feeding a polymer composition to at least one spinnerette at a flow rate sufficient to obtain a spinning speed of about 10 to 200 meters per minute through the at least one spinnerette; heating the polymer composition at a location at or adjacent to the at least one spinnerette so as to heat the polymer composition to a sufficient temperature to obtain a skin-core filament structure upon quenching in an oxidative atmosphere; extruding the heated polymer composition through the at least one spinnerette at a spinning speed of about 10 to 200 meters per minute to form molten filaments; and quenching the molten filaments in an oxidative atmosphere so as to effect oxidative chain scission degradation of at least a surface of the molten filaments to obtain filaments having a skin-core structure.

In still another embodiment of the invention, the objects of the present invention are obtained by providing a process for spinning polymer filaments, comprising feeding a polymer melt composition to at least one spinnerette at a flow rate sufficient to obtain a spinning speed of about 10 to 200 meters per minute through the at least one spinnerette, the polymer melt composition having a temperature of at least about 200° C.; heating the polymer composition at a location at or adjacent to the at least one spinnerette so as to heat the polymer composition to a sufficient temperature to obtain a skin-core filament structure upon quenching in an oxidative atmosphere; extruding the heated polymer composition through the at least one spinnerette at a spinning speed of about 10 to 200 meters per minute to form molten filaments; and quenching the molten filaments in an oxidative atmosphere so as to effect oxidative chain scission degradation of at least a surface of the molten filaments to obtain filaments having a skin-core structure.

In still another embodiment of the invention, the objects of the present invention are obtained by providing a process for spinning polymer filaments, comprising feeding a polymer composition to at least one spinnerette at a flow rate sufficient to obtain a spinning speed of about 10 to 200 meters per minute through the at least one spinnerette; heating the polymer composition at a location at or adjacent to the at least one spinnerette so as to obtain sufficient heating of the polymer composition to partially degrade the polymer composition in a vicinity of the at least one spinnerette; extruding the partially degraded polymer composition through the at least one spinnerette at a spinning speed of about 10 to 200 meters per minute to form molten filaments; and quenching the molten filaments in an oxidative atmosphere so as to effect oxidative chain scission degradation of at least a surface of the molten filaments to obtain filaments having a skin-core structure.

In still another embodiment of the invention, the objects of the present invention are obtained by providing a process for spinning polymer filaments, comprising feeding a polymer composition to at least one spinnerette at a flow rate sufficient to obtain a spinning speed of about 10 to 200 meters per minute through the at least one spinnerette; heating the at least one spinnerette to a temperature of at least about 230° C.; extruding the heated polymer composition through the at least one spinnerette at a spinning speed of about 10 to 200 meters per minute to form molten filaments; and quenching the molten filaments in an oxidative atmosphere having a flow rate of about 3,000 to 12,000 ft/min to effect oxidative chain scission degradation of at least a surface of the molten filaments to obtain filaments having a skin-core structure.

In still another embodiment of the invention, the objects of the present invention are obtained by providing a process for spinning polymer filaments, comprising feeding a polymer composition to at least one spinnerette at a flow rate sufficient to obtain a spinning speed of about 10 to 200 meters per minute through the at least one spinnerette; heating at least one apertured element positioned upstream of the at least one spinnerette to a temperature of at least about 250° C.; extruding the heated polymer composition through the at least one apertured element and the at least one spinnerette of at a spinning speed of about 10 to 200 meters per minute to form molten filaments; and quenching the molten filaments in an oxidative atmosphere having a flow rate of about 3,000 to 12,000 ft/min to effect oxidative chain scission degradation of at least a surface of the molten filaments to obtain filaments having a skin-core structure.

In still another embodiment of the invention, the objects of the present invention are obtained by providing a process for spinning polymer filaments, comprising feeding a polymer composition to at least one spinnerette at a flow rate sufficient to obtain a spinning speed of about 10 to 200 meters per minute through the at least one spinnerette; heating the polymer composition at a location at or adjacent to the at least one spinnerette so as to heat the polymer composition to a sufficient temperature to obtain a skin-core filament structure upon quenching in an oxidative atmosphere; extruding the heated polymer composition through the at least one spinnerette at a spinning speed of about 10 to 200 meters per minute to form molten filaments; and quenching the molten filaments in an oxidative atmosphere at a flow rate of about 3,000 to 12,000 ft/mmn so as to effect oxidative chain scission degradation of at least a surface of the molten filaments to obtain filaments having a skin-core structure capable of forming non-woven materials having a cross directional strength of at least 650 g/in for a 20 g/yd$^2$ fabric bonded at speeds of at least 250 ft/mmn.

The objects of the present invention are also obtainable by providing apparatus for spinning polymer filaments, and, in particular, apparatus for performing the processes of the present invention.

Therefore, according to one embodiment of the present invention, apparatus is provided for spinning polymer filaments, comprising at least one spinnerette; means for feeding a polymer composition through the at least one spinnerette to extrude molten filaments, means for heating the polymer composition at a location at or adjacent to the at least one spinnerette to obtain sufficient heating of the polymer composition to obtain a skin-core filament structure upon quenching in an oxidative atmosphere; and means for immediately quenching molten filaments of extruded polymer in an oxidative atmosphere, as the molten filaments exit the at least one spinnerette, to effect oxidative chain scission degradation of at least a surface of the molten filaments to obtain filaments having a skin-core structure.

In another embodiment of the apparatus of the present invention, the apparatus for spinning polymer filaments comprises at least one spinnerette; means for feeding a polymer composition through the at least one spinnerette to extrude molten filaments; means for substantially uniformly heating the polymer composition at a location at or adjacent to the at least one spinnerette so as to obtain sufficient heating of the polymer composition to partially degrade the polymer composition in a vicinity of the at least one spinnerette; and means for immediately quenching molten filaments of extruded polymer in an oxidative atmosphere, as the molten filaments exit the at least one spinnerette, so as to effect oxidative chain scission degradation of at least a surface of the molten filaments.

In still another embodiment of the apparatus of the present invention, the apparatus for spinning polymer filaments comprises at least one spinnerette; means for feeding a polymer composition through the at least one spinnerette to extrude molten filaments; means for substantially uniformly heating the at least one spinnerette to a temperature of at least about 230° C.; and means for quenching molten filaments of extruded polymer in an oxidative atmosphere, as the molten filaments exit the at least one spinnerette, to effect oxidative chain scission degradation of at least a surface of the molten filaments to obtain filaments having a skin-core structure.

In still another embodiment of the apparatus of the present invention, the apparatus for spinning polymer filaments comprises at least one spinnerette; means for feeding a polymer composition through the at least one spinnerette to extrude molten filaments; at least one apertured element positioned upstream of the at least one spinnerette; means for substantially uniformly heating the at least one apertured element to a temperature of at least about 250° C.; and means for quenching molten filaments of extruded polymer in an oxidative atmosphere, as the molten filaments exit the at least one spinnerette, to effect oxidative chain scission degradation of at least a surface of the molten filaments to obtain filaments having a skin-core structure.

In yet another embodiment of the apparatus of the present invention, the apparatus for spinning polymer filaments comprises at least one spinnerette; means for feeding a polymer composition to the at least one spinnerette to obtain a spinning speed of about 10 to 200 meters per minute through the at least one spinnerette to extrude molten filaments; means for heating the polymer composition at a location at or adjacent to the at least one spinnerette to obtain sufficient heating of the polymer composition to obtain a skin-core filament structure upon quenching in an oxidative atmosphere; and means for immediately quenching molten filaments of extruded polymer in an oxidative atmosphere, as the molten filaments exit the at least one spinnerette, so as to effect oxidative chain scission degradation of at least a surface of the molten filaments.

In still another embodiment of the apparatus of the present invention, the apparatus for spinning polymer filaments comprises at least one spinnerette; means for feeding a polymer composition to the at least one spinnerette to obtain a spinning speed of about 10 to 200 meters per minute through the at least one spinnerette to extrude molten filaments; means for substantially uniformly heating the polymer composition at a location at or adjacent to the at least one spinnerette so as to obtain sufficient heating of the polymer composition to partially degrade the polymer composition in a vicinity of the at least one spinnerette; and means for immediately quenching molten filaments of extruded polymer in an oxidative atmosphere, as the molten filaments exit the at least one spinnerette, so as to effect oxidative chain scission degradation of at least a surface of the molten filaments.

In still another embodiment of the apparatus of the present invention, the apparatus for spinning polymer filaments comprises at least one spinnerette; means for feeding a polymer composition to the at least one spinnerette to obtain a spinning speed of about 10 to 200 meters per minute through the at least one spinnerette to extrude molten filaments; means for substantially uniformly heating the at least one spinnerette to a temperature of at least about 230° C.; and means for immediately quenching molten filaments of extruded polymer in an oxidative atmosphere at a flow rate of about 3,000 to 12,000 ft/min, as the molten filaments exit the at least one spinnerette, to effect oxidative chain scission degradation of at least a surface of the molten filaments to obtain filaments having a skin-core structure.

In still another embodiment of the apparatus of the present invention, the apparatus for spinning polymer filaments comprises at least one spinnerette; means for feeding a polymer composition to the at least one spinnerette to obtain a spinning speed of about 10 to 200 meters per minute through the at least one spinnerette to extrude molten filaments; at least one element positioned upstream of the at least one spinnerette, the at least one element permitting passage of polymer composition; means for substantially uniformly heating the at least one element to a temperature of at least about 250° C.; the at least one element and the at least one spinnerette being positioned sufficiently close to each other so that as the polymer exits the at least one spinnerette the polymer maintains a sufficient temperature to obtain a skin-core structure upon quenching in an oxidative atmosphere; and means for immediately quenching molten filaments of extruded polymer in an oxidative atmosphere, as the molten filaments exit the at least one spinnerette, to effect oxidative chain scission degradation of at least a surface of the molten filaments to obtain filaments having a skin-core structure.

In still another embodiment of the apparatus of the present invention, the apparatus for spinning polymer filaments comprises at least one spinnerette; means for feeding a polymer composition to the at least one spinnerette to obtain a spinning speed of about 10 to 200 meters per minute through the at least one spinnerette to extrude molten filaments; at least one apertured plate positioned upstream of the at least one spinnerette; means for substantially uniformly heating the at least one apertured plate to a temperature of at least about 250° C.; and means for quenching molten filaments of extruded polymer in an oxidative atmosphere having a flow rate of about 3,000 to 12,000 ft/min, as the molten filaments exit the at least one spinnerette, to effect oxidative chain scission degradation of at least a surface of the molten filaments to obtain filaments having a skin-core structure.

In another aspect, the present invention is directed to apparatus for spinning polymer filaments, comprising at least one spinnerette structured and arranged to be directly and substantially uniformly heated by resistance or impedance of the at least one spinnerette; a feeding mechanism effecting extrusion of polymer composition through the at least one spinnerette to extrude molten filaments; and a quenching system positioned to immediately quench molten filaments of extruded polymer in an oxidative atmosphere, as the molten filaments exit the at least one spinnerette, to effect oxidative chain scission degradation of at least a surface of the molten filaments to obtain filaments having a skin-core structure.

In still another aspect, the present invention is directed to apparatus for spinning polymer filaments, comprising at least one spinnerette; means for feeding polymer composition through the at least one spinnerette to extrude molten filaments; means for directly and substantially uniformly heating by resistance or impedance the at least one spinnerette to a temperature of at least about 230° C.; and means for quenching molten filaments of extruded polymer in an oxidative atmosphere, as the molten filaments exit the at least one spinnerette, to effect oxidative chain scission degradation of at least a surface of the molten filaments to obtain filaments having a skin-core structure.

In still a further aspect, the present invention is directed to apparatus for spinning polymer filaments, comprising at least one spinnerette; means for feeding polymer composition to the at least one spinnerette to obtain a spinning speed of about 10 to 200 meters per minute through the at least one spinnerette to extrude molten filaments; means for substantially uniformly heating the at least one spinnerette to obtain sufficient heating of the polymer composition to obtain a skin-core filament structure upon quenching in an oxidative atmosphere; and means for immediately quenching molten filaments of extruded polymer in an oxidative atmosphere, as the molten filaments exit the at least one spinnerette, so as to effect oxidative chain scission degradation of at least a surface of the molten filaments.

In still a further aspect, the present invention is directed to apparatus for spinning polymer filaments, comprising at least one spinnerette; a feeding mechanism effecting extrusion of polymer composition through the at least one spinnerette to extrude molten filaments; at least one apertured element positioned upstream and in the vicinity of the at least one spinnerette; elements associated with the apertured element to substantially uniformly heat the at least one apertured element to a temperature of at least about 250° C.; and a quenching system adapted to quench molten filaments of extruded polymer in an oxidative atmosphere, as the molten filaments exit the at least one spinnerette, to effect oxidative chain scission degradation of at least a surface of the molten filaments to obtain filaments having a skin-core structure.

In still a further aspect, the present invention is directed to apparatus for spinning polymer filaments, comprising at least one spinnerette; elements associated with the at least one spinnerette to substantially uniformly heat the at least one spinnerette to obtain sufficient heating of the polymer composition to obtain a skin-core filament structure upon quenching in an oxidative atmosphere; spinning elements associated with the at least one spinnerette to obtain a spinning speed of about 10 to 200 meters per minute through the at least one spinnerette; and a quenching system positioned to immediately quench molten filaments of extruded polymer in an oxidative atmosphere, as molten filaments exit the at least one spinnerette, to effect oxidative chain scission degradation of at least a surface of the molten filaments to obtain filaments having a skin-core structure.

In still a further aspect, the present invention is directed to apparatus for spinning polymer filaments, comprising at least one spinnerette; elements associated with the at least one spinnerette to substantially uniformly heat the at least one spinnerette to a temperature of at least about 230° C.; spinning elements associated with the at least one spinnerette to obtain a spinning speed of about 10 to 200 meters per minute through the at least one spinnerette; and a quenching system positioned to immediately quench molten filaments of extruded polymer in an oxidative atmosphere at a flow rate of about 3,000 to 12,000 fl/min, as molten filaments exit the at least one spinnerette, to effect oxidative chain scission degradation of at least a surface of the molten filaments to obtain filaments having a skin-core structure.

In still a further aspect, the present invention is directed to apparatus for spinning polymer filaments, comprising at least one spinnerette; spinning elements associated with the at least one spinnerette to obtain a spinning speed of about 10 to 200 meters per minute through the at least one spinnerette; and at least one element positioned upstream of the at least one spinnerette, the at least one element permitting passage of polymer composition; elements associated with the at least one element to uniformly heating the at least one element to a temperature of at least about 250° C.; the at least one element and the at least one spinnerette being positioned sufficiently close to each other so that as the polymer exits the at least one spinnerette the polymer maintains a sufficient temperature to obtain a skin-core structure upon quenching in an oxidative atmosphere; and a quenching system positioned to immediately quench molten filaments of extruded polymer in an oxidative atmosphere, as molten filaments exit the at least one spinnerette, to effect oxidative chain scission degradation of at least a surface of the molten filaments to obtain filaments having a skin-core structure.

In still a further aspect, the present invention is directed to apparatus for spinning polymer filaments in a short spin process, comprising at least one spinnerette; elements associated with the at least one spinnerette to substantially uniformly heat the at least one spinnerette to obtain sufficient heating of the polymer composition to obtain a skin-core filament structure upon quenching in an oxidative atmosphere; spinning elements associated with the at least one spinnerette to obtain a short spin spinning speed through the at least one spinnerette; and a quenching system positioned to immediately quench molten filaments of extruded polymer in an oxidative atmosphere, as molten filaments exit the at least one spinnerette, to effect oxidative chain scission degradation of at least a surface of the molten filaments to obtain filaments having a skin-core structure.

In still a further aspect, the present invention is directed to apparatus for spinning polymer filaments in a short spin process, comprising at least one spinnerette; spinning elements associated with the at least one spinnerette to obtain a short spin spinning speed through the at least one spinnerette; and at least one element positioned upstream of the at least one spinnerette, the at least one element permitting passage of polymer composition; elements associated with the at least one element to uniformly heating the at least one element to a temperature of at least about 250° C.; the at least one element and the at least one spinnerette being positioned sufficiently close to each other so that as the polymer exits the at least one spinnerette the polymer maintains a sufficient temperature to obtain a skin-core structure upon quenching in an oxidative atmosphere; and a quenching system positioned to immediately quench molten filaments of extruded polymer in an oxidative atmosphere, as molten filaments exit the at least one spinnerette, to effect oxidative chain scission degradation of at least a surface of the molten filaments to obtain filaments having a skin-core structure.

The present invention is also directed to a fiber or filament comprising an inner core of polymeric material; a surface zone surrounding the inner core, the surface zone comprising oxidative chain scission degraded polymeric material, so that the inner core and the surface zone comprise a skin-core structure; and the oxidative chain scission degraded polymeric material being substantially limited to the surface zone wherein the inner core and the surface zone comprise adjacent discrete portions of the skin-core structure.

In a still further aspect of the invention, the fiber or filament comprises an inner core of polymeric material; a surface zone having a thickness of at least about 0.5 $\mu$m, and more preferably at least about 1 $\mu$m, surrounding the inner core, the surface zone comprising oxidative chain scission degraded polymeric material, so that the inner core and the surface zone comprise a skin-core structure; and the oxidative chain scission degraded polymeric material being substantially limited to the surface zone so that the inner core and the surface zone comprise adjacent discrete portions of the skin-core structure.

The invention is also directed to a fiber or filament comprising an inner core of polymeric material; a surface zone surrounding the inner core, the surface zone comprising oxidative chain scission degraded polymeric material, so that the inner core and the surface zone comprise a skin-core structure; and the inner core has a melt flow rate substantially equal to an average melt flow rate of the inner core and the surface zone.

It is also an object of the present invention to provide non-woven materials comprising fibers according to the invention thermally bonded together, as well as to provide hygienic products comprising at least one absorbent layer, and at least one non-woven fabric comprising fibers of the present invention thermally bonded together. The hygienic article can comprise a diaper having an outer impermeable layer, an inner non-woven fabric layer, and an intermediate layer. Such hygienic products are disclosed in the above-referenced Kozulla and Gupta et al. applications, which have been incorporated by reference in their entirety herein.

The polymeric material in each of the above fibers or filaments can comprise various polymeric materials, such as polyolefins, polyesters, polyamides, polyvinyl acetates, polyvinyl alcohol and ethylene acrylic acid copolymers. For example, polyolefins can comprise polyethylenes, such as low density polyethylenes, high density polyethylenes, and linear low density polyethylenes, including polyethylenes prepared by copolymerizing ethylene with at least one $C_3$–$C_{12}$ alpha-olefin; polypropylenes, such as atactic, syndiotactic, and isotactic polypropylene—including partially and fully isotactic, or at least substantially fully isotactic—polypropylenes; polybutenes; such as poly-1-butenes, poly-2-butenes, and polyisobutylenes, and poly 4-methyl-1-pentenes; polyesters can comprise poly (oxyethyleneoxyterephthaloyl); and polyamides can comprise poly(imino-1-oxohexamethylene) (Nylon 6), hexamethylene-diaminesebacic acid (Nylon 6–10), and polyiminohexamethyleneiminoadipoyl (Nylon 66). Preferably, the polymeric material comprises polypropylene, and, preferably, the inner core of the fiber or filament has a melt flow rate of about 10, and the average melt flow rate of the fiber or filament is about 11 or about 12.

In the process and apparatus of the present invention, the heating of the polymer composition at a location at or adjacent to the at least one spinnerette comprises heating the polymer composition to a temperature of at least about 200° C., preferably at least about 220° C., and more preferably at least about 250° C. Moreover, the extruding of the heated polymer composition comprises extruding at a temperature of at least about 200° C., preferably at least about 220° C., and more preferably at least about 250° C.

In the process and apparatus of the present invention, the spinnerette can be directly heated and/or an element associated with the spinnerette, such as an apertured plate, can be heated. Preferably, the spinnerette or the associated element is substantially uniformly heated to ensure that substantially all, and preferably all, filaments extruded through the spinnerette are capable of achieving sufficient conditions to obtain a skin-core structure.

The heating of the spinnerette can be to a temperature of at least about 230° C., preferably at least about 250° C., and can be in the range of about 250° C. to 370° C., preferably in the range of about 290° C. to 360° C., and more preferably in the range of about 330° C. to 360° C.

The spinnerette according to the present invention preferably contains about 500 to 150,000 capillaries, with preferred ranges being about 30,000 to 120,000 capillaries, about 30,000 to 70,000 capillaries, and about 30,000 to 45,000 capillaries. These capillaries can have a cross-sectional area of about 0.02 to 0.2 $mm^2$, preferably about 0.07 $mm^2$, and a length of about 1 to 20 mm, preferably a length of about 1 to 5 mm, and more preferably a length of about 1.5 mm. The capillaries can have a recess at a lower portion, and the recess can have a cross-sectional area of about 0.05 to 0.4 $mm^2$, preferably of about 0.3 $mm^2$, and a length of about 0.25 mm to 2.5 mm, preferably a length of about 0.5 mm.

Additionally, the capillaries can have a tapered upper portion. These tapered capillaries can comprise countersunk capillaries having a total length of about 3 to 20 mm, preferably about 7–10 mm; a first cross-sectional area of about 0.03 $mm^2$ to 0.2 $mm^2$ at a lower portion; a maximum cross-sectional area at a surface of the at least one spinnerette of about 0.07 $mm^2$ to 0.5 $mm^2$, preferably about 0.2 $mm^2$; and the countersunk capillaries taper from the maximum cross-sectional area to the first cross-sectional area at an angle of about 20° to 60°, preferably about 35° to 45°, and more preferably about 45°. The countersunk capillaries can include a distance between the maximum cross-sectional area to the first cross-sectional area of about 0.15 to 0.4 mm.

The tapered capillaries can comprise counterbored, countersunk capillaries. These counterbored, countersunk capillaries can comprise an upper tapered portion having a diameter of about 0.6 mm and a length of about 0.5 mm; an upper capillary having a diameter of about 0.5 mm and a length of about 3.5 mm; a middle tapered portion having a length of about 0.1 mm; and a lower capillary having a diameter of about 0.35 mm and a length of about 1.5 mm.

Further, the tapered capillaries can comprise counterbored capillaries. These counterbored capillaries can comprise an upper capillary having a diameter of about 0.5 mm and a length of about 4 mm; a middle tapered portion having a length of about 0.1 mm; and a lower capillary having a diameter of about 0.35 mm and a length of about 2 mm.

When the heating comprises heating with an apertured element, preferably an apertured plate, the apertured plate is positioned upstream of the spinnerette, preferably about 1 to 4 mm, preferably about 2 to 3 mm, and more preferably about 2.5 mm. The spinnerette and the apertured plate can comprise a corresponding number of capillaries and have a corresponding pattern, or there can be a different number of capillaries and/or a different pattern. The capillaries in the apertured plate can have a cross-sectional area that is up to about 30% larger than the cross-sectional area of capillaries in the spinnerette.

The apertured plate preferably contains about 500 to 150,000 capillaries, with preferred ranges being about 30,000 to 120,000 capillaries, about 30,000 to 70,000 capillaries, and about 30,000 to 45,000 capillaries. These capillaries preferably having a cross-sectional area of about 0.03 $mm^2$ to 0.3 $mm^2$, more preferably of about 0.1 $mm^2$, and a length of about 1 to 5 mm, more preferably about 1.5 mm.

The heating of the apertured plate can be to a temperature of at least about 250° C., and can be in the range of about 250° C. to 370° C., preferably in the range of about 280° C. to 350° C., and more preferably in the range of about 300° C. to 360° C.

The quenching can comprise any quench with an oxidative gas that flows at a high rate of speed, preferably about 3,000 to 12,000 ft/min, more preferably about 4,000 to 9,000 ft/min, and even more preferably 5,000 to 7,000 ft/min. Preferably, the molten filaments are immediately quenched upon being extruded. Examples of quenching according to the present invention include radial quenching and quenching with adjustable nozzles blowing an oxidative gas. The adjustable nozzles are preferably directed at a central portion of the spinnerette, and preferably have an angle of about 0° to 60° with respect to a plane passing through the surface of the spinnerette, more preferably about 10° to 60°, and can also preferably be an angle of about 0° to 45°, more preferably 0° to 25°.

The heating can be accomplished using conduction, convection, induction, magnetic heating and/or radiation, and can be accomplished using impedance or resistance heating, inductance heating and/or magnetic heating.

The polymer composition can comprise various spinnable polymers, including polyolefins, such as polyethylene and polypropylene, and polyesters. The polymer can have usual spinning temperatures i.e., the polymer melt temperature, and a narrow or broad molecular weight distribution. For polypropylene, the temperature of the melt spin composition is about 200° C. to 300° C., preferably 220° C. to 260° C., and more preferably 230° C. to 240° C.,the melt flow rate is preferably about 0.5 to 40 dg/min, with preferred ranges being 5–25 dg/min, 10–20 dg/min, 9–20 dg/min and 9–15 dg/min. Preferably, the polypropylene composition has a broad molecular weight distribution of at least about 4.5. Moreover, polymer compositions as disclosed in either the Kozulla or Gupta et al. applications referred to above can be utilized in the present invention, which polymer compositions are expressly incorporated by reference herein. For example, the molecular weight distribution of the polymer composition can be at least about 5.5, as disclosed by Kozulla.

At least one metal carboxylate can be added to the polymer composition. The metal carboxylate can comprise at least one member selected from the group consisting of nickel salts of 2-ethylhexanoic, caprylic, decanoic and dodecanoic acids, and 2-ethylhexanoates of Fe, Co, Ca and Ba, such as nickel octoate.

Preferably, the spinning speed is about 80 to 100 meters per minute.

The spinnerette can have various dimensions, with preferred dimensions being a width of about 30–150 mm and a length of about 300 to 700 mm, such as a width of about 40 mm and a length of about 450 mm, or a width of about loo mm and a length of about 510 mm. The spinnerette can be circular having a preferred diameter of about 100 to 600 mm, more preferably about 400 mm, especially when using a radial quench.

BRIEF DESCRIPTION OF THE DRAWINGS

The invention will be better understood and characteristics thereof are illustrated in the annexed drawings showing non-limiting embodiments of the invention, in which:

FIG. 7 illustrates a spinnerette for providing the skin-core filamentary structure according to the present invention which includes counterbored, countersunk capillaries;

FIG. 8 illustrates a spinnerette for providing the skin-core filamentary structure according to the present invention which includes counterbored capillaries;

FIG. 17 illustrates the spacer used in the small-scale developmental tests in the examples tabulated in Table I; and FIGS. 18*a* and 18*b* illustrate the lower clamping element used in the small-scale developmental tests in the examples tabulated in Table I.

DETAILED DESCRIPTION OF THE PREFERRED EMBODIMENTS

Figure 1:
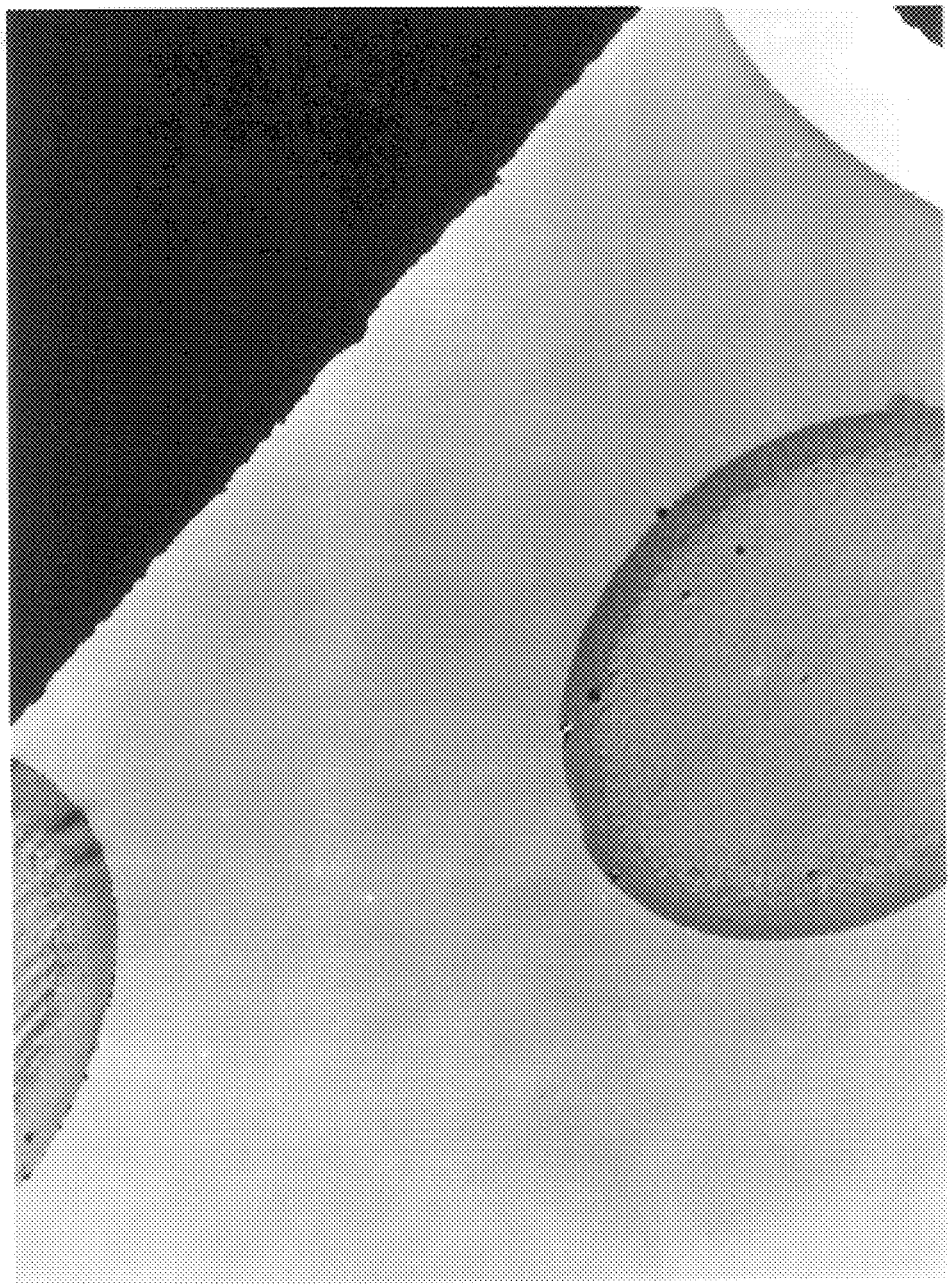
FIG. 1 illustrates a microphotograph of a polypropylene fiber stained with $RuO_4$ obtained using the Kozulla process.

To accomplish the objectives of obtaining fibers and filaments having a skin-core morphology, and especially the obtaining of fibers and filaments having a skin-core morphology in a short spin process, the present invention provides a sufficient environment to the polymeric material in the vicinity of its extrusion from the spinnerette. For example, because this environment is not achievable in a short spin process solely by using a controlled quench, such as a delayed quench, as in the long spin process, and the long spin process needs a delayed quench, the environment for obtaining a skin-core fiber is obtained according to the present invention by using apparatus and procedures which promote at least partial surface degradation of the molten filaments when extruded through the spinnerette. In particular, in preferred embodiments of the present invention, various elements are associated with the spinnerette so as to provide a sufficient temperature environment, at least at the surface of the extruded polymeric material, to achieve a skin-core filament structure.

The present invention is directed to various forms of fibers, including filaments and staple fibers. These terms are used in their ordinary commercial meanings. Typically, herein, filament is used to refer to the continuous fiber on the spinning machine; however, as a matter of convenience, the terms fiber and filament are also used interchangeably herein. "Staple fiber" is used to refer to cut fibers or filaments. Preferably, for instance, staple fibers for non-woven fabrics useful in diapers have lengths of about 1 to 3 inches, more preferably 1.25 to 2 inches.

The substantially non-uniform morphological structure of the skin-core fibers according to the present invention can be characterized by transmission electron microscopy (TEM) of ruthenium tetroxide ($RuO_4$)-stained fiber thin sections. In this regard, as taught by Trent et al., in *Macromolecules*, Vol. 16, No. 4, 1983, "Ruthenium Tetroxide Staining of Polymers for Electron Microscopy", which is hereby incorporated by reference in its entirety, it is well known that the structure of polymeric materials is dependent on their heat treatment, composition, and processing, and that, in turn, mechanical properties of these materials such as toughness, impact strength, resilience, fatigue, and fracture strength can be highly sensitive to morphology. Further, this article teaches that transmission electron microscopy is an established technique for the characterization of the structure of heterogeneous polymer systems at a high level of resolution; however, it is often necessary to enhance image contrast for polymers by use of a staining agent. Useful staining agents for polymers are taught to include osmium tetroxide and ruthenium tetroxide. For the staining of the filaments and fibers of the present invention, ruthenium tetroxide is the preferred staining agent.

In the morphological characterization of the present invention, samples of filaments or fibers are stained with aqueous $RuO_4$, such as a 0.5% (by weight) aqueous solution of ruthenium tetroxide obtainable from Polysciences, Inc., overnight at room temperature. (While a liquid stain is utilized in this procedure, staining of the samples with a gaseous stain is also possible.) Stained fibers are embedded in Spurr epoxy resin and cured overnight at 60° C. The embedded stained fibers are then thin sectioned on an ultramicrotome using a diamond knife at room temperature to obtain microtomed sections approximately 80 nm thick, which can be examined on conventional apparatus, such as a Zeiss EM-10 TEM, at 100 kV. Energy dispersive x-ray analysis (EDX) was utilized to confirm that the $RuO_4$ had penetrated completely to the center of the fiber.

Fibers that are produced using the methods according to the present invention show an enrichment of the ruthenium (Ru residue) at the outer surface region of the fiber cross-section to a depth of at least about 0.5 $\mu$m, and preferably to a depth of at least about 1 $\mu$m with the cores of the fibers showing a much lower ruthenium content.

Another test procedure to illustrate the skin-core structure of the fibers of the present invention, and especially useful in evaluating the ability of a fiber to thermally bond, consists of the microfusion analysis of residue using a hot stage test. This procedure is used to examine for the presence of a residue following axial shrinkage of a fiber during heating, with the presence of a higher amount of residue directly correlating with the ability of a fiber to provide good thermal bonding. In this hot stage procedure, a suitable hot stage, such as a Mettler FP52 low mass hot stage controlled via a Mettler FP5 control processor, is set to 145° C. A drop of silicone oil is placed on a clean microscope slide. Fibers are cut into ½ mm lengths from three random areas of filamentary sample, and stirred into the silicone oil with a probe. The randomly dispersed sample is covered with a cover glass and placed on the hot stage, so that both ends of the cut fibers will, for the most part, be in the field of view. The temperature of the hot stage is then raised at a rate of 3° C./minute to 164° C. At approximately 163° C., the fibers shrink axially, and the presence or absence of trailing residues is observed. When the temperature reaches 164° C., the heating is stopped and the temperature reduced rapidly to 145° C. The sample is then examined through a suitable microscope, such as a Nikon SK-E trinocular polarizing microscope, and a photograph of a representative area is taken to obtain a still photo reproduction using, for example, a MTI-NC70 video camera equipped with a Pasecon videotube and a Sony Up-850 B/W videographic printer. A rating of "good" is used when the majority of fibers leave residues. A rating of "poor" is used when only a few percent of-the fibers leave residues. other comparative ratings are also available, and include a rating of "fair" which falls between "good" and "poor", a rating of "very good" which is positioned above "good", and a rating of "none" which, of course, falls below "poor".

The polymer material extruded into a skin-core filament structure can comprise any polymer that can be extruded in a long spin or short spin process to directly produce the skin-core structure in the filaments as they are formed at the exit of the spinnerette, such as polyolefins, polyesters, polyamides, polyvinyl acetates, polyvinyl alcohol and ethylene acrylic acid copolymers. For example, polyolefins can comprise polyethylenes, such as low density polyethylenes, high density polyethylenes, and linear low density polyethylenes, including polyethylenes prepared by copolymerizing ethylene with at least one $C_3$–$C_{12}$ alpha-olefin; polypropylenes, such as atactic, syndiotactic, and isotactic polypropylene—including partially and fully isotactic, or at least substantially fully isotactic—polypropylenes, polybutenes, such as poly-1-butenes, poly-2-butenes, and polyisobutylenes, and poly 4-methyl-1-pentenes; polyesters can comprise poly(oxyethyleneoxyterephthaloyl); and polyamides can comprise poly(imino-1-oxohexamethylene) (Nylon 6), hexamethylene-diaminesebacic acid (Nylon 6–10), and polyiminohexamethyleneiminoadipoyl (Nylon 66).

A preferred polymer material to be extruded is a polymer material for the production of polyolefin fibers, preferably polypropylene fibers. Therefore, preferably the composition to be extruded into filaments comprises an olefinic polymer, and more preferably polypropylene.

The polymeric compositions to be extruded can comprise polymers having a narrow molecular weight distribution or a broad molecular weight distribution, with a broad molecular weight distribution being preferred for polypropylene.

Further, as used herein, the term polymer includes homopolymers, various polymers, such as copolymers and terpolymers, and mixtures (including blends and alloys produced by mixing separate batches or forming a blend in situ). For example, the polymer can comprise copolymers of olefins, such as propylene, and these copolymers can contain various components. Preferably, in the case of polypropylene, such copolymers include up to about 10 weight % of at least one of ethylene and butene, but can contain varying amounts thereof depending upon the desired fiber or filament.

The melt flow rate (MFR) as described herein is determined according to ASTM D-1238 (condition L;230/2.16).

By practicing the process of the present invention, and by spinning polymer compositions using melt spin processes, such as a long spin or short spin process according to the present invention, fibers and filaments can be obtained which have excellent thermal bonding characteristics in combination with excellent tenacity, tensile strength and toughness. Moreover, the fibers and filaments of the present invention are capable of providing non-woven materials of exceptional cross-directional strength, toughness, elongation, uniformity, loftiness and softness using a short spin process, as well as a long spin process.

With regard to the above, while not wishing to be bound to any particular theory, by heating the polymer in the vicinity of the spinnerette, either by directly heating the spinnerette or an area adjacent to the spinnerette, filaments having polymeric zones of differing characteristics are obtained. In other words, the heating of the present invention heats the polymer composition at a location at or adjacent to the at least one spinnerette, by directly heating the spinnerette or an element such as a heated plate positioned approximately 1 to 4 mm above the spinnerette, so as to heat the polymer composition to a sufficient temperature to obtain a skin-core filament structure upon quenching in an oxidative atmosphere. For example, for a typical short spin process for the extrusion of polypropylene, the extrusion temperature of the polymer is about 230° C. to 250° C., and the spinnerette has a temperature at its lower surface of about 200° C. This temperature of about 200° C. does not permit oxidative chain scission degradation at the exit of the spinnerette. In this regard, a temperature of greater than about 200° C., preferably at least about 220° C., and even more preferably at least about 250° C. is needed across the exit of the spinnerette in order to obtain oxidative chain scission .degradation of the molten filaments to thereby obtain filaments having a skin-core structure. Accordingly, even though the polymeric material is heated to a sufficient temperature for melt spinning in known melt spin systems, such as in the extruder or at another location prior to being extruded through the spinnerette, the polymeric material cannot maintain a high enough temperature upon extrusion from the spinnerette, under oxidative quench conditions, without the heating supplied at or at a location adjacent to the spinnerette. In this regard, in the melt spin processes taught by the above-referred to Kozulla applications, the quenching is delayed so that the filament has sufficient time to remain at a high enough temperature to enable oxidative scission at the surface to obtain a skin-core structure.

Further, heat and mechanical degradation of the polymer just prior to its extrusion can assist in the obtaining of the skin-core structure. In other words, the controlling of the extrusion environment in the melt spin process enables the extruded material to have an inner zone of higher molecular weight molecules, and an outer zone of lower molecular weight molecules. The higher molecular weight molecules in the inner zone provide the fibers and filaments with high tenacity, tensile strength and toughness, while the lower molecular weight molecules in the outer zone provide sufficient flow characteristics for the fibers or filaments to achieve superior thermal bonding characteristics.

The oxidative quench of this process provides chain scission degradation of the molecular chains in the polymer at the outer zone, which, in comparison to the above-discussed Kozulla applications, is capable of controlling the interface between the inner, core zone and the outer, surface zone. In particular, the heating of the polymer and the oxidative quench contribute to provide the superior filamentary product obtained with the present process and apparatus. Thus, the heating conditions and the oxidative quench conditions are adjustable, with respect to each other, to obtain the skin-core filamentary structure of the present invention. Therefore, the present invention is capable of providing suitable conditions, even in a short spin process, that enable the creation of a skin, overcoming the inherent stabilizers in the polymer composition, when present.

More specifically, by utilizing the process and apparatus according to the present invention, greater degree of control is obtainable with respect to the structure of the skin-core fiber than when practicing the Kozulla process. In this regard, the interface between the core and skin of the skin-core structure of the present invention can be controlled so as to provide a gradient between the skin and the core as obtained in the Kozulla process, or can be controlled so as to provide distinct core and skin regions. In other words, a distinct step is obtainable between the core and skin of the present invention forming two adjacent discrete portions of the filament or fiber; whereas, in the Kozulla process a gradient is obtained between the core and the skin.

Figure 2:
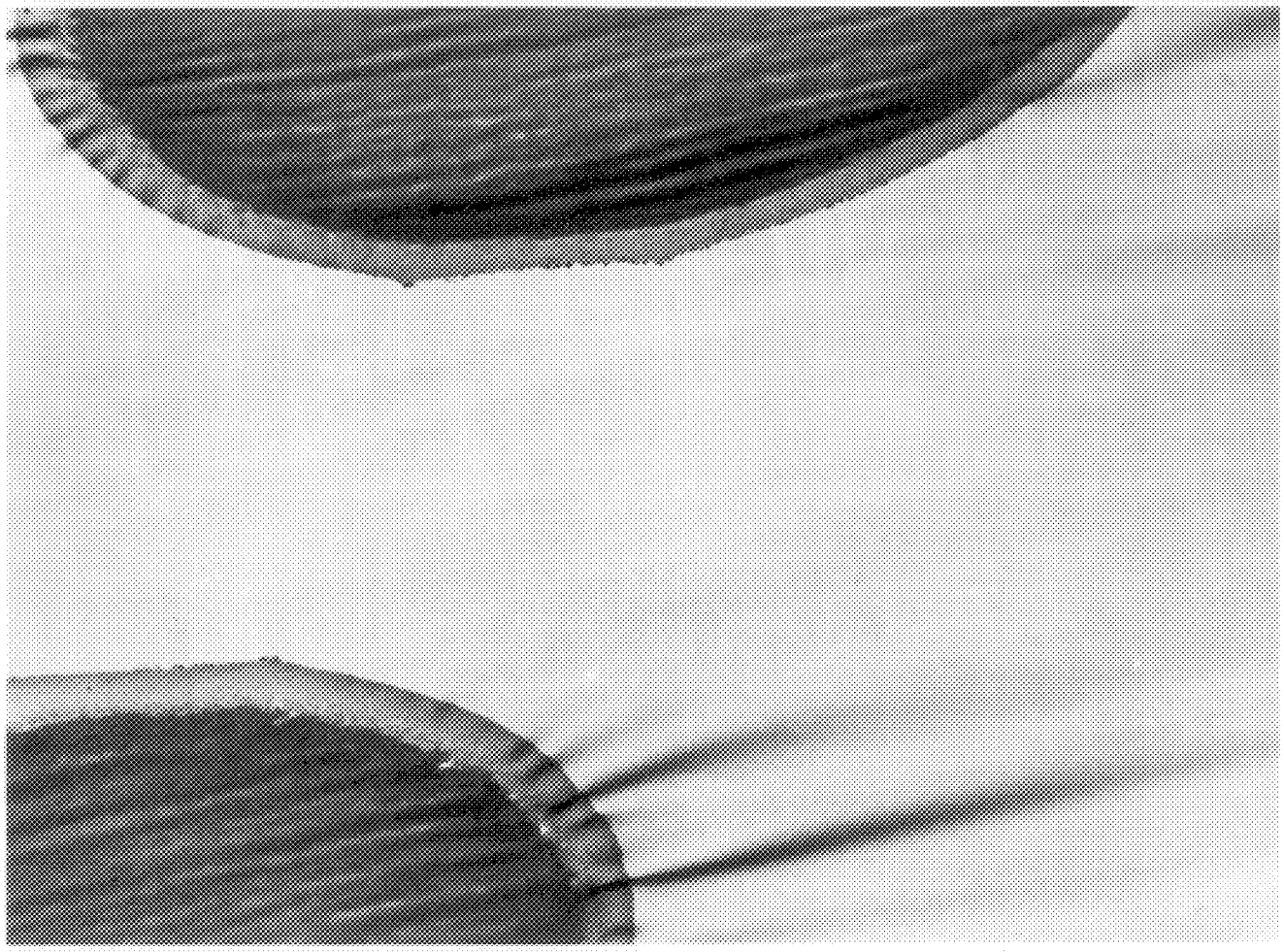
FIG. 2 illustrates a microphotograph of a polypropylene fiber stained with $RuO_4$ obtained using the process of the present invention.

In particular, FIGS. 1 and 2 are microphotographs, at 5,000x, illustrating this difference for polypropylene fibers stained with $RuO_4$ obtained using the Kozulla process and the process according to the present invention, respectively. As can be seen from these microphotographs, the skin-core structure of the Kozulla fiber illustrated in FIG. 1 is not very distinct, and there is a gradient area between the skin and the core. However, the skin-core structure illustrated in FIG. 2, obtained using the process of the present invention, has a clear line of demarcation between the skin and the core, whereby two adjacent discrete portions are provided.

As a result of the above-described difference in structure between the Kozulla fiber and the fiber according to the present invention, the physical characteristics of the fibers are also different. For example, the average melt flow rate of the fibers obtained according to the present invention is only slightly greater than the melt flow rate of the polymer composition; whereas, in the Kozulla fiber, the average melt flow rate of the fiber is significantly greater than the melt flow rate of the polymer composition. More specifically, for a melt flow rate of the polymer composition of about 10 dg/min, the average melt flow rate of the fiber according to the present invention can be controlled to about 11 to 12 dg/min, which indicates that chain scission degradation has been limited to substantially the skin portion of the skin-core fiber. In contrast, the average melt flow rate for the Kozulla fiber is about 20 to 30 dg/min, which indicates that chain scission degradation has been effected in both the core and the skin of the Kozulla fiber.

In each of the embodiments according to the present invention, whether directly heating the spinnerette or heating in another manner, such as with a heated plate, the temperature of the polymer, the temperature of the heated spinnerette or plate, and the quench conditions are controlled to permit, even in a short spin process, the spinning of the filaments with a skin-core structure. In the situation wherein the polymer comprises polypropylene, preferred conditions for each of these variables include the following. The polymer to be extruded preferably has a temperature of about 200° C. to 325° C., more preferably about 200° C. to 300° C., even more preferably 220° C. to 260° C., and most preferably about 230° C. to 240° C. The heated spinnerette preferably has a temperature of at least about 230° C., preferably at least about 250° C., and can be in the range of about 250° C. to 370° C., preferably in the range of about 290° C. to 360° C., and more preferably in the range of about 330° C. to 360° C. The apertured plate preferably is heated to a temperature of at least about 250° C., and can be in the range of about 250° C. to 370° C., preferably in the range of about 280° C. to 350° C., and more preferably in the range of about 300° C. to 360° C. The oxidative quench gas has a preferred flow rate of about 3,000 to 12,000 ft/min, more preferably a flow rate of about 4,000 to 9,000 ft/min, and even more preferably about 5,000 to 7,000 ft/min. These values can be varied depending on the polymer being treated, and the dimensions of the spin pack assembly including the spinnerette and/or the heated plate.

The oxidizing environment can comprise air, ozone, oxygen, or other conventional oxidizing environment, at a heated or ambient temperature, at a downstream portion of the spinnerette. The temperature and oxidizing conditions at this location must be maintained to ensure that, even in a short spin process, sufficient oxygen diffusion is achieved within the fiber so as to effect oxidative chain scission within at least a surface zone of the fiber to obtain the skin-core filament structure.

The temperature environment to obtain the skin-core filament structure can be achieved through a variety of heating conditions, and can include the use of heating through conduction, convection, inductance, magnetic heating and radiation. For example, resistance or impedance heating, laser heating, magnetic heating or induction heating can be used to heat the spinnerette or a plate associated with the spinnerette. Preferably, the heating substantially uniformly heats the spinnerette or the plate associated with the spinnerette. Further, the spinnerette or a plate associated with the spinnerette can comprise a hollow plate having a heat transfer fluid flowing therethrough or can be equipped with a band heater wrapped around its periphery. For example, with regard to magnetic heating, a magnetic field heating device as disclosed in U.S. Pat. No. 5,025,124 by Alfredeen, whose disclosure is hereby incorporated by reference in its entirety, can be used to obtain heating of the spinnerette or its associated elements. These means for heating the extrudable polymer at or at a location adjacent to the spinnerette to obtain the skin-core filamentary structure are not exhaustive, and other means for heating the spinnerette or elements associated with the spinnerette are within this invention. In other words, various sources of heating means can be utilized with the present invention to heat the polymer melt composition, which is at a certain temperature when it reaches a location at or adjacent to the spinnerette, to ensure that the polymer melt composition is at a sufficient temperature when extruded through the spinnerette to obtain a skin-core filament structure upon quenching in an oxidative atmosphere.

Figure 3:
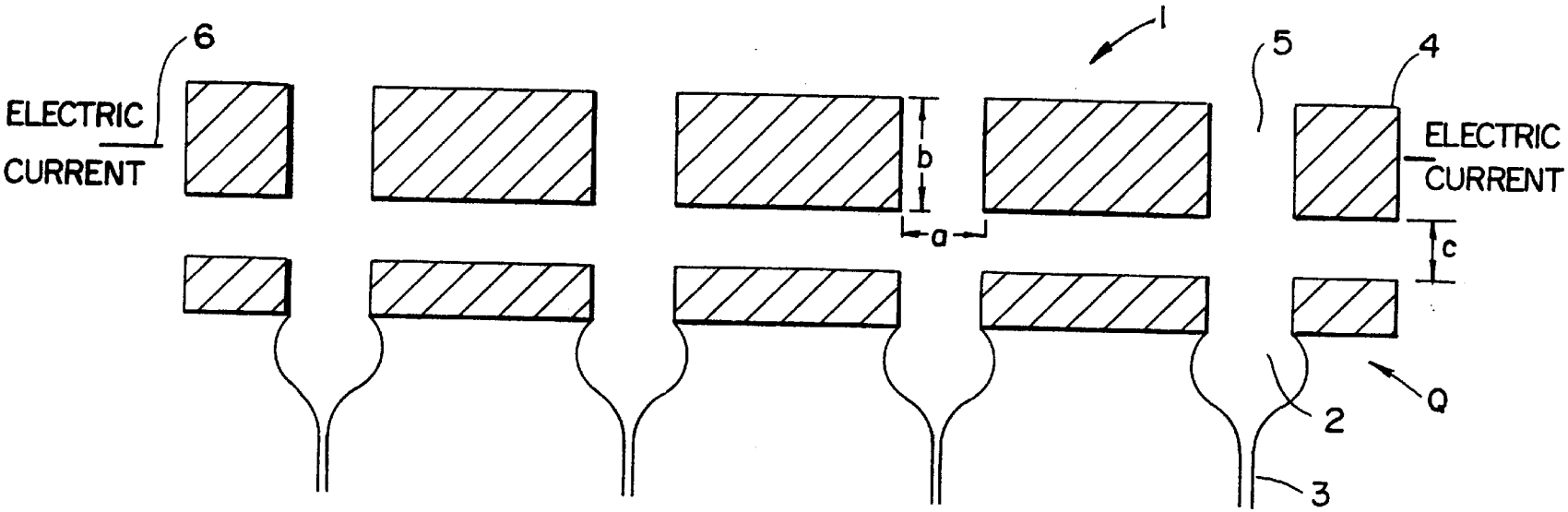
FIG. 3 illustrates an electrically heated plate associated with a spinnerette for providing the skin-core filamentary structure according to the present invention.

In the drawings, several non-limiting embodiments of the invention are illustrated wherein various structures are provided to obtain the skin-core filamentary structure, especially using a short spin process. Referring to FIG. 3, there is schematically illustrated a spinnerette 1 having capillaries 2 through which polymer is extruded to be quenched by the oxidative gas flow Q to form filaments 3. Located above the spinnerette is a plate 4 having capillaries 5, which capillaries 5 correspond to capillaries 2 of the spinnerette 1. An electric current is provided, such as through leads 6 to the plate 4 to heat the plate either by resistance or impedance.

The plate 4 can be heated to a suitable temperature, such as a temperature of at least about 250° C. to raise the temperature of the polymer as it approaches and passes through the plate 4. More specifically, as the polymer passes through the plate 4, it is heated to a sufficient temperature to permit oxidative chain scission degradation of at least the surface of the molten filament upon extrusion from the spinnerette into the oxidative gas flow Q. While not being wished to be bound to any particular theory, in this embodiment, smaller molecular weight molecules are obtainable on the surface of the polymer (as compared to the core) when subjected to oxidative quench conditions due to the differential heating obtained on the surface of the extrudate, as well as due to the additional stress on the polymer stream as the polymer flows to and from the plate 4 to the spinnerette 1.

The distance "c" between the heated plate 4 and the spinnerette 1 can be varied depending upon the physical and chemical characteristics of the composition, the temperature of the composition and the dimensions of the capillaries 2. For example, for a melt flow rate of a polypropylene polymer of about 0.5 to 40 dg/min, and a temperature of about 200° C. to 325° C., the capillaries 2 and 5 should have a cross-sectional area "a" of about 0.03 to 0.3 $mm^2$, preferably about 0.1 $mm^2$, and a length "b" of about 1 to 5 mm, preferably about 1.5 mm, and distance "c" should be about 1 to 4 mm, preferably about 2 to 3 mm, and more preferably about 2.5 mm.

Figure 4:
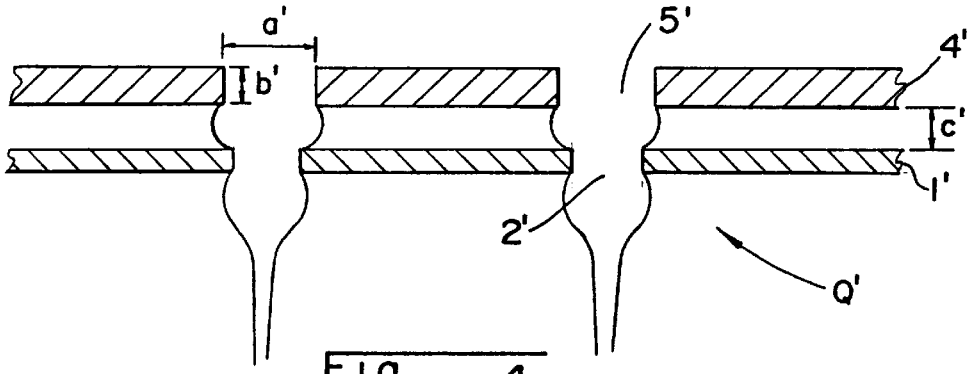
FIG. 4 illustrates another embodiment of an electrically heated plate associated with a spinnerette for providing the skin-core filamentary structure according to the present invention.

The capillaries 2 and 5 can be of the same or substantially the same dimensions, as shown in FIG. 3, or can be of different dimensions, such as capillaries 2 being of a smaller or larger diameter than capillaries 5. For example, as illustrated in FIG. 4, with similar parts being referred to with the same reference numerals but including primes thereon, capillaries 5' can have a larger diameter than capillaries 2'. In this instance, capillaries 5' would preferably be up to about 30% wider than capillaries 2', and preferably have a cross-sectional area of about 0.4 $mm^2$. A limiting factor on the size of capillaries 5' for embodiments wherein capillaries 5' correspond in number and/or pattern to the capillaries 2' is the ability to maintain the strength of the heated plate while fitting a large number of capillaries therein.

Figure 6:
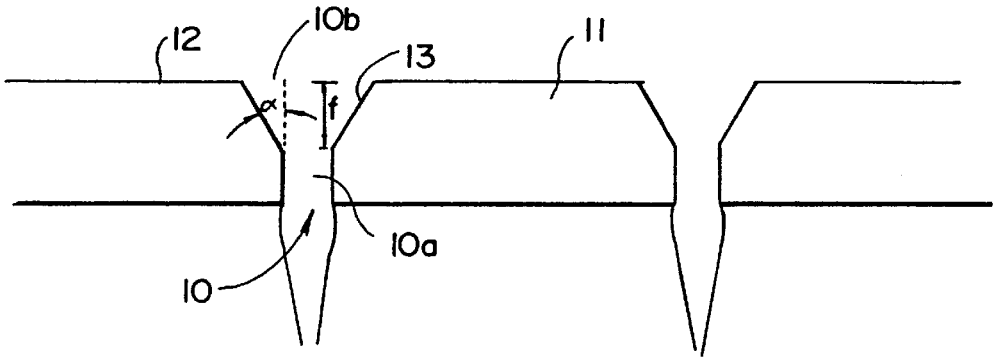
FIG. 6 illustrates a spinnerette for providing the skin-core filamentary structure according to the present invention which includes countersunk tapered capillaries.
Figure 5:
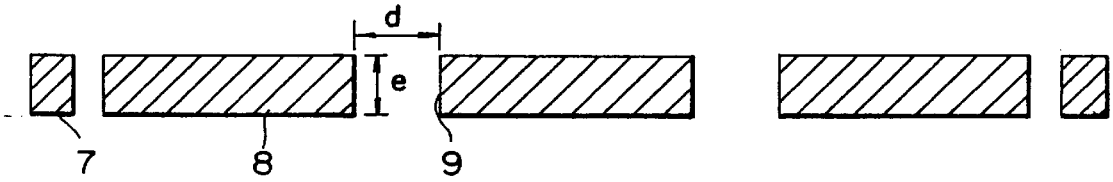
FIG. 5 illustrates a spinnerette for providing the skin-core filamentary structure according to the present invention which is heated by induction heating.

Moreover, as illustrated in FIGS. 5 and 6, the spinnerette can be directly heated by various means whereby a heated plate can be omitted. For example, as shown in FIG. 5, an induction coil 7 can be positioned around the spinnerette 8 in order to heat the spinnerette to a sufficient temperature for obtaining the skin-core filament structure. The temperature to heat the spinnerette to varies depending upon the chemical and physical characteristics of the polymer, the temperature of the polymer, and the dimensions of the capillaries 9. For example, for a melt flow rate of a polymer, such as polypropylene, of about 0.5 to 40 dg/min, and a temperature of about 200° C. to 325° C., the capillaries 9 would have a cross-sectional area "d" of about 0.02 to 0.2 $mm^2$, preferably about 0.07 $mm^2$, and a length "e" of about 1 to 20 mm, preferably about 1–5 mm, and more preferably about 1.5 mm.

FIG. 6 shows a modified spinnerette structure wherein the capillaries 10 of spinnerette 11 are countersunk on the upper surface 12 of the spinnerette 11 so that the capillaries 10 include a tapered, upper portion 13. Capillaries 10 have a total length of about 3 to 20 mm, preferably about 7–10 mm; a first cross-sectional area 10*a* of about 0.03 $mm^2$ to 0.2 $mm^2$ at a lower portion; a maximum cross-sectional area 10*b* at the surface 12 of about 0.07 $mm^2$ to 0.5 $mm^2$, preferably about 0.2 $mm^2$; and the countersunk capillaries taper from the maximum cross-sectional area 10*b* to the first cross-sectional area 10*a* at an angle $\alpha$ of about 20° to 60°, preferably about 35° to 45°, and more preferably about 45°. The countersunk capillaries can include a distance "f" between the maximum cross-sectional area 10*b* to the first cross-sectional area 10*a* of about 0.15 to 0.4 mm.

As illustrated in FIG. 7, the capillaries can comprise counterbored, countersunk capillaries 49. These counterbored, countersunk capillaries can comprise an upper tapered portion 49*a* having an upper diameter 49*b* of about 0.6 mm and a length of about 0.5 mm. The upper diameter 49*b* tapers by an angle $\beta$ of about 20° to 60°, preferably about 35° to 45°, and more preferably about 45°, to an upper capillary 49*c* having a diameter of about 0.5 mm and a length of about 3.5 mm. A middle tapered portion 49*d* having a length of about 0.1 mm and an angle $\gamma$ of about 20° to 60°, preferably about 35° to 45°, and more preferably about 45°, connects the upper capillary 49*c* to a lower capillary 49*e* having a diameter of 0.35 mm and a length of about 1.5 mm.

As illustrated in FIG. 8, the capillaries can comprise counterbored capillaries 50. These counterbored capillaries 50 can comprise an upper capillary 50*a* having a diameter of about 0.5 mm and a length of about 4 mm. A middle tapered portion 50*b* having a length of about 0.1 mm tapers at an angle $\theta$ of about 20° to 60°, preferably about 35° to 45°, and more preferably about 45° to a lower capillary 50*c* having a diameter of 0.35 mm and a length of about 2 mm.

Any of the above-described spinnerettes can have a recess at a lower portion, such as recess 50*d* illustrated in FIG. 8. The recess can have a cross-sectional area of about 0.05 to 0.4 $mm^2$, preferably of about 0.3 $mm^2$, and a length of about 0.25 mm to 2.5 mm, preferably a length of about 0.5 mm.

Figure 9:
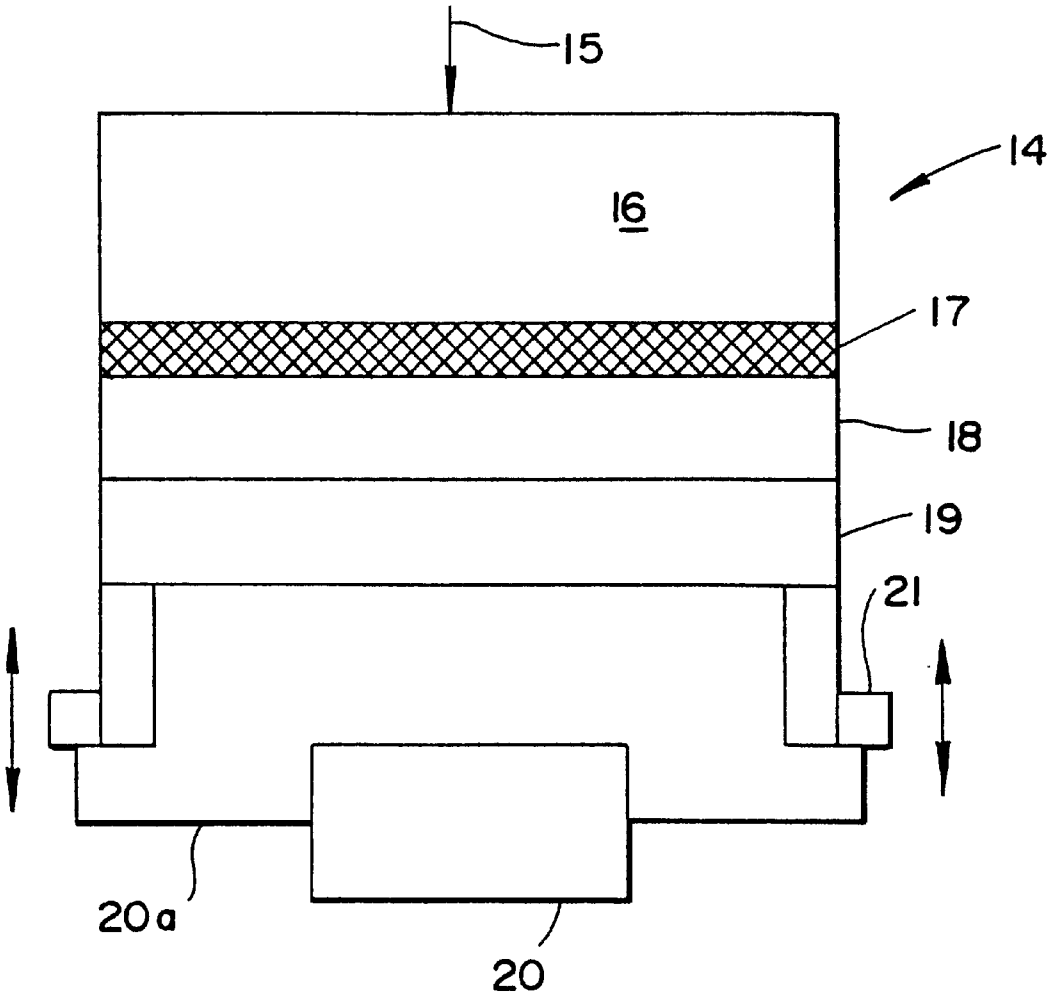
FIG. 9 illustrates a spin pack assembly which includes an electrically heated spinnerette for providing the skin-core filamentary structure according to the present invention.

FIG. 9 illustrates an exemplary illustration of a spin pack assembly according to the present invention for impedance heating of the spinnerette. In the spin pack assembly 14 of FIG. 9, polymer 15 enters the spin pack top 16, passes through filter screen 17, breaker plate 18, and through the heated spinnerette 19 supplied with low voltage through an adjustable clamp 21 via conductor 20*a* from transformer 20.

This type of spin pack assembly is known in the art, with the exception of the heating of the spinnerette. Accordingly, the filter screen and breaker plate and materials of construction can be chosen using conventional guidelines for these assemblies.

For impedance heating of the spinnerette or heated plate the current is preferably about 500 to 3,000 amperes, the transformer tap voltage is preferably about 1 to 7 volts, and the total power should preferably be about 3 to 21 kilowatts. These values can be varied depending on the polymer being treated, and the dimensions of the spin pack assembly including the dimensions of the spinnerette and/or the heated plate.

Figure 10:
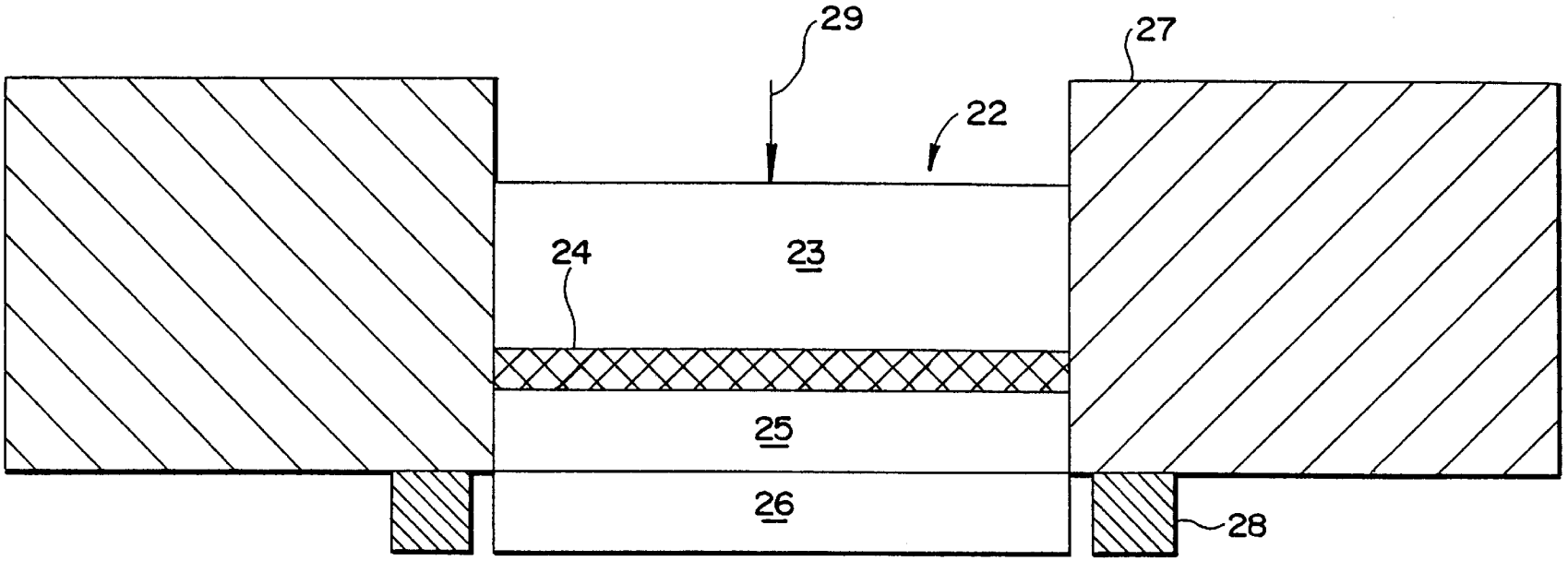
FIG. 10 illustrates a spin pack assembly which includes a heated spinnerette heated by induction heating for providing the skin-core filamentary structure according to the present invention.

FIG. 10 illustrates an exemplary illustration of a spin pack assembly according to the present invention for induction heating of the spinnerette. In the spin pack assembly 22 of FIG. 10, polymer 29 enters the spin pack top 23, passes through filter screen 24, breaker 25, and through spinnerette 26 heated by induction coil 28 which surrounds the spinnerette. Surrounding the spin pack assembly is a Dowtherm manifold 27.

For induction heating of the spinnerette or heated plate, the oscillating frequency is about 2 to 15 kilohertz, is preferably about 5 kilohertz, and the power is about 2–15 kilowatts, preferably 5 kilowatts. However, as with impedance heating, these values can be varied depending on the polymer being treated, and the dimensions of the spin pack assembly including the dimensions of the spinnerette and/or the heated plate.

Figure 11:
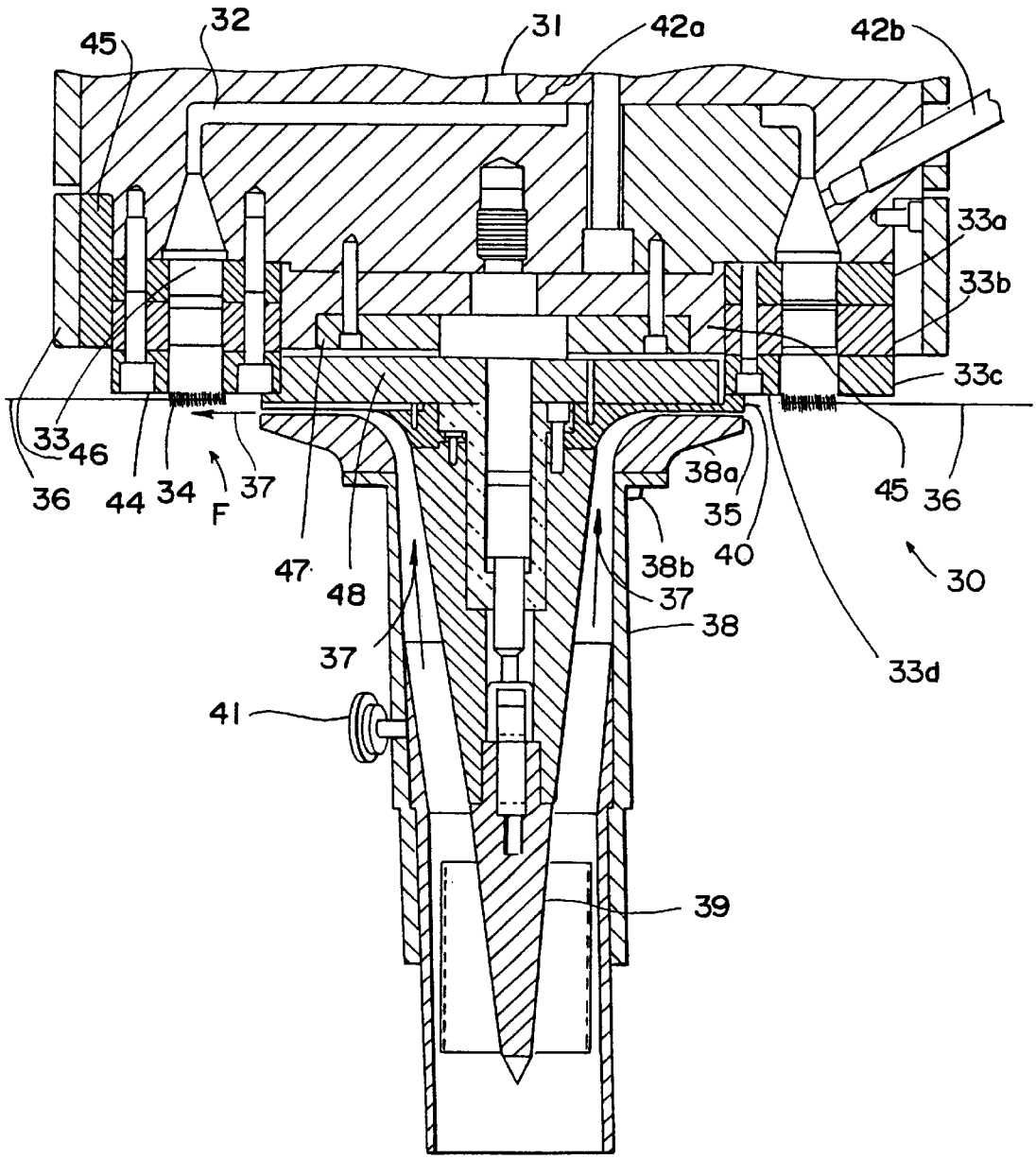
FIG. 11 illustrates a radial quench apparatus which operates with an electrically heated spinnerette for providing the skin-core filamentary structure according to the present invention.

FIG. 11 illustrates a cross-sectional view of a radial quench short spin apparatus 30. The radial quench short spin apparatus, which is a modified version of apparatus manufactured by Meccaniche Morderne of Milan, Italy, includes a polymer inlet spin pump 31 through which the polymer that is heated to a first temperature, such as at 200° C. to 300° C. is fed by a plurality of polymer feed ducts 32 to the spin pack assemblies 33 having breaker plates 33*a* and 33*b*, and inner and outer retaining rings 33*c* and 33*d* and spinnerettes 34. The extruded polymer in the form of filaments F are drawn downwardly past the high rate of flow oxidative quench, illustrated by arrows 37, flowing between outer encasement 38 and the cone-shaped conduit 39, and through annular opening 35. As can be seen in FIG. 11, the annular opening 35 is formed by upper extension 38*a* of the outer encasement 38, which can be attached by bolts 38*b*, and metal plate 40. A set screw 41 can be tightened to adjustably secure the outer encasement 38 to provide differing lengths.

Moreover, a thermocouple 42*a* is positioned in a region near the spin pump 31 to measure-the polymer feed temperature, and another thermocouple 43*b* is positioned near the top of a spinnerette assembly 33 to measure the polymer temperature at the spinnerette head. Bolts 44 are employed for releasably securing each of the spin pack assemblies 33 in place. A band heater 45 can surround the spin pack assemblies 33 for maintaining or adjusting the melt temperature of the polymer melt. Further, to obtain the heating of the electrically heated spinnerette in this embodiment to obtain the heating of the polymer melt at or at a location adjacent to the spinnerette, copper terminals 36 are attached to the spinnerette for connection to an electrical source (not shown). Also, insulation is provided at 46, 47 and 48.

Figure 12:
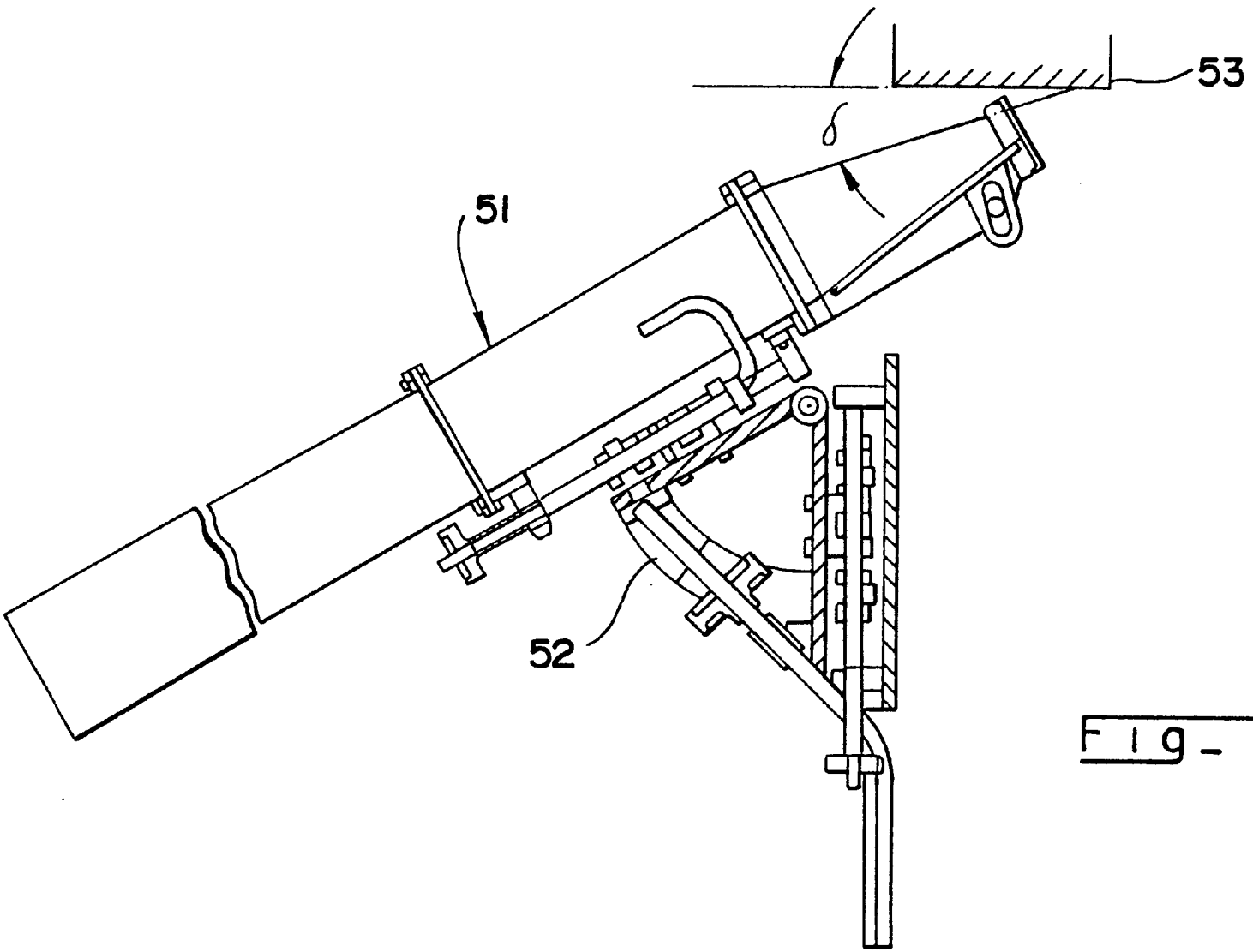
FIG. 12 illustrates movable nozzle apparatus for quenching the skin-core filamentary structure according to the present invention.

The quench flow can be effected by other than the radial flow illustrated in FIG. 11, and various other manners of providing a high rate of oxidative quench gas to the filaments as they exit the spinnerette can be used. For example, a nozzle can be positioned relative to each spinnerette so as to direct a high flow rate of oxidative quench gas to the filaments as they exit each spinnerette. One such nozzle, as illustrated in FIG. 12, is available from Automatik of Germany. This nozzle 51 is movably mounted using elements 52 to most preferably be directed towards the center of the spinnerette 53 at an angle δ with respect to a plane longitudinal passing through the spinnerette of about 0° to 60°, more preferably about 10° to 60°, and can also preferably be an angle of about 0° to 45°, more preferably 0° to 25°.

The various elements of the spin pack assembly of the present invention can be constructed using conventional materials of construction, such as stainless steel, including 17-4PH stainless steel, 304 stainless steel and 416 stainless steel, and nickelchrome, such as nickelchrome-800H.

The spun fiber obtained in accordance with the present invention can be continuous and/or staple fiber of a monocomponent or bicomponent type, and preferably falls within a denier per filament (dpf) range of about 0.5–30, more preferably is no greater than about 5, and preferably is between about 0.5 and 3.0.

Additionally, in making the fiber in accordance with the present invention, at least one melt stabilizer and/or antioxidant is mixed with the extrudable composition. The melt stabilizer and/or antioxidant is preferably mixed in a total amount with the polypropylene to be made into a fiber in an amount ranging from about 0.005–2.0 weight % of the extrudable composition, preferably about 0.03–1.0 weight %. Such stabilizers are well known in polypropylene-fiber manufacture and include phenylphosphites, such as IRGAFOS 168 (available from Ciba Geigy Corp.), ULTRANOX 626 (available from General Electric Co.), and SANDOSTAB PEP-Q (available from Sandoz Chemical Co.); and hindered phenolics, such as IRGANOX 1076 (available from Ciba Geigy Corp.) and CYANOX 1790 (available from American Cyanamid Co.); and N,N'-bis-piperidinyl diamine-containing materials, such as CHIMASSORB 119 and CHIMASSORB 944 (available from Ciba Geigy Corp.).

The at least one melt stabilizer and/or antioxidant can be mixed into the extrudable composition, or can be separately added to polypropylenes that are to be mixed together to form the extrudable composition.

Optionally, whiteners, such as titanium dioxide, in amounts up to about 2 weight %, antiacids such as calcium stearate, in amounts ranging from about 0.05–0.2 weight %, colorants, in amounts ranging from 0.01–2.0 weight %, and other well known additives can included in the fiber of the present invention. Wetting agents, such as disclosed in U.S. Pat. No. 4,578,414, incorporated herein by reference, are also usefully incorporated into the fiber of the present invention. Other commercially available useful additives include LUPERSOL 101 (available from Pennwalt Corp.)

Additionally, metal carboxylates can be added to the polymer material. These metal carboxylates are known for use in polymer materials to be subjected to thermal bonding, and a small amount of metal carboxylates is believed to lower the surface fusion temperature of polymer materials, such as polypropylene fiber. Typical metal carboxylates include nickel salts of 2-ethylhexanoic, caprylic, decanoic and dodecanoic acids, and 2-ethylhexanoates of Fe, Co, Ca and Ba. Preferred metal carboxylates include nickel octoates, such as a 10% solution in mineral spirits of nickel octoate obtained from Shepherd Chemical Co., Cincinnati, Ohio. Preferably, the metal carboxylates are included in the polymer material to be made into fibers or filaments in a concentration of about 7 ppm to 1000 ppm, most preferably about 700 ppm.

In order to more clearly describe the present invention, the following non-limiting examples are provided. All parts and percentages in the examples are by weight unless indicated otherwise.

EXAMPLES

Fibers were produced using both small-scale developmental tests and pilot plant tests, under the operating conditions tabulated in Table I. More specifically, the different polymers, their temperatures and spin conditions, and differing conditions are tabulated in Table I, accompanied by information pertaining to the skin-core structure of the resulting fibers based on microfusion analysis.

The test procedures tabulated in the examples in Table I include the following:

Examples 1–67 utilized a heated apertured plate in a small-scale developmental test, with Examples 22–44 incorporating 0.00019% Ultranox 626 as an antioxidant stabilizer.

Examples 68–75 and 188–196 utilized a heated spinnerette having recessed capillaries in a small-scale developmental test.

Examples 76–79 utilized a heated apertured plate in a small-scale developmental test wherein heating was achieved with a band heater.

Examples 80–89 utilized a heated spinnerette in a small-scale developmental test wherein heating was achieved with a band heater.

Examples 90–187 utilized a heated spinnerette having recessed capillaries in a pilot plant test, with Examples 90–150 using an extruder temperature of 240 to 280° C., and Examples 151–187 using an extruder temperature of 285 to 300° C.

Examples 197–202 utilized a heated spinnerette without recessed capillaries in a small-scale developmental test.

Examples 203–313 utilized a heated spinnerette without recessed capillaries in a pilot plant test.

Examples 314–319 utilized a heated spinnerette without recessed capillaries in a small-scale developmental test, wherein the polypropylene contained nickel octoate.

Examples 320–324 utilized a heated spinnerette without recessed capillaries in a small-scale developmental test, wherein the polymer was polyethylene.

Examples 325–331 utilized a spinnerette without recessed capillaries in a small-scale developmental test, wherein the polymer was polyester.

Figure 13A:
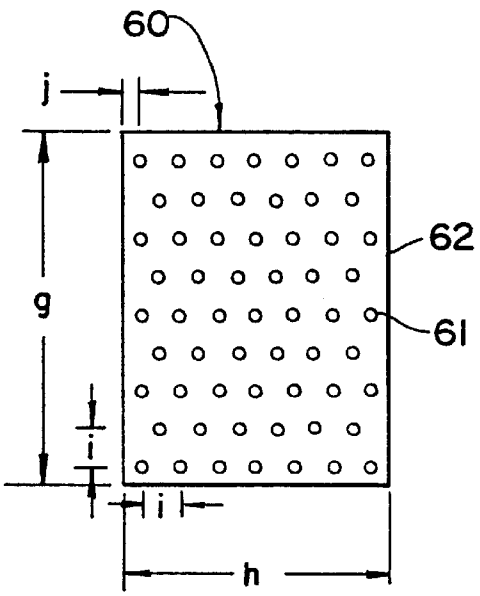
FIGS. 13*a*, 13*b*, 13*c* and 13*d* illustrate the heated spinnerette used in the small-scale developmental tests in the examples tabulated in Table I.

In the small-scale developmental test using a heated spinnerette, a directly heated spinnerette 60 was constructed from nickel chrome-800H having dimensions, as illustrated in FIG. 13*a*, of 0.3 inch (dimension "g")×0.25 inch (dimension "h") including 59 capillaries 61 positioned in alternating rows of 6 and 7 capillaries having a diameter of 0.012 inch (0.3 mm) and length of 0.12 inch, with the spinnerette having a corresponding thickness of 0.12 inch. In particular, there were 5 rows having 7 capillaries alternating with 4 rows having 6 capillaries, with the capillaries being spaced 0.03 inch (dimension "i") from each other, and 0.035 inch (dimension "j") from edges 62 of the spinnerette.

Figure 13D:
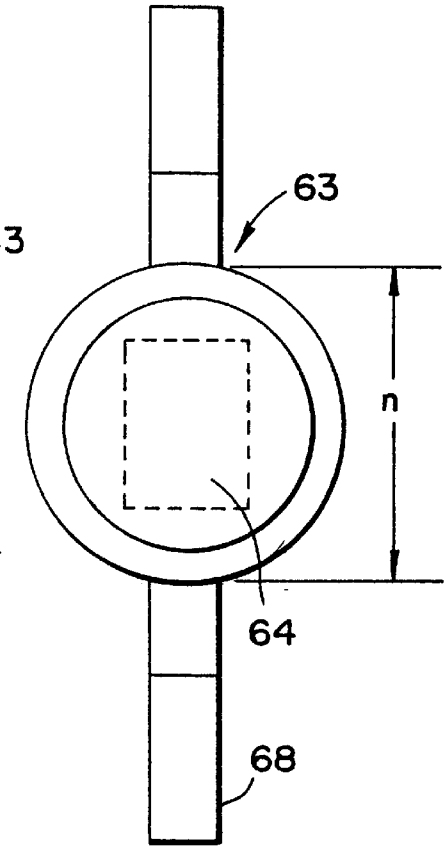
Figure 13C:
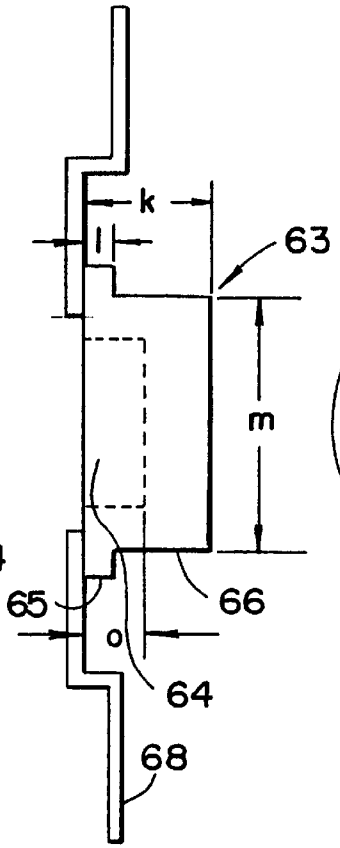
Figure 13B:
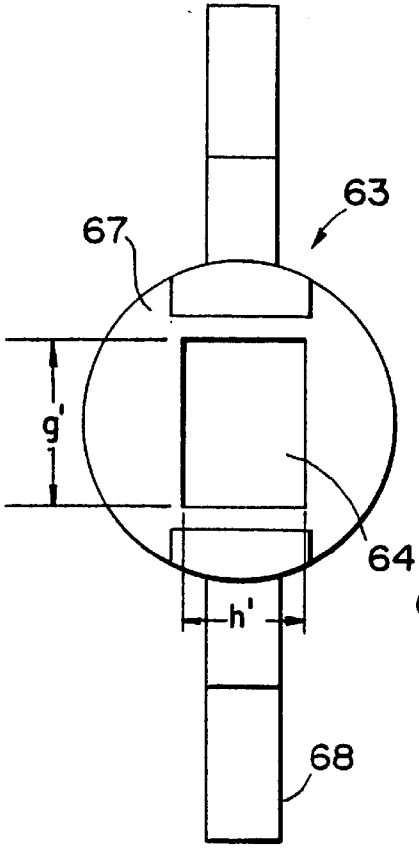

As illustrated in FIGS. 13*b*, 13*c* and 13*d*, the spinnerette 60 is inserted into a recess 64 of spinnerette holder 63, which recess 64 has corresponding dimensions of 0.3 inch (dimension "g'") by 0.25 inch (dimension "h'") to the spinnerette 60, and a depth of 0.1 inch (dimension "o"). The spinnerette holder has an upper portion 65 having a diameter of 0.745 inch (dimension "n"), and a thickness of 0.06 inch (dimension "l"), and a lower portion 66 having a diameter 0.625 inch (dimension "m") and a thickness to provide an overall thickness of 0.218 inch (dimension "k") for the spinnerette holder 63. Further, copper terminals 68 were connected to the upper surface 67 of the spinnerette holder 63 for connection to a power source (not shown).

Figure 14:
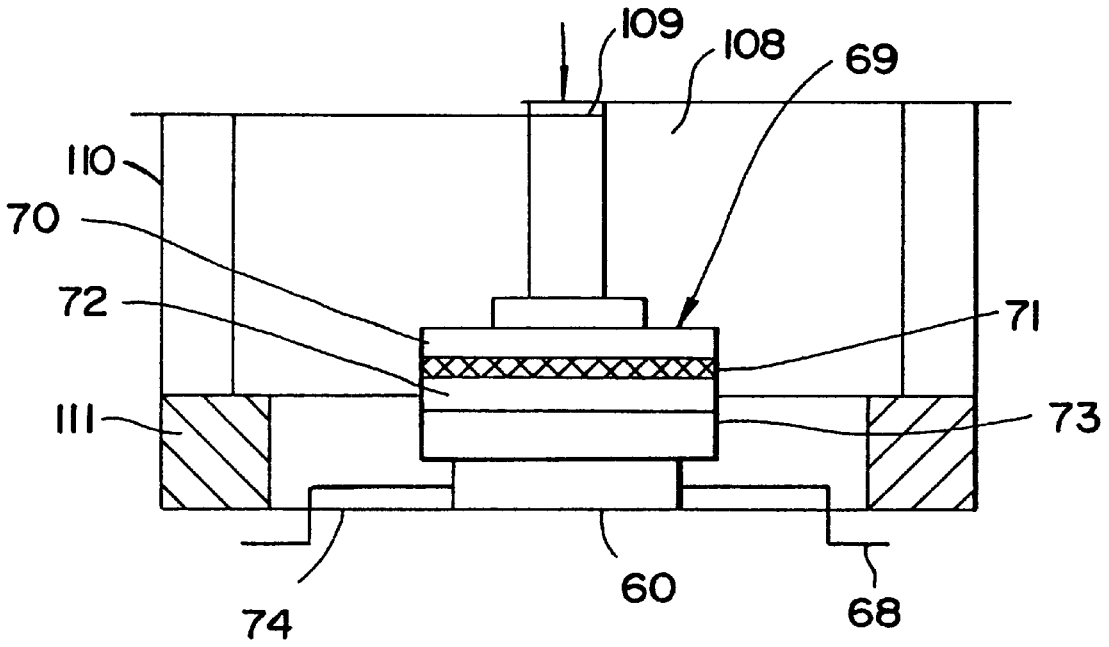
FIG. 14 illustrates the spin pack assembly using the heated spinnerette in the small-scale developmental tests in the examples tabulated in Table I.

As illustrated schematically in FIG. 14, this spinnerette was mounted in a spin pack assembly 69. The spin pack assembly 69 included, in sequential order, a polymer feed distributor 70, a filter 71, a distributor 72, a spacer 73, the spinnerette 60, and a lower clamping element 74. The spin pack assembly was attached to a polymer pipe 108 for directing polymer through inlet 109 to the spin pack assembly 69. Further, a band heater 110 and insulation 111 surrounded the assembly.

Figure 15:
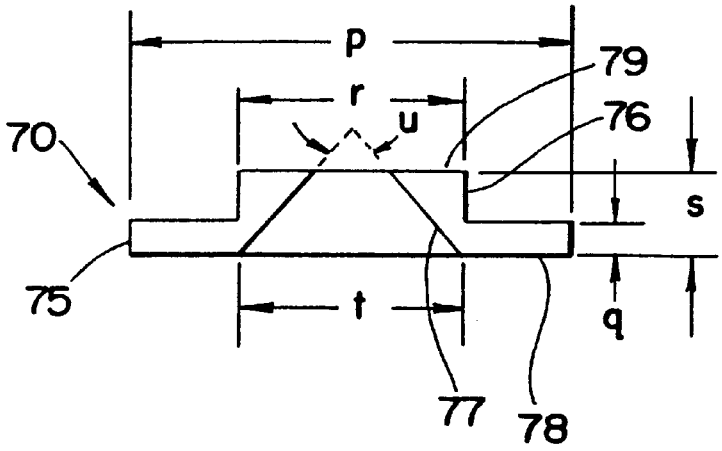
FIG. 15 illustrates the polymer feed distributor used in the small-scale developmental tests in the examples tabulated in Table I.

As illustrated in FIG. 15, the polymer feed distributor 70, which was constructed from 17-4PH stainless steel, included a lower portion 75 having a diameter of 0.743 inch (dimension "p") and a thickness of 0.6 inch (dimension "q"), and an upper portion 76 having a diameter of 0.646 inch (dimension "r") and a thickness to provide an overall thickness to the polymer feed distributor 70 of 0.18 inch (dimension "s"). Centrally located in the polymer feed distributor 70 was a conically-spaced opening 77 having, on surface 78, a lower diameter of 0.625 inch (dimension "t") tapering inwardly and upwardly to upper surface 79 at an angle "u" of 72°.

The filter screen 71 included a combination of three 304 stainless steel screens surrounded by a 24 gauge (0.02 inch thick) aluminum binder. The filter screens included a first screen of 250 mesh, a second screen of 60 mesh and a third screen of 20 mesh. The aluminum binder had an inner diameter (forming an opening for the filter screen) of 0.63 inch, an outer diameter of 0.73 inch, and a thickness of 0.094 inch.

Figure 16B:
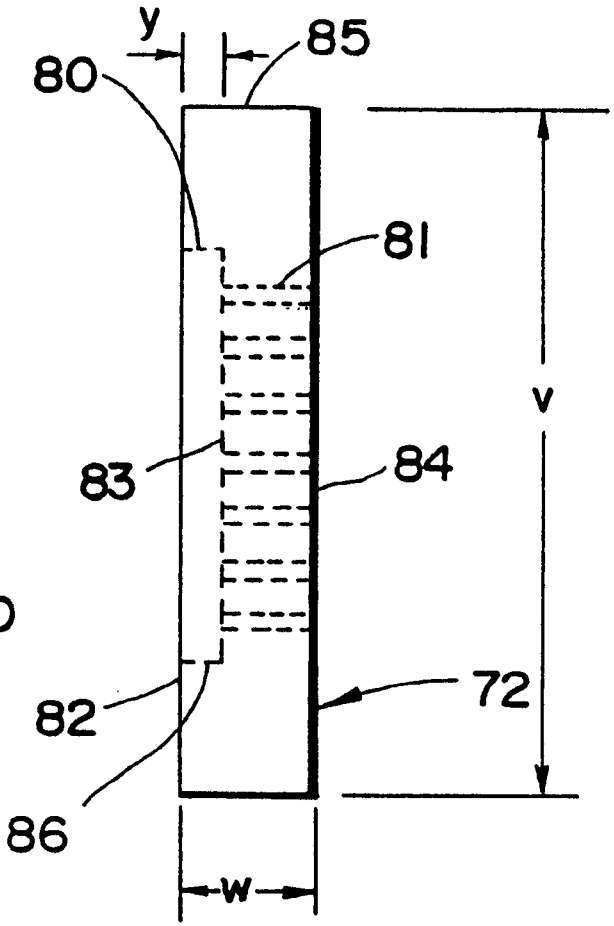
FIGS. 16*a* and 16*b* illustrate the distributor used in the small-scale developmental tests in the examples tabulated in Table I.
Figure 16A:
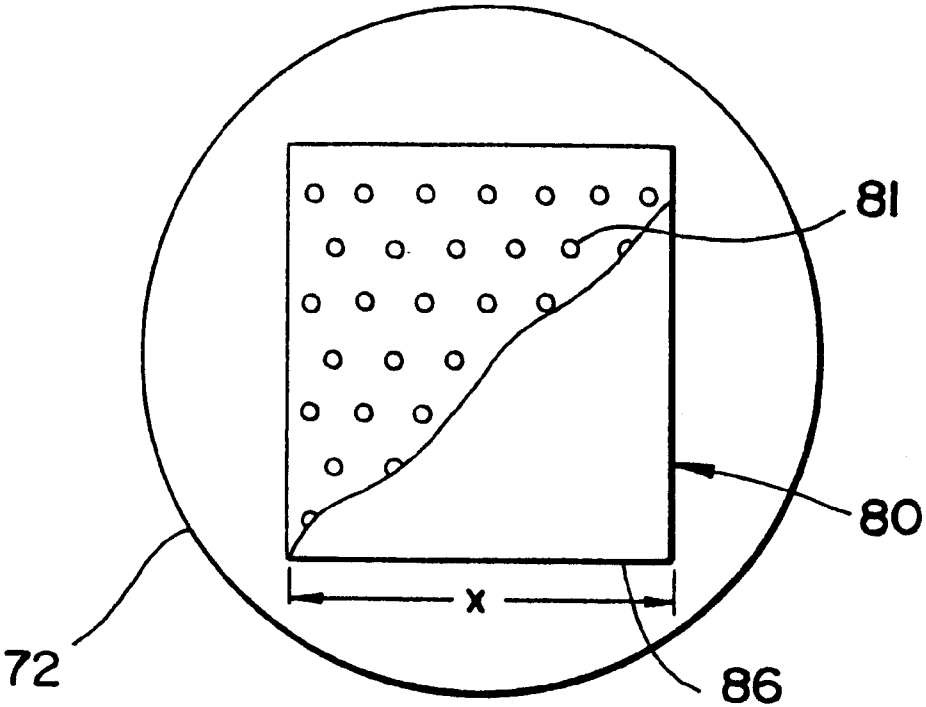

As illustrated in FIGS. 16*a* and 16*b*, the distributor 72, which was constructed from 17-4PH stainless steel, included an element 85 of round cross-section having a diameter of 0.743 inch (dimension "v") and a thickness of 0.14 inch (dimension "w"). A square-shaped recess 83 was centrally located in the upper surface 82 of the element 85 having edges 86 of 0.45 inch (dimension "x") and a depth to a lower recess surface 83 of 0.02 inch (dimension "y"). The element further included 46 capillaries enabling flow of polymer from the lower recess surface 83 through the lower surface 84 of element 85. The capillaries had a diameter of 3/64 inch, were uniformly spaced, and included 4 rows of seven capillaries alternating with 3 rows of 6 capillaries. The capillaries were spaced from edges 86 of the recess 80 by approximately 0.06 inch.

As illustrated in FIG. 17, the spacer 73, which was constructed from 416 stainless steel, included an upper element 87 having an outer diameter of 0.743 inch (dimension "z") and a thickness of 0.11 inch (dimension "aa") and a lower element 88 having an outer diameter of 0.45 inch (dimension "bb") and a thickness of 0.07 inch (dimension "cc") to provide an overall thickness of 0.18 inch (dimension "dd"). Further, the spacer 73 included an opening 89 having a maximum diameter at the surface 91 of the upper element 87 and tapered inwardly and downwardly along the conically-shaped taper 90 to point 92 where the lower element 88 begins, and then maintained a constant diameter of 0.375 inch (dimension "ff") to lower surface 93.

As illustrated in FIGS. 18*a* and 18*b*, lower clamping element 74, which was constructed from 416 stainless steel, included an element 94 having an outer diameter of 2 inches (dimension "gg") and a thickness of 0.4 inch (dimension "kk"). An opening 95 communicated upper surface 96 of element 94 to lower surface 97. opening 95 included a maximum diameter of 0.75 inch (dimension "hh") at the upper surface 96, and maintained this maximum diameter for 0.34 inch (dimension "ii") where the diameter was reduced to 0.64 inch (dimension "jj") and maintained this reduced diameter until lower surface 97, whereby a recessed surface 98 was obtained against which the spinnerette holder 63 was pressed when bolts (not shown) positioned in openings 99 were tightened. For ease in viewing the figures, openings 99 have been omitted from FIG. 18*b*. Slot 100 having a width of 0.25 inch (dimension "ll") was located in the element 94 to a depth of 0.28 inch (dimension "mm") for receiving and permitting the copper terminals 68 to protrude from the spin pack assembly 69.

Figure 19:
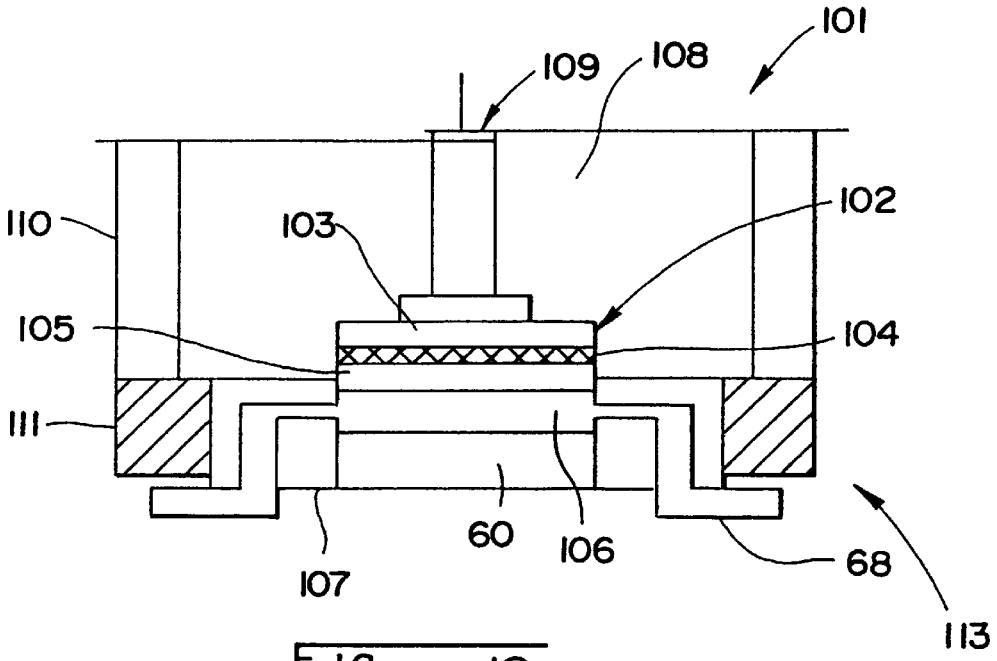
FIG. 19 illustrates the spin pack assembly using the heated plate in the small-scale developmental tests in the examples tabulated in Table I.

In the small-scale developmental test using a heated plate, the structure of the spin pack assembly was similar to that of the above-described heated spinnerette assembly; however, the heated plate was added to the assembly and the spinnerette had a different number of capillaries. In particular, as seen in FIG. 19, the small-scale developmental test assembly 101 included a spin pack assembly 102 having a polymer feed distributor 103, a filter screen 104, a distributor 105, a heated plate 106, a spinnerette 60, copper terminal 68 and a lower clamping element 107. Additionally, in a similar manner to the above-described heated spinnerette embodiment, the spin pack assembly 102 was attached to a polymer pipe 108 for directing polymer through inlet 109 to the spin pack assembly 102. Further, a band heater 110 and insulation 111 surrounded the assembly.

Figure 20A:
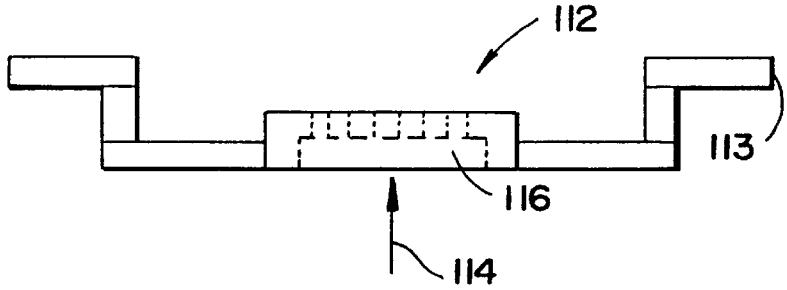
FIGS. 20*a* and 20*b* illustrate the heated plate used in the small-scale developmental tests in the examples tabulated in Table I.
Figure 20B:
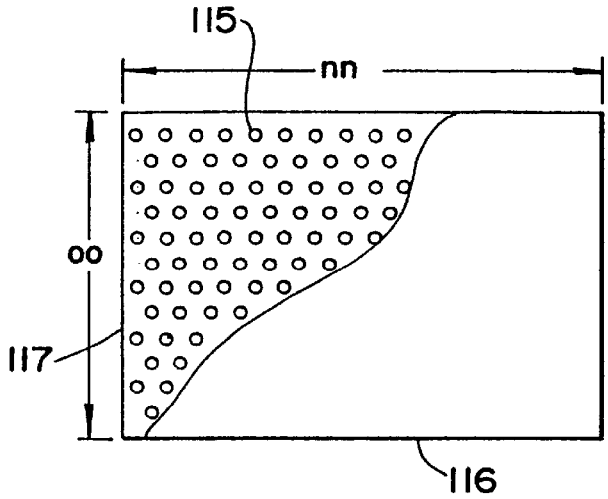

As illustrated in FIGS. 20*a* and 20*b*, the heated plate 112, which was constructed of stainless steel, is similar in construction to the distributor 72 as illustrated in FIGS. 16*a* and 16*b*. However, in contrast to the distributor, the heated plate 112 included copper terminals 113 for connection to a source of electricity (not shown), and included 186 capillaries 115 situated below a 0.1 inch deep recess 116 for flow of polymer in the direction indicated by arrow 114. The capillary layout is illustrated in FIG. 20*a*, wherein there are partially shown 186 capillaries 115 positioned in alternating rows of 15 and 16 capillaries having a diameter of 0.012 inch and a length of 0.078 inch (2 mm). In particular, in an area having a length along edge 116 of 0.466 inch (dimension "nn") and a width along edge 117 of 0.442 inch (dimension "oo"), there were positioned 6 rows having 16 capillaries alternating with 6 rows having 15 capillaries, with the distance between capillaries, on center, being 0.027 inch along edge 116 and 0.034 inch along edge 117, with end capillaries on the rows having 16 capillaries being spaced from edge 117 by 0.03 inch and end capillaries on the rows having 15 capillaries being spaced from edge 117 by 0.04 inch. Moreover, in the heated plate small-scale developmental test, the spinnerette had 186 capillaries of the same pattern as the heated plate, but had a diameter of 0.008 inch and a length of 0.006 inch (1.5 mm).

For examples wherein a spinnerette having recessed capillaries in a small-scale developmental test was used, the capillaries had a diameter of 0.3 mm and a total length of 4.0 mm, and the recessed portions had a diameter of 0.5 mm and a length of 1.0 mm.

For examples wherein a heated spinnerette in a pilot plant test was used, the spinnerette included 30,500 capillaries having a diameter of 0.3 mm and a length of 1.5 mm. A 20 Kilowatt transformer having a maximum voltage of 7.5 volts, and a nominal voltage of 2 to 3 volts, with the secondary current being 34 times the primary current, was used for heating the spinnerette.

For examples wherein a band heater is used, the band heater was a CHROMALOX mica insulated band heater of 150 watts and 120 volts.

Further, quenching was achieved in the various examples using a nozzle to blow room temperature air at about 4,000–6,000 ft/min. Additionally, in Table I, Polymer A denotes linear isotactic polypropylene pellets having a melt flow rate of 18±2 dg/min obtained from Himont, Inc., Polymer B denotes linear isotactic polypropylene pellets having a melt flow rate of 9.5±2 dg/min obtained from Himont, Inc., Stabilizer denotes the antioxidant stabilizer Ultranox 626 obtained from the General Electric Co., PE denotes DOW 6811A polyethylene, and polyester was Barnette Southern recycled bottle chips.

TABLE I

| EXAMPLE NO. | HEATING CONDITIONS | POLYMER | MELT TEMPERATURE ° C. | SPIN SPEED meters/min. | RESULTS |
|---|---|---|---|---|---|
| 1 | Heated Plate<br>No Electrical<br>Current | Polymer A | 294 | 59 | No streak<br>Spinnerette Temp 231° C. |
| 2 | Heated Plate<br>No Electrical<br>Current | Polymer A | 303 | 59 | Spinnerette Temp 277° C.<br>Slight Streak<br>Spinnerette Temp Going<br>Down with Time |
| 3 | Heated Plate<br>Volt = 0.5<br>Current = 250A | Polymer A | 303 | 59 | Some Sign of Skin<br>Spinnerette 261° C. |
| 4 | Heated Plate<br>Volt = 1<br>Current = 100A | Polymer A | 269 | 59 | No Streak<br>Spinnerette Temp 259° C. |
| 5 | Heated Plate<br>Volt = .74<br>Current = 275A | Polymer A | 255 | 59 | Spinnerette Temp 220° C.<br>Streak Poor<br>Needed Continuous<br>Voltage Control Rather<br>Than Changing Tap to<br>Control Current |
| 6 | Heated Plate<br>No Current | Polymer A | 260 | 50 | No Streak |
| 7 | Heated Plate<br>Current = 160A | Polymer A | 264 | 50 | Plate Temp 196° C.<br>Spinnerette Temp 191° C.<br>No Streak |
| 8 | Heated Plate<br>Current = 200A | Polymer A | 267 | 50 | No Streak<br>Plate Temp 213° C.<br>Spinnerette Temp 206° C. |
| 9 | Heated Plate<br>Current = 240A | Polymer A | 270 | 50 | Plate Temp 229° C.<br>Spinnerette Temp 220° C.<br>Slight Streak |
| 10 | Heated Plate<br>Current = 260A | Polymer A | 273 | 50 | Plate Temp 242° C.<br>Spinnerette Temp 233° C.<br>No Streak |
| 11 | Heated Plate<br>Current = 280A | Polymer A | 274 | 50 | Plate Temp 249° C.<br>Spinnerette Temp 240° C.<br>Some Streak (Fair) |
| 12 | Heated Plate<br>Current = 300A | Polymer A | 268 | 50 | Plate Temp 252° C.<br>Spinnerette Temp 240° C.<br>No Streak<br>Nozzle Angle = 8° |
| 13 | Heated Plate<br>Current = 310A | Polymer A | 264 | 50 | Plate Temp 216° C.<br>Spinnerette Temp 210° C.<br>No Streak<br>Quench Jet Angle = 11° |
| 14 | Heated Plate<br>Current = 310A | Polymer A | 262 | 60 | Plate Temp 219° C.<br>Spinnerette Temp 222° C.<br>Some Sign of Streak<br>Quench Jet Angle = 16° |
| 15 | Heated Plate<br>Current = 320A | Polymer A | 266 | 60 | Plate Temp 220° C.<br>Spinnerette 233° C.<br>No Streak<br>Quench Jet Angle = 16° |

TABLE I-continued

| EXAMPLE NO. | HEATING CONDITIONS | POLYMER | MELT TEMPERATURE ° C. | SPIN SPEED meters/min. | RESULTS |
|---|---|---|---|---|---|
| 16 | Heated Plate Current = 330A | Polymer A | 267 | 60 | Plate Temp 231° C. Spinnerette Temp 233° C. Streak Poor Quench Jet Angle = 17° |
| 17 | Heated Plate Current = 340A | Polymer A | 264 | 60 | Plate Temp 220° C. Spinnerette Temp 221° C. No Streak Angle = 17° |
| 18 | Heated Plate Current = 350A | Polymer A | 262 | 60 | Plate Temp 219° C. Spinnerette Temp 219° C. No Streak |
| 19 | Heated Plate Current = 360A | Polymer A | 262 | 50 | Plate Temp 211° C. Spinnerette Temp 202° C. No Streak |
| 20 | Heated Plate Current 370A | Polymer A | 257 | 50 | Plate Temp 205° C. Spinnerette Temp 202° C. No Streak |
| 21 | Heated Plate Current = 380A | Polymer A | 256 | 50 | Plate Temp 208° C. Spinnerette Temp 205° C. No Streak |
| 22 | Heated Plate No Current | Polymer B Stabilizer | 295 | 50 | Plate Temp 197° C. Spinnerette Temp 179° C. No Streak Nozzle Angle = 0° |
| 23 | Heated Plate Current = 270A | Polymer B Stablizer | 303 | 50 | Plate Temp 275° C. Spinnerette Temp 254° C. Evidence of Streak |
| 24 | Heated Plate Current = 190A | Polymer B Stablizer | 303 | 50 | Plate Temp 290° C. Spinnerette Temp 233° C. No Streak |
| 25 | Heated Plate Current = 240A | Polymer B Stablizer | 303 | 50 | Plate Temp 300° C. Spinnerette Temp 245° C. Excellent Streak (Skin Core Evident) |
| 26 | Heated Plate Current = 260A | Polymer B Stablizer | 308 | 50 | Plate Temp 297° C. Spinnerette Temp 261° C. Sign of Streak |
| 27 | Heated Plate Current = 280A | Polymer B Stablizer | 305 | 50 | Plate Temp 309° C. Spinnerette Temp 260° C. |
| 28 | Heated Plate Current 300A | Polymer B Stablizer | 308 | 50 | Plate Temp 309° C. Spinnerette Temp 269° C. Sign of Skin Core |
| 29 | Heated Plate Current = 300A | Polymer B Stablizer | 290 | 50 | Plate Temp 300° C. Spinnerette Temp 261° C. Sign of Skin Core |
| 30 | Heated Plate Current = 320A | Polymer B Stablizer | 283 | 50 | Spinnerette Temp 258° C. Sign of Skin Core |
| 31 | Heated Plate Current = 320A | Polymer B Stablizer | 278 | 50 | Spinnerette Temp 257° C. No Streak |
| 32 | Heated Plate Current = 320A | Polymer B Stablizer | 270 | 50 | Spinnerette Temp 243° C. Sign of Streak |
| 33 | Heated Plate Current = 360A | Polymer B Stablizer | 265 | 50 | Spinnerette Temp 265° C. Evidence of Streak |
| 34 | Heated Plate No Current | Polymer B Stablizer | 299 | 50 | Spinnerette Temp 190° C. No Streak |
| 35 | Heated Plate No Current | Polymer B Stablizer | 280 | 50 | Spinnerette Temp 189° C. No Streak |
| 36 | Heated Plate Current 240A | Polymer B Stablizer | 278 | 50 | Spinnerette Temp 199° C. Sign of Streak |
| 37 | Heated Plate Current = 260A | Polymer B Stablizer | 281 | 50 | Spinnerette Temp 203° C. No Streak |
| 38 | Heated Plate Current = 280A | Polymer B Stablizer | 281 | 50 | Spinnerette Temp 190° C. No Streak |
| 39 | Heated Plate Current = 300A | Polymer B Stablizer | 273 | 50 | Spinnerette Temp 190° C. No Streak |
| 40 | Heated Plate Current = 320A | Polymer B Stablizer | 281 | 50 | Spinnerette Temp 201° C. No Streak |
| 41 | Heated Plate Current = 320A | Polymer B Stablizer | 270 | 50 | Spinnerette Temp 198° C. No Streak |
| 42 | Heated Plate Current = 340A | Polymer B Stablizer | 213 | 50 | Spinnerette Temp 213° C. No Streak |
| 43 | Heated Plate Current = 360A | Polymer B Stablizer | 283 | 50 | Spinnerette Temp 218° C. Sign of Streak |
| 44 | Heated Plate Current = 360A | Polymer B Stablizer | 282 | 50 | Spinnerette Temp 243° C. Sign of Streak |

TABLE I-continued

| EXAMPLE NO. | HEATING CONDITIONS | POLYMER | MELT TEMPERATURE ° C. | SPIN SPEED meters/min. | RESULTS |
|---|---|---|---|---|---|
| 45 | Heated Plate Current = 200A | Polymer B | 300 | 50 | Spinnerette Temp 189° C. No Streak Quench Nozzle Angle = 0° |
| 46 | Heated Plate Current = 240A | Polymer B | 296 | 50 | Spinnerette Temp 197° C. No Streak Quench Nozzle Angle = 7° |
| 47 | Heated Plate Current = 240A | Polymer B | 303 | 50 | Spinnerette Temp 225° C. Some Sign of Streak Nozzle Angle = 0° |
| 48 | Heated Plate Current = 300A | Polymer B | 303 | 50 | Spinnerette Temp 210° C. No Streak |
| 49 | Heated Plate Current 360A | Polymer B | 307 | 50 | Spinnerette Temp 242° C. Sign of Streak |
| 50 | Heated Plate Current = 0 | Polymer B | 301 | 50 | Spinnerette Temp 181° C. No Streak This Series Had Electrical Isolation Problem |
| 51 | Heated Plate Current = 200A | Polymer B | 295 | 50 | Spinnerette Temp 181° C. Hand Held |
| 52 | Heated Plate Current = 360A | Polymer B | 305 | 50 | No Spinnerette Temperature Thermocouple Broke Sign of Streak |
| 53 | Heated Plate Current = 360A | Polymer B | 279 | 50 | No Spinnerette Temp Thermocouple Broke No Streak |
| 54 | Heated Plate Current = 360A | Polymer B | 279 | 50 | No Spinnerette Temp Thermocouple Broke No Streak |
| 55 | Heated Plate Current = 250A | Polymer B | 286 | 50 | No Spinnerette Temp Thermocouple Broke No Streak |
| 56 | Heated Plate Current = 0 | Polymer B | 286 | 50 | Spinnerette Temp 192° C. No Streak New Thermocouple |
| 57 | Heated Plate Current = 240A | Polymer B | 290 | 50 | Spinnerette Temp 290° C. No Streak |
| 58 | Heated Plate Current = 260A | Polymer B | 284 | 50 | Spinnerette Temp 205° C. No Streak |
| 59 | Heated Plate Current = 320A | Polymer B | 280 | 50 | Spinnerette Temp 220° C. No Streak |
| 60 | Heated Plate Current = 360A | Polymer B | 280 | 50 | Spinnerette Temp 234° C. No Streak |
| 61 | Heated Plate Current = 380A | Polymer B | 282 | 50 | Spinnerette Temp 250° C. Sign of Streak |
| 62 | Heated Plate Current = 320A | Polymer B | 281 | 50 | Spinnerette Temp 233° C. Sign of Streak (Fair) |
| 63 | Heated Plate Current = 320A | Polymer B | 300 | 50 | Spinnerette Temp 247° C. No Streak |
| 64 | Heated Plate Current = 340A | Polymer B | 300 | 50 | Spinnerette Temp 255° C. Sign of Streak (Fair-to-Good) |
| 65 | Heated Plate Current = 360A | Polymer B | 302 | 50 | Spinnerette Temp 268° C. Sign of Streak (Fair-to-Good) |
| 66 | Heated Plate Current = 280A | Polymer B | 299 | 50 | Spinnerette Temp 230° C. No Streak |
| 67 | Heated Plate Current = 0 | Polymer B | 292 | 50 | Spinnerette Temp 194° C. No Streak |
| 68 | Directly heated Current = 0 Recessed Spinnerette | Polymer B | 297 | 50 | Spinnerette Temp 180° C. No Streak |
| 69 | Current = 240A Recessed Spinnerette | Polymer B | 297 | 50 | Spinnerette Temp 238° C. No Streak |
| 70 | Current = 260A Recessed Spinnerette | Polymer B | 299 | 50 | Spinnerette Temp 243° C. No Streak |
| 71 | Current = 280A Recessed Spinnerette | Polymer B | 303 | 50 | Spinnerette Temp 265° C. Sign of Streak (Fair) |

TABLE I-continued

| EXAMPLE NO. | HEATING CONDITIONS | POLYMER | MELT TEMPERATURE ° C. | SPIN SPEED meters/min. | RESULTS |
|---|---|---|---|---|---|
| 72 | Current = 300A Recessed Spinnerette | Polymer B | 304 | 50 | Spinnerette Temp 270° C. Sign of Streak (Fair) |
| 73 | Current = 320A Recessed Spinnerette | Polymer B | 303 | 50 | Spinnerette Temp 283° C. Sign of Streak (Good) |
| 74 | Current = 340A Recessed Spinnerette | Polymer B | 305 | 50 | Spinnerette Temp 295° C. Sign ot Streak (Very Good) |
| 75 | Current = 200A Recessed Spinnerette | Polymer B | 301 | 50 | Spinnerette Temp 220° C. No Streak |
| 76 | Heated Plate No Current Band Heater is Used | Polymer B | 289 | 100 | Plate Temp 215° C. Spinnerette Temp 215° C. No Streak |
| 77 | Heated Plate No Current | Polymer B | 295 | 100 | Plate Temp 265° C. Spinnerette Temp 257° C. No Streak |
| 78 | Heated Plate Heat On | Polymer B | 312 | 100 | Plate Temp 275° C. Spinnerette Temp 265° C. No Streak |
| 79 | Heated Plate Heat On | Polymer B | 310 | 100 | Plate Temp 280° C. Spinnerette Temp 271° C. No Streak |
| 80 | No Heat Heated Spinnerette by a Band Heater | Polymer B | 311 | 50 | Spinnerette Temp 215° C. No Streak |
| 81 | Heat On | Polymer B | 318 | 50 | Spinnerette Temp 260° C. Sign of Streak |
| 82 | Heat On | Polymer B | 318 | 100 | Could Not Spin for Some Reason |
| 83 | Heated Spinnerette Current = 0 | Polymer B | 301 | 100 | Spinnerette Temp 100° C. No Streak |
| 84 | Current = 200A | Polymer B | 303 | 100 | Spinnerette Temp 114° C. No Streak |
| 85 | Current = 240A | Polymer B | 294 | 100 | Spinnerette Temp 108° C. No Streak |
| 86 | Current = 260A | Polymer B | 295 | 100 | Spinnerette Temp 112° C. No Streak |
| 87 | Current = 280A | Polymer B | 297 | 100 | Spinnerette Temp 116° C. No Streak |
| 88 | Current = 300A | Polymer B | 298 | 100 | Spinnerette Temp 121° C. No Streak |
| 89 | Current = 340A | Polymer B | 298 | 100 | Spinnerette Temp 135° C. No Streak |
| 90 | Heated Spinnerette Primary Current = 18A | Polymer B | 260 | 33 | Spinnerette Temp 490° F. No Streaks |
| 91 | Heated Spinnerette Primary Current = 21A | Polymer B | 260 | 33 | Spinnerette Temp 491° F. No Streaks |
| 92 | Heated Spinnerette Primary Current = 27A | Polymer B | 260 | 33 | Spinnerette Temp 570° F. No Streaks |
| 93 | Heated Spinnerette Primary Current = 29A | Polymer B | 260 | 33 | Spinnerette Temp 519° F. No Streaks |
| 94 | Heated Spinnerette Primary Current = 35A | Polymer B | 260 | 33 | Spinnerette Temp 538° F. No Streaks |
| 95 | Heated Spinnerette Primary Current = 41A | Polymer B | 260 | 33 | Spinnerette Temp 557° F. No Streaks |

TABLE I-continued

| EXAMPLE NO. | HEATING CONDITIONS | POLYMER | MELT TEMPERATURE ° C. | SPIN SPEED meters/min. | RESULTS |
|---|---|---|---|---|---|
| 96 | Heated Spinnerette Primary Current = 41A | Polymer B | 260 | 33 | Spinnerette Temp 567° F. Sign of Streaks |
| 97 | Heated Spinnerette Primary Current = 45A | Polymer B | 260 | 33 | Spinnerette Temp 597° F. Signs of Streaks |
| 98 | Heated Spinnerette Primary Current = 12A | Polymer B | 270 | 33 | Spinnerette Temp 490° F. No Streaks |
| 99 | Heated Spinnerette Primary Current = 18A | Polymer B | 270 | 33 | Spinnerette Temp 510° F. No Streaks |
| 100 | Heated Spinnerette Primary Current = 21A | Polymer B | 270 | 33 | Spinnerette Temp 520° F. No Streaks |
| 101 | Heated Spinnerette Primary Current = 25A | Polymer B | 270 | 33 | Spinnerette Temp 530° F. No Streaks |
| 102 | Heated Spinnerette Primary Current = 27A | Polymer B | 270 | 33 | Spinnerette Temp 540° F. Sign of Streaks |
| 103 | Heated Spinnerette Primary Current = 28A | Polymer B | 270 | 33 | Spinnerette Temp 550° F. No Streaks |
| 104 | Heated Spinnerette Primary Current = 32A | Polymer B | 270 | 33 | Spinnerette Temp 560° F. No Streaks |
| 105 | Heated Spinnerette Primary Current = 36A | Polymer B | 270 | 33 | Spinnerette Temp 570° F. No Streaks |
| 106 | Heated Spinnerette Primary Current = 0 | Polymer B | 280 | 33 | Spinnerette Temp 490° F. No Streaks |
| 107 | Heated Spinnerette Primary Current = .08A | Polymer B | 280 | 33 | Spinnerette Temp 500° F. No Streaks |
| 108 | Heated Spinnerette Primary Current = .13A | Polymer B | 280 | 33 | Spinnerette Temp 510° F. No Streaks |
| 109 | Heated Spinnerette Primary Current = 16A | Polymer B | 280 | 33 | Spinnerette Temp 520° F. No Streaks |
| 110 | Heated Spinnerette Primary Current = 20A | Polymer B | 280 | 33 | Spinnerette Temp 530° F. Sign of Streaks |
| 111 | Heated Spinnerette Primary Current = 22A | Polymer B | 280 | 33 | Spinnerette Temp 540° F. No Streaks |
| 112 | Heated Spinnerette Primary Current = 25A | Polymer B | 280 | 33 | Spinnerette Temp 550° F. No Streaks |
| 113 | Heated Spinnerette Primary Current = 28A | Polymer B | 280 | 33 | Spinnerette Temp 560° F. Sign of Streaks |

TABLE I-continued

| EXAMPLE NO. | HEATING CONDITIONS | POLYMER | MELT TEMPERATURE ° C. | SPIN SPEED meters/min. | RESULTS |
|---|---|---|---|---|---|
| 114 | Heated Spinnerette Primary Current = 30A | Polymer B | 280 | 33 | Spinnerette Temp 570° F. Sign of Streaks |
| 115 | Spinnerette Primary Current = 9A | Polymer B | 290 | 33 | Spinnerette Temp 520° F. No Streaks |
| 116 | Heated Spinnerette Primary Current = 13A | Polymer B | 290 | 33 | Spinnerette Temp 530° F. No Streaks |
| 117 | Heated Spinnerette Primary Current = 18A | Polymer B | 290 | 33 | Spinnerette Temp 540° F. No Streak |
| 118 | Heated Spinnerette Primary Current = 13A | Polymer B | 250 | 33 | Spinnerette Temp 490° F. No Streaks |
| 119 | Heated Spinnerette Primary Current = 18A | Polymer B | 250 | 33 | Spinnerette Temp 500° F. No Streak |
| 120 | Heated Spinnerette Primary Current = 22A | Polymer B | 250 | 33 | Spinnerette Temp 510° F. No Streaks |
| 121 | Heated Spinnerette Primary Current = 26A | Polymer B | 250 | 33 | Spinnerette Temp 520° F. No Streak |
| 122 | Heated Spinnerette Primary Current = 30A | Polymer B | 250 | 33 | Spinnerette Temp 530° F. No Streaks |
| 123 | Heated Spinnerette Primary Current = 33A | Polymer B | 250 | 33 | Spinnerette Temp 540° F. No Streaks |
| 124 | Heated Spinnerette Primary Current = 36A | Polymer B | 250 | 33 | Spinnerette Temp 550° F. No Streaks |
| 125 | Heated Spinnerette Primary Current = 39A | Polymer B | 250 | 33 | Spinnerette Temp 560° F. Sign of Streaks |
| 126 | Heated Spinnerette Primary Current = 42A | Polymer B | 250 | 33 | Spinnerette Temp 570° F. No Streaks |
| 127 | Heated Spinnerette Primary Current = 20A | Polymer B | 240 | 33 | Spinnerette Temp 490° F. No Streaks |
| 128 | Heated Spinnerette Primary Current = 24A | Polymer B | 240 | 33 | Spinnerette Temp 500° F. No Streaks |
| 129 | Heated Spinnerette Primary Current = 25A | Polymer B | 240 | 33 | Spinnerette Temp 510° F. No Streaks |
| 130 | Heated Spinnerette Primary Current = 31A | Polymer B | 240 | 33 | Spinnerette Temp 520° F. No Streaks |
| 131 | Heated Spinnerette Primary Current = 34A | Polymer B | 240 | 33 | Spinnerette Temp 530° F. No Streaks |
| 132 | Heated Spinnerette Primary Current = 37A | Polymer B | 240 | 33 | Spinnerette Temp 540° F. No Streaks |

TABLE I-continued

| EXAMPLE NO. | HEATING CONDITIONS | POLYMER | MELT TEMPERATURE ° C. | SPIN SPEED meters/min. | RESULTS |
|---|---|---|---|---|---|
| 133 | Heated Spinnerette Primary Current = 40A | Polymer B | 240 | 33 | Spinnerette Temp 550° F. No Streaks |
| 134 | Heated Spinnerette Primary Current = 42A | Polymer B | 240 | 33 | Spinnerette Temp 560° F. No Streaks |
| 135 | Heated Spinnerette Primary Current = 44A | Polymer B | 240 | 33 | Spinnerette Temp 570° F. No Streaks |
| 136 | Heated Spinnerette Primary Current = 47A | Polymer B | 240 | 33 | Spinnerette Temp 580° F. Slight Streaks |
| 137 | Heated Spinnerette Primary Current = 53A | Polymer B | 240 | 33 | Spinnerette Temp 601° F. Slight Streaks (Fair-to-Good) |
| 138 | Heated Spinnerette Primary Current = 57A | Polymer B | 240 | 80 | Spinnerette Temp 606° F. Sign of Streaks |
| 139 | Heated Spinnerette Primary Current = 50A | Polymer B | 240 | 80 | Spinnerette Temp 591° F. No Streaks |
| 140 | Heated Spinnerette Primary Current = 54A | Polymer B | 240 | 80 | Spinnerette Temp 596° F. Sign of Streaks |
| 141 | Heated Spinnerette Primary Current = 55A | Polymer B | 240 | 80 | Spinnerette Temp 601° F. Sign of Streaks |
| 142 | Heated Spinnerette Primary Current = 51A | Polymer B | 250 | 80 | Spinnerette Temp 587° F. Signs of Streaks (Fair) |
| 143 | Heated Spinnerette Primary Current = 58A | Polymer B | 250 | 80 | Spinnerette Temp 592° F. Sign of Streaks (Good) |
| 144 | Heated Spinnerette Primary Current = 63A | Polymer B | 240 | 80 | Spinnerette Temp 600° F. Sign of Streaks (Fair) |
| 145 | Heated Spinnerette Primary Current = 0 | Polymer B | 260 | 66 | Spinnerette Temp 590° F. Sign of Streak (Fair) |
| 146 | Heated Spinnerette Primary Current = 42A | Polymer B | 260 | 66 | Spinnerette Temp 585° F. No Streaks |
| 147 | Heated Spinnerette Primary Current = 43A | Polymer B | 260 | 66 | Spinnerette Temp 580° F. No Streaks |
| 148 | Heated Spinnerette Primary Current = NA | Polymer B | 260 | 66 | Spinnerette Temp 575° F. Sign of Streaks |
| 149 | Heated Spinnerette Primary Current = 47A | Polymer B | 260 | 66 | Spinnerette Temp 595° F. No Streaks |
| 150 | Heated Spinnerette Primary Current = 47A | Polymer B | 260 | 66 | Spinnerette Temp 600° F. No Streaks Spin Bad, Too Hot |

TABLE I-continued

| EXAMPLE NO. | HEATING CONDITIONS | POLYMER | MELT TEMPERATURE ° C. | SPIN SPEED meters/min. | RESULTS |
|---|---|---|---|---|---|
| 151 | Heated Spinnerette Primary Current = 0 | Polymer B | 285 | 66 | Spinnerette Temp 504° F. No Streaks |
| 152 | Heated Spinnerette Primary Current = 18A | Polymer B | 285 | 66 | Spinnerette Temp 573° F. Sign of Streaks |
| 153 | Heated Spinnerette Primary Current = 25A | Polymer B | 285 | 66 | Spinnerette Temp 583° F. Sign of Streaks |
| 154 | Heated Spinnerette Primary Current = 25A | Polymer B | 285 | 66 | Spinnerette Temp 595° F. No Streaks |
| 155 | Heated Spinnerette Primary Current = 27A | Polymer B | 285 | 66 | Spinnerette Temp 601° F. Sign of Streaks |
| 156 | Heated Spinnerette Primary Current = 29A | Polymer B | 285 | 66 | Spinnerette Temp 610° F. No Streaks |
| 157 | Heated Spinnerette Primary Current = NA | Polymer B | 290 | 66 | Spinnerette Temp 519° F. No Streaks |
| 158 | Heated Spinnerette Primary Current = 20A | Polymer B | 290 | 66 | Spinnerette Temp 573° F. No Streaks |
| 159 | Heated Spinnerette Primary Current = 23A | Polymer B | 290 | 66 | Spinnerette Temp 582° F. No Streaks |
| 160 | Heated Spinnerette Primary Current = 25A | Polymer B | 290 | 66 | Spinnerette Temp 592° F. Sign of Streaks |
| 161 | Heated Spinnerette Primary Current = 28A | Polymer B | 290 | 66 | Spinnerette Temp 601° F. No Streaks |
| 162 | Heated Spinnerette Primary Current = 29A | Polymer B | 290 | 66 | Spinnerette Temp 610° F. Sign of Streaks |
| 163 | Heated Spinnerette Primary Current = NA | Polymer B | 295 | 66 | Spinnerette Temp 524° F. No Streaks |
| 164 | Heated Spinnerette Primary Current = 24A | Polymer B | 295 | 66 | Spinnerette Temp 574° F. No Streaks |
| 165 | Heated Spinnerette Primary Current = 27A | Polymer B | 295 | 66 | Spinnerette Temp 582° F. No Streaks |
| 166 | Heated Spinnerette Primary Current = 29A | Polymer B | 295 | 66 | Spinnerette Temp 592° F. No Streaks |
| 167 | Heated Spinnerette Primary Current = 32A | Polymer B | 295 | 66 | Spinnerette Temp 600° F. No Streaks |
| 168 | Heated Spinnerette Primary Current = 29A | Polymer B | 295 | 66 | Spinnerette Temp 610° F. Sign of Streaks |

TABLE I-continued

| EXAMPLE NO. | HEATING CONDITIONS | POLYMER | MELT TEMPERATURE ° C. | SPIN SPEED meters/min. | RESULTS |
|---|---|---|---|---|---|
| 169 | Heated Spinnerette Primary Current = 0 | Polymer B | 285 | 66 | Spinnerette Temp 500° F. No Streaks |
| 170 | Heated Spinnerette Primary Current = 22A | Polymer B | 285 | 66 | Spinnerette Temp 574° F. No Streaks |
| 171 | Heated Spinnerette Primary Current = 31A | Polymer B | 260 | 66 | Spinnerette Temp 581° F. No Streaks |
| 172 | Heated Spinnerette Primary Current = 31A | Polymer B | 260 | 66 | Spinnerette Temp 592° F. Sign of Streaks |
| 173 | Heated Spinnerette Primary Current = 33A | Polymer B | 260 | 66 | Spinnerette Temp 601° F. No Streaks |
| 174 | Heated Spinnerette Primary Current = 35A | Polymer B | 260 | 66 | Spinnerette Temp 610° F. No Streaks |
| 175 | Heated Spinnerette Primary Current = 0 | Polymer B | 265 | 66 | Spinnerette Temp 483° F. Sign of Streaks |
| 176 | Heated Spinnerette Primary Current = 26A | Polymer B | 265 | 66 | Spinnerette Temp 573° F. No Streaks |
| 177 | Heated Spinnerette Primary Current = 31A | Polymer B | 265 | 66 | Spinnerette Temp 583° F. Sign of Streak (Good) |
| 178 | Heated Spinnerette Primary Current = 32A | Polymer B | 265 | 66 | Spinnerette Temp 592° F. Sign of Streak (Good) |
| 179 | Heated Spinnerette Primary Current = 33A | Polymer B | 265 | 66 | Spinnerette Temp 601° F. Sign of Streaks (Fair) |
| 180 | Heated Spinnerette Primary Current = 34A | Polymer B | 265 | 66 | Spinnerette Temp 610° F. Sign of Streaks (Good) |
| 181 | Heated Spinnerette Primary Current = 0 | Polymer B | 270 | 66 | Spinnerette Temp 490° F. No Streaks |
| 182 | Heated Spinnerette Primary Current = 24A | Polymer B | 270 | 66 | Spinnerette Temp 573° F. No Streaks |
| 183 | Heated Spinnerette Primary Current = 27A | Polymer B | 270 | 66 | Spinnerette Temp 581° F. No Streaks |
| 184 | Heated Spinnerette Primary Current = 29A | Polymer B | 270 | 66 | Spinnerette Temp 592° F. No Streaks |
| 185 | Heated Spinnerette Primary Current = 31A | Polymer B | 270 | 66 | Spinnerette Temp 601° F. No Streaks |
| 186 | Heated Spinnerette Primary Current = 32A | Polymer B | 270 | 66 | Spinnerette Temp 610° F. Sign of Streaks (Fair) |

TABLE I-continued

| EXAMPLE NO. | HEATING CONDITIONS | POLYMER | MELT TEMPERATURE ° C. | SPIN SPEED meters/min. | RESULTS |
|---|---|---|---|---|---|
| 187 | Heated Spinnerette Primary Current = 0 | Polymer B | 300 | 66 | |
| 188 | Recessed Spinnerette Current = 0 | Polymer B | 295 | 50 | Spinnerette Temp 204° C. No Streak |
| 189 | Recessed Spinnerette Current = 260A | Polymer B | 282 | 50 | Spinnerette Temp 299° C. Sign of Streak |
| 190 | Recessed Spinnerette Current = 260A | Polymer B | 241 | 50 | Spinnerette Temp 266° C. No Streaks |
| 191 | Recessed Spinnerette Current = 280A | Polymer B | 241 | 50 | Spinnerette Temp 283° C. No Streaks |
| 192 | Recessed Spinnerette Current = 330A | Polymer B | 239 | 50 | Spinnerette Temp 295° C. No Streaks |
| 193 | Recessed Spinnerette Current = 320A | Polymer B | 260 | 50 | Spinnerette Temp 295° C. No Streaks |
| 194 | Recessed Spinnerette Current = 340A | Polymer B | 260 | 50 | Spinnerette Temp 307° C. No Streaks |
| 195 | Recessed Spinnerette Current = 370A | Polymer B | 258 | 50 | Spinnerette Temp 319° C. Sign of Streaks (Poor) |
| 196 | Recessed Spinnerette Current = 400A | Polymer B | 260 | 50 | Spinnerette Temp 349° C. Sign of Streaks (Good) |
| 197 | Standard Spinnerette Current = 0 | Polymer B | 260 | 50 | Spinnerette Temp 211° C. Sign of Streaks |
| 198 | Standard Spinnerette Current = 0 | Polymer B | 280 | 50 | Spinnerette Temp 229° C. No Streaks |
| 199 | Standard Spinnerette Current = 300A | Polymer B | 264 | 50 | Spinnerette Temp 311° C. Slight Streak (Fair) |
| 200 | Standard Spinnerette Current = 330A | Polymer B | 263 | 50 | Spinnerette Temp 326° C. Sign of Streak |
| 201 | Standard Spinnerette Current = 385A | Polymer B | 263 | 50 | Spinnerette Temp 330° C. Sign of Streaks (Good) |
| 202 | Standard Spinnerette Current = 405A | Polymer B | 262 | 50 | Spinnerette Temp 353° C. Slight Streak |
| 203 | Heated Spinnerette Current = 49A | Polymer B | 250 | 66 | Spinnerette Temp 544° F. |
| 204 | Heated Spinnerette Current = 55A | Polymer B | 250 | 66 | Spinnerette Temp 552° F. |
| 205 | Heated Spinnerette Current = 37A | Polymer B | 250 | 66 | Spinnerette Temp 572° F. |
| 206 | Heated Spinnerette Current = 18.6A | Polymer B | 258 | 65 | Spinnerette Temp 572° F. No Picture New Spinnerette Design Requires Lower Current |
| 207 | Heated Spinnerette Current = 18.6A | Polymer B | 259 | 65 | Spinnerette Temp 572° F. No Picture |
| 208 | Heated Spinnerette Current = 18.4A | Polymer B | 259 | 65 | Spinnerette Temp 572° F. No Picture |
| 209 | Heated Spinnerette Current = 18A | Polymer B | 259 | 66 | Spinnerette Temp 572° F. No Picture |
| 210 | Heated Spinnerette Current = 19.2A | Polymer B | 259 | 66 | Spinnerette Temp 572° F. No Picture |

TABLE I-continued

| EXAMPLE NO. | HEATING CONDITIONS | POLYMER | MELT TEMPERATURE ° C. | SPIN SPEED meters/min. | RESULTS |
|---|---|---|---|---|---|
| 211 | Heated Spinnerette Current = 19A | Polymer B | 259 | 66 | Spinnerette Temp 572° F. No Picture |
| 212 | Heated Spinnerette Current = 19.2A | Polymer B | 259 | 66 | Spinnerette Temp 572° F. No Picture |
| 213 | Heated Spinnerette Current = 19.4A | Polymer B | 259 | 66 | Spinnerette Temp 572° F. No Picture |
| 214 | Heated Spinnerette Current = 19.6A | Polymer B | 259 | 66 | Spinnerette Temp 572° F. Sign of Streak |
| 215 | Heated Spinnerette Current = 20.8A | Polymer B | 259 | 66 | Spinnerette Temp 572° F. No Streaks |
| 216 | Heated Spinnerette Current = 20.8A | Polymer B | 259 | 66 | Spinnerette Temp 572° F. No Picture |
| 217 | Heated Spinnerette Current = 21A | Polymer B | 259 | 66 | Spinnerette Temp 572° F. No Picture |
| 218 | Heated Spinnerette Current = 21A | Polymer B | 259 | 66 | Spinnerette Temp 572° F. No Picture |
| 219 | Heated Spinnerette Current = 21.3A | Polymer B | 259 | 66 | Spinnerette Temp 572° F. No Picture |
| 220 | Heated Spinnerette Current = 21.7A | Polymer B | 259 | 66 | Spinnerette Temp 572° F. No Picture |
| 221 | Heated Spinnerette Current = 21.8A | Polymer B | 259 | 66 | Spinnerette Temp 572° F. No Picture |
| 222 | Heated Spinnerette Current = 22.5A | Polymer B | 259 | 66 | Spinnerette Temp 572° F. No Picture |
| 223 | Heated Spinnerette Current = 22.5A | Polymer B | 250 | 66 | Spinnerette Temp 572° F. No Streaks |
| 224 | Heated Spinnerette Current = 23.1A | Polymer B | 250 | 66 | Spinnerette Temp 572° F. No Streaks |
| 225 | Heated Spinnerette Current = 23.5A | Polymer B | 260 | 66 | Spinnerette Temp 572° F. No Picture |
| 226 | Heated Spinnerette Current = 23.8A | Polymer B | 259 | 66 | Spinnerette Temp 572° F. No Picture |
| 227 | Heated Spinnerette Current = 24.3A | Polymer B | 259 | 66 | Spinnerette Temp 572° F. No Picture |
| 228 | Heated Spinnerette Current = 24.6A | Polymer B | 259 | 66 | Spinnerette Temp 572° F. No Picture |
| 229 | Heated Spinnerette Current = 24.9A | Polymer B | 259 | 66 | Spinnerette Temp 572° F. No Picture |
| 230 | Heated Spinnerette Current = 25.1A | Polymer B | 259 | 66 | Spinnerette Temp 572° F. No Picture |
| 231 | Heated Spinnerette Current = 24.4A | Polymer B | 259 | 66 | Spinnerette Temp 572° F. No Pictures |
| 232 | Heated Spinnerette Current = 23.3A | Polymer B | 275 | 66 | Spinnerette Temp 572° F. Some Sign of Streak |
| 233 | Heated Spinnerette Current = 23.7A | Polymer B | 264 | 66 | Spinnerette Temp 572° F. Some Sign of Streaks |
| 234 | Heated Spinnerette Current = 24.1A | Polymer B | 267 | 66 | Spinnerette Temp 572° F. No Pictures |
| 235 | Heated Spinnerette Current = 24.3A | Polymer B | 267 | 66 | Spinnerette Temp 572° F. No Picture |

TABLE I-continued

| EXAMPLE NO. | HEATING CONDITIONS | POLYMER | MELT TEMPERATURE ° C. | SPIN SPEED meters/min. | RESULTS |
|---|---|---|---|---|---|
| 236 | Heated Spinnerette Current = 25.6A | Polymer B | 267 | 66 | Spinnerette Temp 572° F. No Picture |
| 237 | Heated Spinnerette Current = 24.6A | Polymer B | 267 | 66 | Spinnerette Temp 572° F. No Picture |
| 238 | Heated Spinnerette Current = 25.2A | Polymer B | 266 | 66 | Spinnerette Temp 572° F. No Pictures |
| 239 | Heated Spinnerette Current = 25.4A | Polymer B | 266 | 66 | Spinnerette Temp 572° F. No Streaks |
| 240 | Heated Spinnerette Current = 25A | Polymer B | 266 | 66 | Spinnerette Temp 572° F. No Pictures |
| 241 | Heated Spinnerette Current = 23A | Polymer B | 267 | 66 | Spinnerette Temp 572° F. No Pictures |
| 242 | Heated Spinnerette Current = 22.8A | Polymer B | 268 | 66 | Spinnerette Temp 572° F. No Pictures |
| 243 | Heated Spinnerette Current = 22.4A | Polymer B | 269 | 66 | Spinnerette Temp 572° F. No Pictures |
| 244 | Heated Spinnerette Current = 25.2A | Polymer B | 268 | 66 | Spinnerette Temp 315° C. Sign of Streak |
| 245 | Heated Spinnerette Current = 24A | Polymer B | 269 | 66 | Spinnerette Temp 316° C. Sign of Streak (Fair) |
| 246 | Heated Spinnerette Current = 24A | Polymer B | 268 | 66 | Spinnerette Temp 312° C. Sign of Streak (Poor) |
| 247 | Heated Spinnerette Current = 23.9 | Polymer B | 268 | 66 | Spinnerette Temp 311° C. Sign of Streak (Poor) |
| 248 | Heated Spinnerette Current = 23.4A | Polymer B | 268 | 66 | Spinnerette Temp 315° C. No Streaks |
| 249 | Heated Spinnerette Current = 23A | Polymer B | 268 | 66 | Spinnerette Temp 311° C. No Pictures |
| 250 | Heated Spinnerette Current = 23.3A | Polymer B | 268 | 66 | Spinnerette Temp 312° C. Sign of Streaks (Fair) |
| 251 | Heated Spinnerette Current = 22.6A | Polymer B | 269 | 66 | Spinnerette Temp 310° C. Sign of Streak (Good) |
| 252 | Heated Spinnerette Current = 26.9A | Polymer B | 269 | 66 | Spinnerette Temp 330° C. Sign of Streaks (Fair-to-Good) |
| 253 | Heated Spinnerette Current = 26.6A | Polymer B | 269 | 66 | Spinnerette Temp 330° C. Sign of Streaks (Fair to Good) |
| 254 | Heated Spinnerette Current = 26.3A | Polymer B | 268 | 66 | Spinnerette Temp 330° C. Sign of Streaks (Good) |
| 255 | Heated Spinnerette Current = 26.2A | Polymer B | 268 | 66 | Spinnerette Temp 328° C. No Streaks |
| 256 | Heated Spinnerette Current = 25.6A | Polymer B | 268 | 66 | Spinnerette Temp 328° C. Sign of Streaks (Good) |
| 257 | Heated Spinnerette Current = 25.6A | Polymer B | 268 | 66 | Spinnerette Temp 329° C. Sign of Streaks (Good) |
| 258 | Heated Spinnerette Current = 25.7A | Polymer B | 269 | 66 | Spinnerette Temp 329° C. Sign of Streaks (Fair) |
| 259 | Heated Spinnerette Current = 25.1A | Polymer B | 268 | 66 | Spinnerette Temp 329° C. Sign of Streaks (Fair) |
| 260 | Heated Spinnerette Current = 25A | Polymer B | 269 | 66 | Spinnerette Temp 329° C. Sign of Streaks (Fair) |

TABLE I-continued

| EXAMPLE NO. | HEATING CONDITIONS | POLYMER | MELT TEMPERATURE ° C. | SPIN SPEED meters/min. | RESULTS |
|---|---|---|---|---|---|
| 261 | Heated Spinnerette Current = 25A | Polymer B | 269 | 66 | Spinnerette Temp 329° C. Sign of Streaks (Fair) |
| 262 | Heated Spinnerette Current = 28A | Polymer B | 270 | 66 | Spinnerette Temp 620° F. Sign of Streaks (Fair) |
| 263 | Heated Spinnerette Current = 24.4A | Polymer B | 269 | 66 | Spinnerette Temp 603° F. Sign of Streaks (Fair) |
| 264 | Heated Spinnerette Current = 23.1A | Polymer B | 269 | 66 | Spinnerette Temp 603° F. No Pictures |
| 265 | Heated Spinnerette Current = 26.9A | Polymer B | 277 | 66 | Spinnerette Temp 626° F. Sign of Streaks (Fair) |
| 266 | Heated Spinnerette Current = 28A | Polymer B | 277 | 66 | Spinnerette Temp 626° F. No Pictures |
| 267 | Heated Spinnerette Current = 28A | Polymer B | 277 | 66 | Spinnerette Temp 626° F. No Pictures |
| 268 | Heated Spinnerette Current = 25.7A | Polymer B | 260 | 66 | Spinnerette Temp 603° F. No Streaks |
| 269 | Heated Spinnerette Current = 28.1A | Polymer B | 259 | 66 | Spinnerette Temp 626° F. No Pictures |
| 270 | Heated Spinnerette Current = 30.6A | Polymer B | 259 | 66 | Spinnerette Temp 644° F. Sign of Streaks (Fair) |
| 271 | Heated Spinnerette Current = 30.6A | Polymer B | 259 | 66 | Spinnerette Temp 644° F. No Picture |
| 272 | Heated Spinnerette Current = 30.8A | Polymer B | 259 | 66 | Spinnerette Temp 644° F. No Picture |
| 273 | Heated Spinnerette Current = 31.1A | Polymer B | 259 | 66 | Spinnerette Temp 644° F. No Picture |
| 274 | Heated Spinnerette Current = 31.3A | Polymer B | 259 | 66 | Spinnerette Temp 644° F. No Picture |
| 275 | Heated Spinnerette Current = 31.6A | Polymer B | 259 | 66 | Spinnerette Temp 644° F. No Picture |
| 276 | Heated Spinnerette Current = 32.3A | Polymer B | 259 | 66 | Spinnerette Temp 644° F. No Picture |
| 277 | Heated Spinnerette Current = 32.4A | Polymer B | 259 | 66 | Spinnerette Temp 644° F. No Picture |
| 278 | Heated Spinnerette Current = 32.3A | Polymer B | 259 | 66 | Spinnerette Temp 644° F. No Picture |
| 279 | Heated Spinnerette Current = 32.7A | Polymer B | 259 | 66 | Spinnerette Temp 644° F. No Picture |
| 280 | Heated Spinnerette Current = 33A | Polymer B | 258 | 66 | Spinnerette Temp 644° F. No Picture |
| 281 | Heated Spinnerette Current = 32A | Polymer B | 249 | 66 | Spinnerette Temp 644° F. No Picture |
| 282 | Heated Spinnerette Current = 32.5A | Polymer B | 249 | 66 | Spinnerette Temp 642° F. No Picture |
| 283 | Heated Spinnerette Current = 32.7A | Polymer B | 240 | 66 | Spinnerette Temp 642° F. No Picture |
| 284 | Heated Spinnerette Current = 35.5A | Polymer B | 240 | 66 | Spinnerette Temp 642° F. No Picture |
| 285 | Heated Spinnerette Current = 35.6A | Polymer B | 240 | 66 | Spinnerette Temp 642° F. No Picture |

TABLE I-continued

| EXAMPLE NO. | HEATING CONDITIONS | POLYMER | MELT TEMPERATURE ° C. | SPIN SPEED meters/min. | RESULTS |
|---|---|---|---|---|---|
| 286 | Heated Spinnerette Current = 35.3A | Polymer B | 250 | 66 | Spinnerette Temp 642° F. No Picture |
| 287 | Heated Spinnerette Current = 35.2A | Polymer B | 250 | 66 | Spinnerette Temp 642° F. No Picture |
| 288 | Heated Spinnerette Current = 33.7A | Polymer B | 249 | 66 | Spinnerette Temp 642° F. No Picture |
| 289 | Heated Spinnerette Current = 33.8A | Polymer B | 250 | 66 | Spinnerette Temp 642° F. No Picture |
| 290 | Heated Spinnerette Current = 34.4A | Polymer B | 249 | 66 | Spinnerette Temp 642° F. No Picture |
| 291 | Heated Spinnerette Current = 35.1A | Polymer B | 250 | 66 | Spinnerette Temp 642° F. No Picture |
| 292 | Heated Spinnerette Current = 29.5A | Polymer B | 237 | 66 | Spinnerette Temp 642° F. No Picture |
| 293 | Heated Spinnerette Current = 29.5A | Polymer B | 237 | 66 | Spinnerette Temp 642° F. No Picture |
| 294 | Heated Spinnerette Current = 29.8A | Polymer B | 237 | 66 | Spinnerette Temp 642° F. No Picture |
| 295 | Heated Spinnerette Current = 29.8A | Polymer B | 238 | 66 | Spinnerette Temp 642° F. Sign of Streak (Fair) |
| 296 | Heated Spinnerette Current = 32.4A | Polymer B | 240 | 66 | Spinnerette Temp 642° F. No Picture |
| 297 | Heated Spinnerette Current = 30.1A | Polymer B | 240 | 66 | Spinnerette Temp 642° F. No Picture |
| 298 | Heated Spinnerette Current = 30.4A | Polymer B | 240 | 66 | Spinnerette Temp 642° F. No Picture |
| 299 | Heated Spinnerette Current = 30.5A | Polymer B | 239 | 66 | Spinnerette Temp 642° F. No Picture |
| 300 | Heated Spinnerette Current = 30.9A | Polymer B | 239 | 66 | Spinnerette Temp 642° F. No Picture |
| 301 | Heated Spinnerette Current = 31.1A | Polymer B | 239 | 66 | Spinnerette Temp 642° F. No Picture |
| 302 | Heated Spinnerette Current = 31.7A | Polymer B | 239 | 66 | Spinnerette Temp 642° F. No Picture |
| 303 | Heated Spinnerette Current = 31.1A | Polymer B | 239 | 66 | Spinnerette Temp 642° F. No Picture |
| 304 | Heated Spinnerette Current = 33.3A | Polymer B | 239 | 66 | Spinnerette Temp 660° F. No Picture |
| 305 | Heated Spinnerette Current = 33.3A | Polymer B | 239 | 66 | Spinnerette Temp 660° F. No Picture |
| 306 | Heated Spinnerette Current = 33.5A | Polymer B | 239 | 66 | Spinnerette Temp 660° F. No Picture |
| 307 | Heated Spinnerette Current = 34A | Polymer B | 239 | 66 | Spinnerette Temp 660° F. No Picture |
| 308 | Heated Spinnerette Current = 33.8A | Polymer B | 239 | 66 | Spinnerette Temp 660° F. No Picture |
| 309 | Heated Spinnerette Current = 34.3A | Polymer B | 239 | 66 | Spinnerette Temp 660° F. No Picture |
| 310 | Heated Spinnerette Current = 33.9A | Polymer B | 239 | 66 | Spinnerette Temp 660° F. No Picture |

TABLE I-continued

| EXAMPLE NO. | HEATING CONDITIONS | POLYMER | MELT TEMPERATURE ° C. | SPIN SPEED meters/min. | RESULTS |
|---|---|---|---|---|---|
| 311 | Heated Spinnerette Current = 34.5 | Polymer B | 239 | 66 | Spinnerette Temp 660° F. No Picture |
| 312 | Heated Spinnerette Current = 24.6A | Polymer B | 239 | 66 | Spinnerette Temp 660° F. No Picture |
| 313 | Heated Spinnerette Current = 34.8A | Polymer B | 239 | 66 | Spinnerette Temp 660° F. No Picture |
| 314 | Heated Spinnerette Current = 299A | Polymer B Ni Octoate 700 ppm | 290 | 100 | Spinnerette Temp 300° C. Excellent Streaks |
| 315 | Heated Spinnerette Current = 334A | Polymer B Ni Octoate 700 ppm | 289 | 100 | Spinnerette Temp 330° C. Excellent Streaks |
| 316 | Heated Spinnerette Current = 358A | Polymer B Ni Octoate 700 ppm | 290 | 100 | Spinnerette Temp 350° C. Excellent Streaks |
| 317 | Heated Spinnerette Current = 358A | Polymer B Ni Octoate 700 ppm | 270 | 100 | Spinnerette Temp 300° C. Excellent Streaks |
| 318 | Heated Spinnerette Current = 345A | Polymer B Ni Octoate 700 ppm | 270 | 100 | Spinnerette Temp 330° C. Excellent Streaks |
| 319 | Heated Spinnerette Current = 362A | Polymer B Ni Octoate 700 ppm | 270 | 100 | Spinnerette Temp 350° C. Excellent Streaks |
| 320 | Heated Spinnerette Current = 327A | 80% Polymer A 20% PE | 270 | 100 | Spinnerette Temp 300° C. Excellent Streaks |
| 321 | Heated Spinnerette Current = 351A | 80% Polymer A 20% PE | 270 | 100 | Spinnerette Temp 320° C. Excellent Streaks |
| 322 | Heated Spinnerette Current = 347A | 80% Polymer A 20% PE | 255 | 100 | Spinnerette Temp 300° C. Excellent Streaks |
| 323 | Heated Spinnerette Current = 361A | 80% Polymer A 20% PE | 258 | 100 | Spinnerette Temp 320° C. Excellent Streaks |
| 324 | Heated Spinnerette Current = 369A | 80% Polymer A 20% PE | 250 | 100 | Spinnerette Temp 330° C. Excellent Streaks |
| 325 | Heated Spinnerette Current = 337A | 90% Polymer A 10% Polyester | 270 | 100 | Spinnerette Temp 300° C. Excellent Streaks |
| 326 | Heated Spinnerette Current = 358A | Polymer A 10% Polyester | 270 | 100 | Spinnerette Temp 330° C. Excellent Streaks |
| 327 | Heated Spinnerette Current = 355A | Polymer A 10% Polyester | 250 | 100 | Spinnerette Temp 315° C. Excellent Streaks |
| 328 | Heated Spinnerette Current = 350A | Polymer A 10% Polyester | 250 | 100 | Spinnerette Temp 310° C. Excellent Streaks |
| 329 | Heated Spinnerette Current = 331A | Polymer A 10% Polyester | 270 | 100 | Spinnerette Temp 300° C. Excellent Streaks |
| 330 | Heated Spinnerette Current = 337A | Polymer A 10% Polyester | 248 | 100 | Spinnerette Temp 300° C. Excellent Streaks |
| 331 | Heated Spinnerette Current = 351A | Polymer A 10% Polyester | 250 | 100 | Spinnerette Temp 320° C. Excellent Streaks |

We claim:

1. Apparatus for spinning polymer filaments, comprising:

at least one spinnerette structured and arranged to be directly and substantially uniformly heated by resistance or impedance of the at least one spinnerette;

a feeding mechanism effecting extrusion of polymer composition through said at least one spinnerette to extrude molten filaments; and a quenching system positioned to immediately quench molten filaments of extruded polymer in an oxidative atmosphere, as the molten filaments exit said at least one spinnerette, to effect oxidative chain scission degradation of at least a surface of the molten filaments to obtain filaments having a skin-core structure.

2. Apparatus for spinning polymer filaments, comprising:

at least one spinnerette;

means for feeding polymer composition through said at least one spinnerette to extrude molten filaments;

means for directly and substantially uniformly heating by resistance or impedance said at least one spinnerette to a temperature of at least about 230° C.; and means for quenching molten filaments of extruded polymer in an oxidative atmosphere, as the molten filaments exit said at least one spinnerette, to effect oxidative chain scission degradation of at least a surface of the molten filaments to obtain filaments having a skin-core structure.

3. Apparatus for spinning polymer filaments, comprising:

at least one spinnerette;

means for feeding polymer composition through said at least one spinnerette to extrude molten filaments;

at least one apertured element positioned upstream of said at least one spinnerette;

means for substantially uniformly heating said at least one apertured element to a temperature of at least about 250° C.; and means for quenching molten filaments of extruded polymer in an oxidative atmosphere, as the molten filaments exit said at least one spinnerette, to effect oxidative chain scission degradation of at least a surface of the molten filaments to obtain filaments having a skin-core structure.

4. The apparatus according to claim 3, wherein said at least one apertured element is positioned about 1 to 4 mm upstream of said at least one spinnerette.

5. The apparatus according to claim 4, wherein said at least one apertured element comprises at least one apertured plate.

6. Apparatus for spinning polymer filaments, comprising:

at least one spinnerette;

means for feeding polymer composition to said at least one spinnerette to obtain a spinning speed of about 10 to 200 meters per minute through said at least one spinnerette to extrude molten filaments;

means for substantially uniformly heating said at least one spinnerette to obtain sufficient heating of the polymer composition to obtain a skin-core filament structure upon quenching in an oxidative atmosphere; and means for immediately quenching molten filaments of extruded polymer in an oxidative atmosphere, as the molten filaments exit said at least one spinnerette, so as to effect oxidative chain scission degradation of at least a surface of the molten filaments.

7. The apparatus according to claim 6, wherein said means for heating comprise elements for substantially uniformly heating said at least one spinnerette to a temperature of at least about 230° C.

8. The apparatus according to claim 7, wherein said means for heating comprise elements for substantially uniformly heating said at least one spinnerette to a temperature of at least about 250° C.

9. The apparatus according to claim 6, wherein said means for heating comprise elements for substantially uniformly heating said at least one spinnerette to a temperature of about 230° C. to 370° C.

10. The apparatus according to claim 8, wherein said at least one spinnerette comprises about 500 to 150,000 capillaries.

11. The apparatus according to claim 6, wherein said at least one spinnerette comprises about 500 to 150,000 capillaries.

12. The apparatus according to claim 11, wherein said at least one spinnerette comprises about 30,000 to 120,000 capillaries.

13. The apparatus according to claim 12, wherein said at least one spinnerette comprises about 30,000 to 70,000 capillaries.

14. The apparatus according to claim 13, wherein said at least one spinnerette comprises about 30,000 to 45,000 capillaries.

15. The apparatus according to claim 11, wherein said at least one spinnerette comprises capillaries having a cross-sectional area of about 0.02 to 0.2 $mm^2$, and a length of about 1 to 20 mm.

16. The apparatus according to claim 15, wherein said capillaries have a recess at a lower portion.

17. The apparatus according to claim 16, wherein said recess has a cross-sectional area of about 0.05 to 0.4 $mm^2$, and a length about 0.25 mm to 2.5 mm.

18. The apparatus according to claim 17, wherein said recess has a cross-sectional area of about 0.3 $mm^2$ and a length of about 0.5 mm.

19. The apparatus according to claim 15, wherein said at least one spinnerette comprises capillaries having a cross-sectional area of about 0.07 $mm^2$, and a length of about 1 to 5 mm.

20. The apparatus according to claim 19, wherein said at least one spinnerette comprises capillaries having a length of about 1.5 mm.

21. The apparatus according to claim 11, wherein said at least one spinnerette comprises capillaries having a tapered portion.

22. The apparatus according to claim 21, wherein said at least one spinnerette comprises countersunk capillaries having a total length of about 3 to 20 mm; a first cross-sectional area of about 0.03 $mm^2$ to 0.2 $mm^2$ at a lower portion; a maximum cross-sectional area at a surface of said at least one spinnerette of about 0.07 $mm^2$ to 0.5 $mm^2$; and said countersunk capillaries taper from said maximum cross-sectional area to said first cross-sectional area at an angle of about 20° to 60°.

23. The apparatus according to claim 22, wherein said countersunk capillaries taper from said maximum cross-sectional area to said first cross-sectional area at an angle of about 35° to 45°.

24. The apparatus according to claim 23, wherein said countersunk capillaries taper from said maximum cross-sectional area to said first cross-sectional area at an angle of about 45°.

25. The apparatus according to claim 22, wherein said countersunk capillaries have a total length of about 7–10 mm.

26. The apparatus according to claim 25, wherein said countersunk capillaries have a maximum cross-sectional area of about 0.2 $mm^2$.

27. The apparatus according to claim 26, wherein said countersunk capillaries include a distance between said maximum cross-sectional area to said first cross-sectional area of about 0.15 to 0.4 $mm^2$.

28. The apparatus according to claim 21, wherein said at least one spinnerette comprises counterbored, countersunk capillaries.

29. The apparatus according to claim 28, wherein said counterbored, countersunk capillaries comprise an upper tapered portion having a diameter of about 0.6 mm and a length of about 0.5 mm; an upper capillary having a diameter of about 0.5 mm and a length of about 3.5 mm; a middle tapered portion having a length of about 0.1 mm; and a lower capillary having a diameter of about 0.35 mm and a length of about 1.5 mm.

30. The apparatus according to claim 21, wherein said at least one spinnerette comprises counterbored capillaries.

31. The apparatus according to claim 30, wherein said counterbored capillaries comprise an upper capillary having a diameter of about 0.5 mm and a length of about 4 mm; a middle tapered portion having a length of about 0.1 mm; and a lower capillary having a diameter of about 0.35 mm and a length of about 2 mm.

32. Apparatus for spinning polymer filaments comprising:

at least one spinnerette;

means for feeding polymer composition to said at least one spinnerette to obtain a spinning speed of about 10 to 200 meters per minute through said at least one spinnerette to extrude molten filaments;

at least one heated apertured plate positioned upstream and in the vicinity of said at least one spinnerette; and means for immediately quenching molten filaments of extruded polymer in an oxidative atmosphere, as the molten filaments exit said at least one spinnerette, so as to effect oxidative chain scission degradation of at least a surface of the molten filaments.

33. The apparatus according to claim 32, wherein said means for heating comprise elements for heating said at least one heated apertured plate to a temperature of at least about 250° C.

34. The apparatus according to claim 33, wherein said means for heating comprise elements for heating said at least one heated apertured plate to a temperature of about 250° C. to 370° C.

35. The apparatus according to claim 34, wherein said means for heating comprise elements for heating said at least one heated apertured plate to a temperature of about 280° C. to 350° C.

36. The apparatus according to claim 35, wherein said means for heating comprise elements for heating said at least one heated apertured plate to a temperature of about 300° C. to 350° C.

37. The apparatus according to claim 32, wherein said at least one heated apertured plate is positioned about 1 to 4 mm upstream of said at least one spinnerette.

38. The apparatus according to claim 37, wherein said at least one heated apertured plate is positioned about 2 to 3 mm upstream of said at least one spinnerette.

39. The apparatus according to claim 38, wherein said at least one heated apertured plate is positioned about 2.5 mm upstream of said at least one spinnerette.

40. The apparatus according to claim 32, wherein said at least one heated apertured plate and said at least one spinnerette comprise a corresponding number of capillaries and pattern.

41. The apparatus according to claim 32, wherein said at least one heated apertured plate and said at least one spinnerette comprise a different number of capillaries.

42. The apparatus according to claim 33, wherein said at least one heated apertured plate and said at least one spinnerette comprise a different pattern.

43. The apparatus according to claim 40, wherein capillaries in said at least one heated apertured plate comprise a cross-sectional area that is up to about 30% larger than a cross-sectional area of capillaries in said at least one spinnerette.

44. The apparatus according to claim 43, wherein said capillaries in said heated apertured plate comprise a cross-sectional area of about 0.03 $mm^2$ to 0.3 $mm^2$.

45. The apparatus according to claim 44, wherein said capillaries in said heated apertured plate comprise a cross-sectional area of about 0.1 $mm^2$.

46. The apparatus according to claim 40, wherein said at least one spinnerette and said at least one heated apertured plate each comprise about 500 to 150,000 capillaries.

47. The apparatus according to claim 46, wherein said at least one spinnerette and said at least one heated apertured plate each comprise about 30,000 to 120,000 capillaries.

48. The apparatus according to claim 47, wherein said at least one spinnerette and said at least one heated apertured plate each comprise about 30,000 to 70,000 capillaries.

49. The apparatus according to claim 48, wherein said at least one spinnerette and said at least one heated apertured plate each comprise about 30,000 to 45,000 capillaries.

50. The apparatus according to claim 40, wherein said at least one spinnerette and said at least one heated apertured plate comprise capillaries having a cross-sectional area of about 0.03 $mm^2$ to 0.3 $mm^2$, and a length of about 1 to 5 mm.

51. The apparatus according to claim 50, wherein said at least one spinnerette and said at least one heated apertured plate comprise capillaries having a cross-sectional area of about 0.1 $mm^2$.

52. The apparatus according to claim 51, wherein said at least one spinnerette and said at least one heated apertured plate comprise capillaries having a length of about 1.5 mm.

53. The apparatus according to claim 41, wherein said at least one spinnerette and said at least one heated apertured plate each comprise about 500 to 150,000 capillaries.

54. The apparatus according to claim 41, wherein said at least one spinnerette and said at least one heated apertured plate comprise capillaries having a cross-sectional area of about 0.03 $mm^2$ to 0.3 $mm^2$, and a length of about 1 to 5 mm.

55. The apparatus according to claim 42, wherein said at least one spinnerette and said at least one heated apertured plate each comprise about 500 to 150,000 capillaries.

56. The apparatus according to claim 42, wherein said at least one spinnerette and said at least one heated apertured plate comprise capillaries having a cross-sectional area of about 0.03 $mm^2$ to 0.3 $mm^2$, and a length of about 1 to 5 mm.

57. The apparatus according to claim 6, wherein said means for quenching comprise means for radial quenching.

58. The apparatus according to claim 57, wherein said means for radial quenching comprise means for effecting flow of an oxidative gas at a flow rate of about 3,000 to 12,000 ft/min.

59. The apparatus according to claim 58, wherein said means for radial quenching comprise means for effecting flow of an oxidative gas at a flow rate of about 4,000 to 9,000 ft/min.

60. The apparatus according to claim 59, wherein said means for radial quenching comprise means for effecting flow of an oxidative gas at a flow rate of about 5,000 to 7,000 ft/min.

61. The apparatus according to claim 6, wherein said means for quenching comprise means for blowing an oxidative gas through at least one nozzle.

62. The apparatus according to claim 61, comprising means for adjustably directing flow of oxidative gas from said at least one nozzle to a central portion of said at least one spinnerette.

63. The apparatus according to claim 62, wherein said means for blowing comprise means for effecting flow of an oxidative gas at a flow rate of about 3,000 to 12,000 ft/min.

64. The apparatus according to claim 63, wherein said means for blowing comprise means for effecting flow of an oxidative gas at a flow rate of about 4,000 to 9,000 ft/min.

65. The apparatus according to claim 64, wherein said means for blowing comprise means for effecting flow of an oxidative gas at a flow rate of about 5,000 to 7,000 ft/min.

66. The apparatus according to claim 62, wherein said at least one nozzle has an angle of about 0° to 60° with respect to a plane longitudinally passing through said at least one spinnerette.

67. The apparatus according to claim 66, wherein said angle is about 10° to 60°.

68. The apparatus according to claim 66, wherein said angle is about 0° to 45°.

69. The apparatus according to claim 68, wherein said angle is about 0° to 25°.

70. The apparatus according to claim 6, including an additional means for heating the polymer composition to a temperature of about 200° C. to 300° C. prior to the polymer composition reaching said means for heating.

71. The apparatus according to claim 6, wherein said means for heating comprise means for directly heating said at least one spinnerette by impedance or resistance.

72. The apparatus according to claim 6, wherein said means for heating comprise means for inductance heating.

73. The apparatus according to claim 6, wherein said means for heating comprise means for magnetic heating.

74. The apparatus according to claim 6, wherein said means for feeding a polymer composition to said at least one spinnerette is capable of obtaining a spinning speed of about 80 to 100 meters per minute through said at least one spinnerette.

75. The apparatus according to claim 6, wherein said at least one spinnerette has a width of about 30–150 mm and a length of about 300 to 700 mm.

76. The apparatus according to claim 75, wherein said at least one spinnerette has a width of about 40 mm and a length of about 450 mm.

77. The apparatus according to claim 75, wherein said at least one spinnerette has a width of about 100 mm and a length of about 510 mm.

78. The apparatus according to claim 6, wherein said at least one spinnerette has a diameter of about 100 to 600 mm.

79. The apparatus according to claim 78, wherein said at least one spinnerette has a diameter of about 400 mm.

80. The apparatus according to claim 78, wherein said means for quenching comprise means for radial quenching.

81. Apparatus for spinning polymer filaments, comprising:

at least one spinnerette;

means for feeding polymer composition to said at least one spinnerette to obtain a spinning speed of about 10 to 200 meters per minute through said at least one spinnerette to extrude molten filaments;

means for substantially uniformly heating said at least one spinnerette to a temperature of at least about 230° C.; and means for immediately quenching molten filaments of extruded polymer in an oxidative atmosphere at a flow rate of about 3,000 to 12,000 ft/min, as the molten filaments exit said at least one spinnerette, to effect oxidative chain scission degradation of at least a surface of the molten filaments to obtain filaments having a skin-core structure.

82. The apparatus according to claim 81, wherein said means for heating comprise elements for substantially uniformly heating said at least one spinnerette to a temperature of at least about 250° C.

83. The apparatus according to claim 81, wherein said means for heating comprise elements for substantially uniformly heating said at least one spinnerette to a temperature of about 230° C. to 370° C.

84. Apparatus for spinning polymer filaments, comprising:

at least one spinnerette;

means for feeding polymer composition to said at least one spinnerette to obtain a spinning speed of about 10 to 200 meters per minute through said at least one spinnerette to extrude molten filaments;

at least one element positioned upstream of said at least one spinnerette, said at least one element permitting passage of polymer composition;

means for substantially uniformly heating said at least one element to a temperature of at least about 250° C.;

said at least one element and said at least one spinnerette being positioned sufficiently close to each other so that as the polymer exits said at least one spinnerette the polymer maintains a sufficient temperature to obtain a skin-core structure upon quenching in an oxidative atmosphere; and means for immediately quenching molten filaments of extruded polymer in an oxidative atmosphere, as the molten filaments exit said at least one spinnerette, to effect oxidative chain scission degradation of at least a surface of the molten filaments to obtain filaments having a skin-core structure.

85. The apparatus according to claim 84, wherein said at least one element is positioned apertured plate is positioned about 1 to 4 mm upstream of said at least one spinnerette.

86. Apparatus for spinning polymer filaments, comprising:

at least one spinnerette;

means for feeding polymer composition to said at least one spinnerette to obtain a spinning speed of about 10 to 200 meters per minute through said at least one spinnerette to extrude molten filaments;

at least one apertured plate positioned upstream of said at least one spinnerette;

means for substantially uniformly heating said at least one apertured plate to a temperature of at least about 250° C.; and means for quenching molten filaments of extruded polymer in an oxidative atmosphere having a flow rate of about 3,000 to 12,000 ft/min, as the molten filaments exit said at least one spinnerette, to effect oxidative chain scission degradation of at least a surface of the molten filaments to obtain filaments having a skin-core structure.

87. The apparatus according to claim 86, wherein said means for heating comprise elements for substantially uniformly heating said at least one apertured plate to a temperature of about 250° C. to 370° C.

88. The apparatus according to claim 87, wherein said means for heating comprise elements for substantially uniformly heating said at least one apertured plate to a temperature of about 280° C. to 350° C.

89. The apparatus according to claim 88, wherein said means for heating comprise elements for substantially uniformly heating said at least one apertured plate to a temperature of about 300° C. to 350° C.

90. The apparatus according to claim 86, wherein said at least one apertured plate is positioned about 1 to 4 mm upstream of said at least one spinnerette.

91. Apparatus for spinning polymer filaments, comprising:

at least one spinnerette;

a feeding mechanism effecting extrusion of polymer composition through said at least one spinnerette to extrude molten filaments;

at least one apertured element positioned upstream and in the vicinity of said at least one spinnerette;

elements associated with said apertured element to substantially uniformly heat said at least one apertured element to a temperature of at least about 250° C.; and a quenching system adapted to quench molten filaments of extruded polymer in an oxidative atmosphere, as the molten filaments exit said at least one spinnerette, to effect oxidative chain scission degradation of at least a surface of the molten filaments to obtain filaments having a skin-core structure.

92. Apparatus for spinning polymer filaments, comprising:

at least one spinnerette;

elements associated with said at least one spinnerette to substantially uniformly heat said at least one spinnerette to obtain sufficient heating of the polymer composition to obtain a skin-core filament structure upon quenching in an oxidative atmosphere;

spinning elements associated with said at least one spinnerette to obtain a spinning speed of about 10 to 200 meters per minute through said at least one spinnerette; and a quenching system positioned to immediately quench molten filaments of extruded polymer in an oxidative atmosphere, as molten filaments exit said at least one spinnerette, to effect oxidative chain scission degradation of at least a surface of the molten filaments to obtain filaments having a skin-core structure.

93. Apparatus for spinning polymer filaments, comprising:

at least one spinnerette;

elements associated with said at least one spinnerette to substantially uniformly heat said at least one spinnerette to a temperature of at least about 230° C.;

spinning elements associated with said at least one spinnerette to obtain a spinning speed of about 10 to 200 meters per minute through said at least one spinnerette; and a quenching system positioned to immediately quench molten filaments of extruded polymer in an oxidative atmosphere at a flow rate of about 3,000 to 12,000 ft/min, as molten filaments exit said at least one spinnerette, to effect oxidative chain scission degradation of at least a surface of the molten filaments to obtain filaments having a skin-core structure.

94. Apparatus for spinning polymer filaments, comprising:

at least one spinnerette;

spinning elements associated with said at least one spinnerette to obtain a spinning speed of about 10 to 200 meters per minute through said at least one spinnerette; and at least one element positioned upstream of said at least one spinnerette, said at least one element permitting passage of polymer composition;

elements associated with said at least one element to uniformly heating said at least one element to a temperature of at least about 250° C.;

said at least one element and said at least one spinnerette being positioned sufficiently close to each other so that as the polymer exits said at least one spinnerette the polymer maintains a sufficient temperature to obtain a skin-core structure upon quenching in an oxidative atmosphere; and a quenching system positioned to immediately quench molten filaments of extruded polymer in an oxidative atmosphere, as molten filaments exit said at least one spinnerette, to effect oxidative chain scission degradation of at least a surface of the molten filaments to obtain filaments having a skin-core structure.

95. Apparatus for spinning polymer filaments in a short spin process, comprising:

at least one spinnerette;

elements associated with said at least one spinnerette to substantially uniformly heat said at least one spinnerette to obtain sufficient heating of the polymer composition to obtain a skin-core filament structure upon quenching in an oxidative atmosphere;

spinning elements associated with said at least one spinnerette to obtain a short spin spinning speed through said at least one spinnerette; and a quenching system positioned to immediately quench molten filaments of extruded polymer in an oxidative atmosphere, as molten filaments exit said at least one spinnerette, to effect oxidative chain scission degradation of at least a surface of the molten filaments to obtain filaments having a skin-core structure.

96. Apparatus for spinning polymer filaments in a short spin process, comprising:

at least one spinnerette;

spinning elements associated with said at least one spinnerette to obtain a short spin spinning speed through said at least one spinnerette; and at least one element positioned upstream of said at least one spinnerette, said at least one element permitting passage of polymer composition;

elements associated with said at least one element to uniformly heating said at least one element to a temperature of at least about 250° C.;

said at least one element and said at least one spinnerette being positioned sufficiently close to each other so that as the polymer exits said at least one spinnerette the polymer maintains a sufficient temperature to obtain a skin-core structure upon quenching in an oxidative atmosphere; and a quenching system positioned to immediately quench molten filaments of extruded polymer in an oxidative atmosphere, as molten filaments exit said at least one spinnerette, to effect oxidative chain scission degradation of at least a surface of the molten filaments to obtain filaments having a skin-core structure.

* * * * *